US005334493A

United States Patent [19]

Fujita et al.

[11] Patent Number: 5,334,493

[45] Date of Patent: Aug. 2, 1994

[54] PHOTOGRAPHIC PROCESSING SOLUTION HAVING A STABILIZING ABILITY AND A METHOD FOR PROCESSING A SILVER HALIDE COLOR PHOTOGRAPHIC LIGHT-SENSITIVE MATERIAL

[75] Inventors: Yoshihiro Fujita; Masakazu Morigaki; Hiroshi Kawamoto; Shigeru Nakamura; Morio Yagihara; Hiroyuki Watanabe, all of Kanagawa, Japan

[73] Assignee: Fuji Photo Film Co., Ltd., Kanagawa, Japan

[21] Appl. No.: 128,278

[22] Filed: Sep. 29, 1993

Related U.S. Application Data

[63] Continuation of Ser. No. 805,954, Dec. 12, 1991, abandoned.

[30] Foreign Application Priority Data

Dec. 12, 1990 [JP] Japan ..... 2-401513
Feb. 12, 1991 [JP] Japan ..... 3-39022

[51] Int. Cl.[5] ..... G03C 11/00

[52] U.S. Cl. ..... 430/463; 430/372; 430/428; 430/429

[58] Field of Search ..... 430/372, 428, 429, 463

[56] References Cited

U.S. PATENT DOCUMENTS

| | | | |
|---|---|---|---|
| 4,251,624 | 2/1981 | GBX | 430/463 |
| 4,786,583 | 11/1988 | Schwartz | 430/372 |
| 4,855,216 | 8/1989 | Meckl et al. | 430/372 |
| 4,859,574 | 8/1989 | Gormel | 430/372 |
| 5,110,716 | 5/1992 | Kuse et al. | 430/428 |

FOREIGN PATENT DOCUMENTS

| | | | |
|---|---|---|---|
| 2153350 | 6/1990 | Japan | 430/428 |

*Primary Examiner*—Hoa Van Le
*Attorney, Agent, or Firm*—Sughrue, Mion, Zinn, Macpeak & Seas

[57] ABSTRACT

A photographic processing solution for processing a silver halide color photographic light-sensitive material and a processing method using the same is disclosed. The photographic processing solution comprises formaldehyde and an amine compound having at least one —NH— group in the —NH— equivalent amount per liter of the photographic processing solution being greater than the molar concentration of formaldehyde in the photographic processing solution. The photographic processing solution is stable and has a reduced formaldehyde vapor pressure. The processing method provides excellent image stability.

10 Claims, No Drawings

PHOTOGRAPHIC PROCESSING SOLUTION HAVING A STABILIZING ABILITY AND A METHOD FOR PROCESSING A SILVER HALIDE COLOR PHOTOGRAPHIC LIGHT-SENSITIVE MATERIAL

This is a continuation of application Ser. No. 07/805,954 filed Dec. 12, 1991, now abandoned.

FIELD OF INVENTION

The present invention relates to a photographic processing solution having a stabilizing ability for processing a silver halide color photographic light-sensitive material (hereinafter referred to as a light-sensitive material) and a processing method using the same. More particularly, the present invention relates to a photographic processing solution having a stabilizing ability, which contains formaldehyde and has a reduced formaldehyde vapor pressure, and which processing method provides a dye image having excellent long-term storage stability.

BACKGROUND OF THE INVENTION

In general, the basic steps for processing a light-sensitive material are a color developing step and a desilvering step. In the color developing step, exposed silver halide is reduced with a color developing agent to generate silver, and the oxidized color developing agent reacts with a coupler to form a dye image. In the following desilvering step, silver formed in the color developing step is oxidized by the action of an oxidizing agent (generally called a bleaching agent ) and the oxidized silver is then dissolved with an agent for forming a complex ion of a silver ion (generally called a fixing agent). After the desilvering step, the dye images thus formed (but no silver) remain on the light-sensitive material.

Usually, after these steps, washing (e.g., water washing) is carried out to remove .residual processing solutions entrained in the light-sensitive material.

In the case of a color paper and a reversal color paper, the processing is finished with the above steps and is generally followed by a drying step. In the processing of a color negative film and a reversal color film, an additional stabilizing step is necessarily provided between the fixing step and the drying step. It is well known that the stabilizing bath at the final step following the fixing and/or washing steps contains formaldehyde to prevent fading of the magenta dye image due to magenta coupler remaining in the light-sensitive material after processing. Some quantity of formaldehyde vapor is generated when the stabilizing bath containing formalin is prepared, and when the light-sensitive material containing stabilizing solution carried out from the processing bath is dried.

Particularly, the preparation of a stabilizing solution is the operation in which a condensate (usually called a kit) is diluted with water. There is a danger in the preparation of a stabilizing solution in contacting formaldehyde vapor of a relatively high concentration due to handling of the condensate having a high concentration of formalin.

It is known that the inhalation of formaldehyde vapor is harmful for humans, and the Japan Association of Industrial Health advises that an allowable concentration of formaldehyde in a working environment is 0.5 ppm or less. Therefore, efforts to reduce the concentration of formaldehyde in the stabilizing bath, and to replace formaldehyde with alternatives have been made to improve the working environment.

A hexamethylenetetramine compound is proposed, for example, in JP-A-63-244036 (the term "JP-A" as used herein means an unexamined published Japanese patent application) as an alternative for formalin. The use of this compound reduces the formaldehyde vapor pressure. However, the compound of JP-A-63-244036 restricts the anti-fading function of formaldehyde for a magenta dye, i.e., the reason for adding formaldehyde to the stabilizing solution, and causes a marked fading of the magenta image within several weeks even at room temperature.

Furthermore, use of N-methylol compounds such as urea, guanidine and melamine is proposed in the specifications of U.S. Pat. Nos. 4,786,583 and 4,859,574.

These compounds can clearly reduce the vapor pressure of formaldehyde, but the reduction in vapor pressure is not sufficient for practical use.

Furthermore, another aspect is that the incorporation of formaldehyde into a processing solution markedly deteriorates the stability of the processing solution. For example, the formaldehyde added to washing water and a stabilizing solution reacts with sulfite ion carried over from a fixing solution or bleach/fixing solution to thereby form a precipitate of sulfite in the processing solution.

The method for preventing such precipitate due to the presence of formaldehyde is described in U.S. Pat. No. 4,786,583, in which alkanolamine is used. However, this method although effective to some extent is not sufficient, and the above sulfurization takes place to cause turbidity and form a precipitate in the solution when the solution exchange rate is low.

Also in a bleaching solution and a conditioning solution (a bleach-accelerating solution) which is a prebath of the bleaching solution, the incorporation of formaldehyde likewise causes the deterioration of the processing solution. Furthermore, turbidity and the formation of a precipitate undesirably clog the filter of an automatic developing machine and the precipitate adheres to a light-sensitive material being processed.

Therefore, there is a need in the art for a technique which provides sufficient anti-fading function to a magenta dye image and reduces formaldehyde vapor pressure.

SUMMARY OF THE INVENTION

A first object of the present invention is to provide a photographic processing solution having a stabilizing ability which does not substantially release compounds which are harmful to humans.

A second object of the present invention is to provide a processing method for a light-sensitive material which is safe and provides excellent image storage properties after processing.

Furthermore, a third object of the present invention is to provide a processing method which provides excellent image storage properties and which does not result in turbidity or formation of a precipitate in a photographic processing solution.

The above objects of the present invention have been achieved by:

(1) a photographic processing solution having a stabilizing ability for a magenta dye image comprising, (A) formaldehyde and (B) an amine compound having at least one —NH— group wherein the —NH— equivalent amount per liter of the photographic processing solution being greater than the molar concentration of formaldehyde in the photographic processing solution, and (2) a method for processing a silver halide color photographic light-sensitive material, comprising color developing in a color developing solution followed by desilvering in a bleaching or bleach-fixing solution, wherein at least one of the photographic processing solutions used to process the light-sensitive material comprises (A) formaldehyde and (B) an amine compound having at least one —NH— group in the above described ratio.

DETAILED DESCRIPTION OF THE INVENTION

As used herein, the term "formaldehyde" in reference to an aqueous processing solution containing formaldehyde includes both the dissolved formaldehyde and formaldehyde hydrate species. The term "formalin" as used herein means an aqueous solution containing formaldehyde.

An aqueous processing solution containing formaldehyde (i.e., formalin) will release formaldehyde fumes (and fumes of other volatile components) in correspondence with the vapor pressure of the formaldehyde in solution. The vapor pressure depends on the concentration of formaldehyde in solution and temperature.

The present invention is characterized in that the photographic processing solution having a stabilizing ability used for processing a light-sensitive material has a markedly reduced concentration and vapor pressure of formaldehyde while providing excellent dye image stability.

Thus, the stabilization processing technique of the present invention can be applied to different types of processing solutions, and is not particularly limited with respect to the light-sensitive material to be processed.

As used herein, a photographic processing solution having a stabilizing ability is a photographic processing solution which prevents the fading of a magenta dye image obtained by color-developing upon storage. The stabilization processing solution contains formaldehyde and an amine compound of the present invention in a specified ratio, and the processing steps are not particularly limited.

Accordingly, formaldehyde and the amine compounds of the present invention can be added to any one of the processing solutions used for processing a color light-sensitive material in a specified ratio to prepare the processing solution having a stabilizing ability of the present invention. These compounds are added preferably to the processing solutions used in the processing steps following a color developing step. Examples thereof are a bleaching solution, a bleach-fixing solution, a fixing solution, a stopping solution, a conditioning solution, a washing solution, a rinsing solution, and a stabilizing solution. Among them, more preferred are a bleaching solution, a stopping solution, a conditioning solution, and a stabilizing solution, and particularly preferred are a bleaching solution, a conditioning solution and a stabilizing solution. Of these, a stabilizing solution is most preferred. When the compounds of the present invention are contained in a conditioning solution or bleaching solution, the compounds need not be contained in what would generally serve as the stabilizing solution. In this case, the naming of the stabilizing solution is inappropriate because the processing solution itself no longer has the effect of stabilizing the color image, but hereafter it will be called that for convenience.

The photographic processing solution having a stabilizing ability of the present invention effectively lowers formaldehyde vapor pressure, especially at an operation temperature of 35° C. or higher.

The above processing solution is supplied in the form of a condensate to reduce manufacturing and transporting costs. A characteristic feature of the photographic processing solution having a stabilizing ability of the present invention is that the formaldehyde vapor pressure is suppressed to a greater extent in the condensate as compared to the diluted solution.

Accordingly, the condensed processing solution having a stabilizing ability is included in the scope of the present invention, and is a particularly preferred embodiment.

In the present invention, the amine compound has at least one —NH— group. The —NH— group may be bonded to a carbon atom, a hydrogen atom, and a hetero atom such as a nitrogen atom, an oxygen atom and a sulfur atom. Also, a $—NH_2$ group and a =NH group are included within the scope of the —NH— group. The amine compound is preferably a secondary amine compound.

In the present invention, the —NH— equivalent number is the number of —NH— equivalents. The —NH— equivalent is the molecular weight per one —NH— group and expressed in terms of Mw/n, in which Mw is the molecular weight of the amine compound and n is the number of —NH— groups per one molecule of the amine compound. The —NH— equivalent amount in a photographic processing solution is expressed in terms of $n \times m$, wherein m is the molar concentration of the amine compound.

Formaldehyde hydrate is a chemical species obtained by dissolving formaldehyde in water and has the formula $H_2C(OH_2)$ which is the adduct of formaldehyde and water.

The photographic processing solution having a stabilizing ability of the present invention may further contain an N-methylol product of the amine compound.

In the present invention, the composition of the photographic processing solution having a stabilizing ability is controlled such that the —NH— equivalent number is greater than the sum of the molar concentrations of formaldehyde and/or formaldehyde hydrate. As used herein, formaldehyde concentration in aqueous solution includes both formaldehyde and formaldehyde hydrate specie.

The coexistence of the amine compound having at least one —NH— group and formaldehyde sets up an equilibrium reaction according to the following equation.

$$—NH— + HCHO \underset{kr}{\overset{kf}{\rightleftharpoons}} —\overset{\overset{CH_2OH}{|}}{N}—$$

in $H_2O$ at r.t.

kr: formaldehyde-releasing rate constant.

kf: rate of generation of an N-methylol product.

K: equilibrium constant defined by:

$$\frac{[—NH—]\,[HCHO]}{[—N(CH_2OH)—]}$$

Accordingly, in addition to the amine compound having the —NH— group and formaldehyde, there exists in the solution the chemical species formed by the reaction of —NH— and HCHO, such as an N-methylol product having the group —N($CH_2OH$)—.

Thus, when considered in reference to the above equilibrium reaction, the amine compound reversibly reacts with HCHO to tie-up much of the free HCHO as an N-methylol product. Thus, the photographic processing solution has a reduced formaldehyde vapor pressure. When HCHO is removed from the photographic processing solution, some of the N-methylol product is converted to free HCHO to maintain the equilibrium condition.

In the photographic processing solution having a stabilizing ability of the present invention, the concentrations [—NH—] and [HCHO] (including formaldehyde hydrate) are regulated among the concentrations or equivalents [—NH—], [HCHO] and [—N($CH_2OH$)—] of the chemical species contained in the photographic processing solution. That is, in the photographic processing solution having a stabilizing ability of the present invention, the —NH— equivalent amount per liter is greater than the molar equilibrium concentration of formaldehyde per liter. These concentrations can readily be measured by conventional measuring means, for example, nuclear magnetic resonance (NMR). Some formaldehyde and/or formaldehyde hydrate is always present, even if in a trace amount for example, of $1\times10^{-9}$ mole/liter or less. In regulating the concentrations of formaldehyde and/or the formaldehyde hydrate, concentrations as low as $1\times10^{-9}$ mole/liter or less and $1\times10^{-12}$ mole/liter or less are included within the scope of the present invention.

In the present invention, a molar concentration ratio or equivalent number ratio [—NH—]/[HCHO] of more than 1 in the regulated stabilization photographic processing solution is preferred. The concentration of the N-methylol product relative to the reactants is increased especially in the condensed solution. A higher ratio as described above further increases the relative content of the N-methylol product.

The above noted ratio is preferably 1.5 or more, more preferably 2 or more, further more preferably 5 or more, particularly preferably 10 or more, and most preferably 20 or more.

The photographic processing solution having a stabilizing ability is advantageously regulated with the addition amounts in the preparation thereof and preferred are (1) a method in which an amine compound having formaldehyde (including formaldehyde hydrate) and at least one —NH— group is added in an —NH— equivalent amount greater than the molar concentration of formaldehyde and (2) a method in which an amine compound having at least one—NH— group is added in an —NH— equivalent amount greater than the equivalent amount of an N-methylol product added to the photographic processing solution having a stabilizing ability.

For example, the amine compound having one —NH— group per molecule can be added in a molar amount greater than the molar amount of formaldehyde, while an amine compound having two —NH— groups per molecule can be added in a molar amount greater than one-half of the molar amount of formaldehyde added to the photographic processing solution.

The former method (1) is preferred, wherein an amine compound having at least one —NH— group per molecule is added in an equivalent number amount of at least 1.2 times the molar amount of formaldehyde, particularly preferably 1.5 to 5 times the molar amount of formaldehyde. The upper limit of the addition of the amine compound is that amount which provides an —NH— equivalent amount of up to 10 times, preferably up to 5 times the molar amount of formaldehyde to avoid problems of staining.

In the latter method (2), the amine compound is added in an—NH— equivalent amount of at least 1.2 times the amount of N-methylol product, more preferably 1.5 to 5 times the amount of N-methylol product.

In the present invention, the amine compound having an —NH— group preferably has a pKa of 8 or less, more preferably 7 or less and further more preferably 6 or less at room temperature (20° C.) in water.

From the viewpoint of the reactivity, amine compounds which satisfy the following conditions are preferred:

1. Amine compounds having an equilibrium constant K of $3\times10^{-2}$ mole/liter or less, preferably $2\times10^{-2}$ mole/liter or less and more preferably $1\times10^{-2}$ mole/liter or less.

2. Amine compounds having a formaldehyde-releasing rate constant kr of $1\times10^{-6}$ $sec^{-1}$ or more, preferably $1\times10^{-5}$ $sec^{-1}$ or more, more preferably $1\times10^{-4}$ $sec^{-1}$ or more, further more preferably $1\times10^{-3}$ $sec^{-1}$ or more, and most preferably $1\times10^{-2}$ $sec^{-1}$ or more.

3. Amine compounds satisfying the conditions 1 and 2.

For regulating the concentrations of the various species of the photographic processing solution having a stabilizing ability, amine compounds having a larger equilibrium constant K are added in a greater amount than amine compounds having a smaller equilibrium constant K from the viewpoint of reactivity.

For example, when the equilibrium constant K of the amine compound is $3\times10^{-3}$ to $5\times10^{-3}$ mole/liter (in the situation where both an N-methylol product and an amine compound are added ), the amine compound is added preferably in an —NH— equivalent number amount of from 1.2 to 5 times the equivalent number amount of the N-methylol product. In the case that equilibrium constant K is of the amine compound is different by a factor of n times, the amine compound is added preferably in an —NH— equivalent amount of n×(1.2 to 5) times the equivalent number amount of the N-methylol product.

In the present invention, the photographic processing solution having a stabilizing ability containing an amine compound having a —NH— group and formaldehyde regulated by the equilibrium concentrations thereof may contain a single amine compound or a combination of amine compounds. The photographic processing solution contains preferably a single amine compound.

Amine compounds having an —NH— group preferably used in the present invention are represented by the following formula (I):

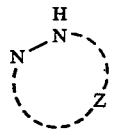

(I)

wherein Z represents a group of non-metallic atoms necessary to form a 4 to 8-membered ring, provided that the ring member of Z bonded to the nitrogen atom of the $$-\overset{H}{N}-N-$$

group is selected from a carbon atom, an oxygen atom and a sulfur atom.

The ring formed by Z may be substituted with, for example, an alkyl group, an alkenyl group, an aryl group, a heterocyclic group, a halogen atom, a nitro group, a cyano group, a sulfo group, a carboxyl group, a phospho group, an acyl group, a sulfonyl group, a sulfinyl group, an acyloxy group, an alkoxycarbonyl group, a carbamoyl group, a sulfamoyl group, an amino group, etc., and may be condensed with an aromatic ring, an aliphatic ring or a hetero ring, and may also be a spiro ring.

Examples of the 4 to 8-membered ring formed by Z includes a pyrazole ring, a 1,2,4-triazole ring and an urazole ring.

Among the amine compounds of the present invention, preferred are compounds having a total carbon atom number of 15 or less, more preferably 10 or less.

In the present invention, the amine compound is more preferably represented by formula (I'):

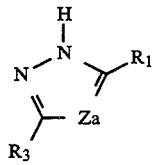

(I')

wherein Za represents —N= or —C($R_2$)', $R_1$, $R_2$ and $R_3$ may be the same or different and each represents a hydrogen atom, an alkyl group, an alkenyl group, an aryl group, a heterocyclic group, a halogen atom, a nitro group, a cyano group, a sulfo group, a carboxyl group, a phospho group, an acyl group, a sulfonyl group, a sulfinyl group, an acyloxy group, an alkoxycarbonyl group, a carbamoyl group, a sulfamoyl group, an amino group, or —YRa, in which Y represents an oxygen atom or a sulfur atom, and Ra represents an alkyl group, an alkenyl group, an aryl group or a heterocyclic group; the above groups may be further substituted with the group represented by $R_1$ and a hydroxyl group; and $R_1$ and $R_2$ or $R_2$ and $R_3$ may be combined with each other to form a 5 to 7-membered ring such as a cycloalkane or phenyl ring.

In more detail, $R_1$, $R_2$ and $R_3$ each represent a hydrogen atom, an alkyl group (for example, methyl, ethyl, n-propyl, butyl, cyclopropyl, hydroxymethyl and methoxymethyl), an alkenyl group (for example, allyl), an aryl group (for example, phenyl and 4-tert-butylphenyl), a heterocyclic group (for example, 5-pyrazole and 4-pyrazole), a halogen atom (for example, fluorine, chlorine and bromine), a nitro group: a cyano group, a sulfo group, a carboxyl group, a phospho group, an acyl group (for example, acetyl, benzoyl and propanoyl), a sulfonyl group (for example, methanesulfonyl, octanesulfonyl and toluenesulfonyl), a sulfinyl group (for example, dodecanesulfinyl), an acyloxy group (for example, acetoxy), an alkoxycarbonyl group (for example, methoxycarbonyl and butoxycarbonyl), a carbamoyl group (for example, carbamoyl and N-ethylcarbamoyl), a sulfamoyl group (for example, sulfamoyl and N-ethylsulfamoyl), an amino group (for example, amino, diethylamino, acetylamino, methanesulfonamino, methylureido, N-methylsulfamoylamino, and methoxycarbonylamino), an alkoxy group (for example, methoxy and ethoxy), an alkylthio group (for example, methylthio and octylthio), an aryloxy group (for example, phenoxy), an arylthio (for example, phenylthio), a hetrocyclicoxy group (for example, 1-phenyltetrazole-5-oxy), and a heterocyclicthio group (for example, benzothiazolylthio).

For providing an enhanced heat-fading property of a cyan image or for prevention of a yellow stain, preferred are the compounds in which $R_1$, $R_2$ and $R_3$ in formula (I') independently represent a hydrogen atom or an unsubstituted alkyl group having 1 to 3 carbon atoms, more preferred are the compounds in which at most one of $R_1$, $R_2$ and $R_3$ is methyl and the others are hydrogen atoms, and particularly preferred are the compounds in which all of $R_1$, $R_2$ and $R_3$ are the hydrogen atoms.

Examples of the amine compounds of the present invention are shown below, but the present invention is not to be construed as being limited thereto.

Ip-1

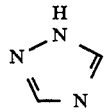

Ip-2

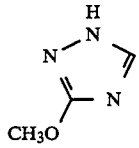

Ip-3

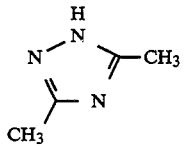

Ip-4

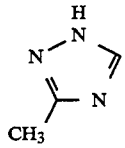

Ip-5

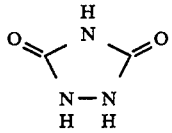

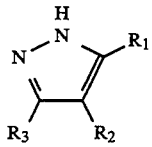

| Compound | $R_1$ | $R_2$ | $R_3$ |
|---|---|---|---|
| (I-1) | H | H | H |
| (I-2) | $CH_3$ | H | H |
| (I-3) | H | $CH_3$ | H |
| (I-4) | H | H | $CH_3$ |
| (I-5) | $CH_3$ | H | $CH_3$ |
| (I-6) | H | H | $C_2H_5$ |
| (I-7) | H | H | $CH_2OH$ |
| (I-8) | H | H | $CH_2OCH_3$ |

-continued

| | | | |
|---|---|---|---|
| (I-9) | H | H | $C_3H_5(n)$ |
| (I-10) | H | H | 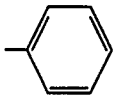 |
| (I-11) | H | H | 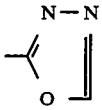 |
| (I-12) | H | $C_2H_5$ | H |
| (I-13) | H | $CH_2OH$ | H |
| (I-14) | $CH_3$ | $CH_3$ | $CH_3$ |
| (I-15) | $CH_2OH$ | H | $CH_3$ |
| (I-16) | $CH_3$ | H | 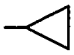 |
| (I-17) | $\leftarrow CH_2 \rightarrow_4$ | | $CH_2OH$ |
| (I-18) | H | H | H 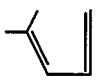 |
| (I-18) | H | 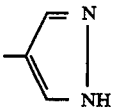 | H |
| (I-20) | H | H | $CO_2CH_3$ |
| (I-21) | $CH_3$ | Cl | $CH_3$ |
| (I-22) | H | $NO_2$ | H |
| (I-23) | H | H | $COCH_3$ |
| (I-24) | $OCH_3$ | H | $CH_3$ |
| (I-25) | —CH=CH—CH=CH— | | H |
| (I-26) | H | Cl | H |
| (I-27) | H | $CO_2C_2H_5$ | H |
| (I-28) | H | CN | H |
| (I-29) | $CH_3$ | H | $NHCOCH_3$ |

The amine compounds of the present invention are commercially available. Also, the amine compounds can be synthesized by the methods described in R. H. Wiley "Pyrazoles, Pyrazolines, Pyrazolidines, Indoles and Condensed Ring" in *The Chemistry of Heterocyclic Compounds,* Vol. 22, published by Interscience Publishers (1967), or by methods corresponding thereto.

The technique of the present invention may be applied to a stabilizing solution used as the final processing step of a color negative film and a color reversal film and may also be used in place of a water washing step. Where the final step is a water washing and a rinsing step, the technique of the present invention may be applied to a stabilizing solution and replenisher thereof used prior thereto.

When the technique of the present invention (i.e., addition of compounds of the present invention) is applied to photographic processing solutions other than a stabilizing solution, the replenishers of such processing solutions are also included in the scope of the present invention.

The replenishing solutions for the respective processing solutions are formulated such that the properties of the processing solutions are maintained at the prescribed levels by replenishing the components decreased due to consumption and deterioration during processing and storage in an automatic processing machine and by controlling the concentrations of the components eluted from a light-sensitive material in processing. Accordingly, the concentrations of components which are consumed during processing are higher in the replenishing solution than in the corresponding processing solution, and components consumed to a lesser extent are contained in lower concentrations in the replenishing solution as opposed to the processing solution. The components which are less susceptible to variations in concentrations by processing and storage are contained in the replenisher usually in about the same concentrations as those of the processing solutions.

The photographic processing solution having a stabilizing ability of the present invention contains a small amount of formaldehyde, and lower concentrations thereof are preferable for reducing the vapor pressure of the formaldehyde. The total concentration of formaldehyde and/or the formaldehyde hydrate is preferably 0. 005 mole/liter or less, particularly preferably 0.003 mole/liter or less.

The preferred content of the amine compound of the present invention is from 0. 003 to 0.3 mole, more preferably 0.010 to 0.10 mole per liter of the photographic processing solution having a stabilizing ability.

The preferred content of the N-methylol product of the amine compound of the present invention is from 0.001 to 0.2 mole, more preferably 0.005 to 0.05 mole per liter of the photographic processing solution having a stabilizing ability.

The photographic processing solution having a stabilizing ability of the present invention and other photographic processing solutions to which the technique of the present invention is applied are explained below.

First, a stabilizing solution and a conditioning solution are described containing an amine compound having at least one—NH-group and formaldehyde. A conditioning solution is a photographic processing solution which is also called a bleach-accelerating solution.

The stabilizing solution may contain compounds for stabilizing a dye image, for example, organic acids and pH buffer agents, in addition to the compounds of the present invention. The stabilizing solution can contain those compounds which are generally added to washing water as described below. Other additives, as required, include ammonium compounds such as ammonium chloride and ammonium sulfite, metal compounds of Bi and Al, fluorescent whitening agents, hardeners, and alkanolamines as described in U.S. Pat. No. 4,786,583.

The stabilizing solution generally has a pH ranging from 4 to 9, preferably 6 to 8.

In the present invention, the replenishing amount of the stabilizing solution is preferably 200 to 1500 ml, particularly 300 to 600 ml per $m^2$ of a light-sensitive material being processed.

When the present invention is applied to a stabilizing solution, the processing temperature is preferably 30° to 45° C.; the processing time is preferably 10 seconds to 2 minutes, particularly 15 to 30 seconds.

In addition to the compound of the present invention, there can be incorporated into the conditioning bath, aminocarboxylic acid chelating agents such as ethylenediaminetetraacetic acid, diethylentriaminepentaacetic acid, 1,3-diaminopropanetetraacetic acid, and cyclohexanediaminetetraacetic acid; and various bleach-accelerating agents including sulfites such as soditun sulfite and ammoniura sulfite, thioglycerine, aminoethanethiol, and sulfoethanethiol.

Further, for the purpose of preventing scums there are preferably incorporated therein sorbitan esters of fatty acids substituted with ethylene oxide, described in U.S. Pat. No. 4,839,262, and polyoxyethylene compounds described in U.S. Pat. No. 4,059,446 and Research Disclosure., vol. 191, 19104 (1980).

These compounds can be used in the range of 0.1 to 20 g, preferably 1 to 5 g, per liter of the conditioning solution.

The pH value of the conditioning solution is usually 3 to 11, preferably 4 to 9, and more preferably 4.5 to 7.

The processing time in the conditioning solution is 30 seconds to 5 minutes.

The replenishing amount for the conditioning solution is preferably 30 to 3000 ml, particularly preferably 50 to 1500 ml, per $m^2$ of a light-sensitive material.

The processing temperature of the conditioning solution is preferably 20° to 50° C., particularly preferably 30° to 40° C.

Usually, after being subjected it to an imagewise exposure, a silver halide color photographic light-sensitive material is subjected to a color development in the case of negative type and positive type light-sensitive materials, and to a color development following a black/white development and a reversal processing in the case of a reversal positive type light-sensitive material.

The color developing solution which can be used in the present invention is an alkaline aqueous solution containing an aromatic primary amine color developing agent as the main component.

The preferred color developing agent is a p-phenylenediamine derivative. Representative examples thereof are shown below, but are not limited thereto:

D-1 N,N-diethyl-p-phenylenediamine;

D-2 2-Methyl-N,N-diethyl-p-phenylenediamine;

D-3 4-[N-ethyl-N-(β-hydroxyethyl) amino] aniline;

D-4 2-Methyl-4-[N-ethyl-N-(β-hydroxyethyl) amino] aniline;

D-5 4-Amino-3-methyl-N-[(β-(methanesulfonamide) ethyl aniline;

D-6 4-Amino-3-methyl-N-ethyl-N-methoxyethylaniline; and

D-7 4-Amino-3-methyl-N-ethyl-N-(4-hydroxybutyl) aniline.

Among the above p-phenylenediamine derivatives, D-4 and D-5 are preferred.

These p-phenylenediamine derivatives may be sulfates, chlorates, sulfites and p-toluenesulfonates thereof.

The aromatic primary amine color ,developing agent is used preferably in a concentration of 0.001 to 0.1 mole, more preferably 0.01 to 0.06 mole, per liter of the color developing solution.

There can be added as a preservative to the color developing solution, sodium sulfite, potassium sulfite, sodium bisulfite, potassium bisulfite, sodium metasulfite, potassium metasulfite, and a carbonyl sulphurous acid adduct, according to necessity.

The addition amount of these preservatives is preferably 0.5 to 10 g, more preferably 1 to 5 g, per liter of the color developing solution.

Examples of the compounds for preserving directly the above aromatic primary amine color developing agent include the various hydroxylamines described in JP-A-63-5341 and JP-A-63-106655 (above all, preferred are the compounds having a sulfo group and a carboxy group); the hydroxamic acids described in JP-A-63-43138; the hydrazines and hydrazides described in JP-A-63-146041; the phenols described in JP-A-63-44657 and JP-A-63-58443; the α-hydroxy ketones and α-aminoketones described in JP-A-63-44656; and the various kinds of sucrose described in JP-A-63-36244.

Also, there can be used in combination with the above compounds: monoamines described in JP-A-63-4235, JP-A-63-24254, JP-A-63-21647, JP-A-63-146040, JP-A-63-27841, and JP-A-63-25654; diamines described in JP-A-63-30845, JP-A-63-14640, and JP-A-63-43139; polyamines described in JP-A-63-21647, JP-A-63-26655, and JP-A-63-44655; nitroxy radicals described in JP-A-63-53551; alcohols described in JP-A-63-43140 and JP-A-63-53549; oximes described in JP-A-63-56654;and tertiary amines described in JP-A-63-239447.

There may be contained according to necessity the other preservatives such as the various metals described in JP-A-57-44148 and JP-A-57-53749; the salicylic acids described in JP-A-59-180588; the alkanolamines described in JP-A-54-3582; the polyethyleneimines described in JP-A-56-94349; and the aromatic polyhydroxy compounds described in U.S. Pat. No. 3,746,544. Among them, the aromatic polyhydroxy compounds are particularly preferable.

The color developing solution preferably has pH of 9 to 12, more preferably 9 to 11.0.

In order to maintain a pH at the above level, various buffer agents are preferably used.

Examples of the buffer agent include sodium carbonate, potassiumcarbonate, sodiumbicarbonate, potassiumbicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate, potassium o-hydroxybenzoate, sodium 5-sulfo-2-hydroxybenzoate (sodium 5-sulfosalicylate), and potassium 5-sulfo-2-hydroxybenzoate (potassium 5-sulfo-salicylate). The addition amount of the buffer agent is preferably 0.1 mole or more, more preferably 0.1 to 0.4 mole, per liter of the color developing solution.

In addition to the above compounds, various chelating agents are preferably used as an anti-precipitation agent for calcium and magnesium or for the purpose of improving the stability of the color developing solution. Organic acid compounds are preferred as the chelating agent and examples thereof include amino-polycarboxylic acids, organic phosphonic acids and phosphonocarboxylic acids.

Representative examples thereof are diethylenetriaminepentaacetic acid, ethylenediaminetetraacetic acid, N,N,N-trimethylenephosphonic acid, ethylenediamine N,N,N', N'-tetramethylenephosphonic acid, transcyclohexanediaminetetraacetic acid, 1,2-diaminopropanetetraacetic acid, hydroxyethyliminodiacetic acid, glycol ether diaminetetraacetic acid, ethylenediamine-orthohydroxyphenylacetic acid, phosphonobutane-1,2,4-tricaboxylic acid, 1-hydroxyethylidene-1,1-diphosphonic acid, and N,N'-bis(2-hydroxybenzyl) ethylenediamine-N,N'-diacetic acid.

These chelating agents may be used in combination of two or more, according to necessity.

The addition amount of the chelating agent may be an amount sufficient to capture metal ions and is at a level, for example, of 0.1 to 10 g per liter of the color developing solution.

Arbitrary development accelerators can be added to the color developing solution according to necessity. However, the color developing solution used in the present invention preferably contains substantially no benzyl alcohol from the viewpoint of a public pollution, the preparing property of the solution and the prevention of a color stain. The term "substantially no benzyl alcohol" means that it is contained in the amount of 2 ml or less per liter of the color developing solution and preferably it is not contained at all.

There can be added as the other development accelerators, the thioether compounds described in JP-B-37-16088 (the term "JP-B" as used herein means an examined Japanese patent publication), JP-B-37-5987, JP-B-38-7826, JP-B-44-12380, and JP-B-45-9019, and U.S. Pat. No. 3,818,247; the p-phenylenediamine compounds described in JP-A-52-49829 and JP-A-50-15554; the quaternary ammonium salts described in JP-A-50-137726, JP-B-44-30074, JP-A-56-156826 and JP-A-52-43429; the amine compounds described in U.S. Pat. Nos. 2,494,903, 3,128,182, 4,230,796, 3,253,919, 2,482,546, 2,596,926, and 3,582,346, and JP-B-41-11431; the polyalkylene oxide described in JP-B-37-16088, JP-B-42-25201, JP-B-41-11431 and JP-B-42-23883, and U.S. Pat. Nos. 3,128,183 and 3,532,501; 1-phenyl-3-pyrazolidones; and imidazoles. They can be added according to necessity.

The addition amount of the development accelerator is 0.01 to 5 g per liter of the color developing solution.

In the present invention, an arbitrary anti-foggant can further be added according to necessity.

There can be used as the anti-foggant, an alkali metal halide such as sodium chloride, potassium bromide and potassium iodide, and an organic anti-foggant. Typical examples of the organic anti-foggant are the nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine, and adenine. The addition amount of the anti-foggant is 0.01 to 1 g per liter of the color developing solution.

The color developing solution used in the present invention may contain a fluorescent whitening agent. The 4,4'-diamine-2,2'-disulfostilbene compounds are preferred as the fluorescent whitening agent. The addition amount thereof is 0 to 5 g, preferably 0.1 to 4 g, per liter of the color developing solution.

Also, there may be added various surfactants such as alkylsulfonic acid, arylsulfonic acid, aliphatic carboxylic acid, and aromatic carboxylic acid.

A color developing-replenishing solution contains the compounds contained in the color developing solution. The functions of the color developing-replenishing solution are (i) to replenish to the color developing solution, the compounds which are consumed due to processing of a light-sensitive material and deterioration caused during the storage in an automatic developing machine and (ii) to maintain the developing properties at the fixed levels by conditioning the concentrations of the compounds eluted from the light-sensitive material by processing. Accordingly, the concentrations of the former are maintained higher than those of the color developing tank solution, and those of the latter are lower. Examples of the former compounds are the color developing agent and preservative, which are contained in amounts 1.1 to 2 times as large as those of the tank solution in the replenishing solution. An example of the latter compound is a development inhibitor represented by halide (for example, potassium bromide), and it is contained in the replenishing solution in the amount 0 to 0.6 times that of the tank solution.

The concentration of the halides in the replenishing solution is usually 0.006 mole/liter or less and has to be decreased more in a lower replenishing, or it may not be contained at all.

The compounds which are less susceptible to concentration variation resulting from processing and storing are contained in the same concentrations as those of the color developing tank solutions. The examples thereof are the chelating agent and the buffer agent.

Further, the pH of the color developing-replenishing solution is maintained higher by 0.05 to 0.5 than that of the tank solution. This difference of pH has to be increased according to the decrease in the replenishing amount.

The color developing solution is replenished in the amount of 3000 m or less, preferably 100 to 1500 ml, per $m^2$ of the light-sensitive material.

The processing temperature in the color developing solution is suitably 20° to 50° C., preferably 30° to 45° C. The processing time is suitably 20 seconds to 5 minutes, preferably 30 seconds to 3 minutes and 20 seconds, and more preferably 1 minute to 2 minutes and 30 seconds.

Also, a color developing bath may be divided into two or more baths according to the need to replenish the color developing-replenishing solution from the front or rear bath thereby to shorten the processing time and reduce the replenishing amount.

The processing method of the present invention can be preferably applied to color reversal processing. Reversal processing is carried out according necessity and then the color development is performed. A black/white developing solution used for the above processing is a so-called first black/white developing solution used for reversal processing of a conventional color light-sensitive material. It can contain various well-known additives which are added to a black/white developing solution used for processing a black/white silver halide light-sensitive material.

Representative additives include developing agents such as 1-phenyl-3-pyazolidone, Metol and hydroquinone, a preservative such as sulfite, an accelerator consisting of an alkali such as sodiumhydroxide, sodiumcarbonate and potassium carbonate, an inorganic or organic inhibitor such as potassium bromide, 2-methylbenzimidazole and methylbenzthiazole, a hard water softener such as polyphosphoric acid, and a development inhibitor consisting of a trace amount of iodide and a mercapto compound.

When processing is carried out with the above black/white developing solution or color developing solution in an automatic developing machine, the area (opening area) in which the developing solution (the color developing solution and black/white developing solution) contacts air is preferably as small as possible. For example, the opening ratio is preferably 0.01 $cm^{-1}$ or less, more preferably 0.005 $cm^{-1}$ or less, wherein the opening ratio is obtained by dividing an opening area ($cm^2$) by the volume ($cm^3$) of the developing solution.

The developing solution can be regenerated for reuse. The regeneration of the developing solution means that the used developing solution is subjected to treatment with an anionic exchange resin and an electro-dialysis, or the processing chemicals called as the regenerating agents are added to the used developing solution, to increase the activity of the developing solution and use it once again as the processing solution.

A regeneration rate (the rate of an overflow solution in a replenishing solution) is preferably 50% or more, particularly 70% or more.

In the processing in which the regeneration of the developing solution is used, the overflow solution is used as the replenishing solution after regenerating.

In a regeneration method, an anionic exchange resin is preferably used. The particularly preferred composition of the anionic exchange resins and the regeneration method of the resins are described in Diaion Manual (I) (14th edition, 1986) published by Mitsubishi Chemical Industry Co., Ltd. Of the anionic exchange resin reins, the resins of the composition described in JP-A-2-952 and JP-A-1-281152 are preferred.

In the present invention, the light-sensitive material after being subjected to color development is subjected to a desilvering processing. The desilvering processing as described herein consists basically of a bleaching processing and a fixing processing. Usually, it consists of a bleach-fixing processing in which both are simultaneously carried out, and the combination of these processings.

The representative desilvering processing steps are shown below:

1. Bleaching—fixing
2. Bleaching—bleach-fixing
3. Bleaching—washing - fixing
4. Bleaching—bleach-fixing - fixing
5. Bleach-fixing
6. Fixing—bleach-fixing Of the above steps, the steps 1, 2, 4 and 5 are particularly preferred. The step 2 is disclosed in, for example, JP-A-61-75352. The step 4 is disclosed in JP-A-61-143755 and Japanese Patent Application No. 2-216389.

The baths such as the bleaching bath and fixing bath applied to the above steps may be a one bath structure or a two or more bath structure (for example, 2 to 4 baths, wherein a counter-current replenishing system is preferable).

The above desilvering processing step may be carried out following a rinsing, washing and stopping after color developing. In the processing of a negative light-sensitive material, it is preferably carried out immediately after color developing, and in a reversal processing it is preferably carried out following a conditioning bath after color developing.

The bleaching solution can contain the compound of the present invention. There can be mentioned as the bleaching agent contained as the main component for the bleaching solution of the present invention, inorganic compounds such as red prussiate, ferric chloride, bichromates, persulfates, and bromates, and semi-organic compounds such as an aminopolycarboxylic acid ferric complex salt and an aminopolyphosphonic acid ferric complex salt.

In the present invention, an aminopolycarboxylic acid ferric complex salt is preferably used from the viewpoint of environmental preservation, safety in handling and corrosion to metal.

Examples of the ferric complex salt of aminopolycarobxylic acid are shown below together with an oxidation/reduction potential, but these complexes are not limited thereto:

| Compound No. | Potential* |
|---|---|
| 1. Ferric complex salt of N-(2-acetamide) iminodiacetic acid | 180 |
| 2. Ferric complex salt of methyliminodiacetic acid | 200 |
| 3. Ferric complex salt of iminodiacetic acid | 210 |
| 4. Ferric complex salt of 2,4-butylenediamine-tetraacetic acid | 230 |
| 5. Ferric complex salt of diethylenethioether-diaminetetraacetic acid | 230 |
| 6. Ferric complex salt of glycol ether diamine-tetraacetic acid | 240 |
| 7. Ferric complex salt of 1,3-propylenediamine-tetraacetic acid | 250 |
| 8. Ferric complex salt of ethylenediamine-tetraacetic acid | 110 |
| 9. Ferric complex salt of diethylenetriamine-pentacetic acid | 80 |
| 10. Ferric complex salt of trans-1,2-cyclohexane-diaminetetraacetic acid | 80 |

*Oxidation/reduction potential (mV vs. NHE, pH = 6)

The oxidation/reduction potential of the above bleaching agents is defined by the oxidation/reduction potential obtained by measuring with the method described in *Transactions of the Faraday Society,* vol. 55 (1959), pp. 1312 to 1313.

In the present invention, from the viewpoint of rapid processing nd effective demonstration of the effects of the present invention, the bleaching agent has preferably an oxidation/reduction potential of 150 mV or more, more preferably 180 mV or more, and most preferably 200 mV or more. The bleaching agent having too high an oxidation/reduction potential causes bleaching fog and therefore, the upper limit thereof is 700 mV or less, preferably 500 mV or less.

Of the above compounds, particularly preferred is Compound No. 7, the ferric complex salt of 1,3-propylenediaminetetraacetic acid.

The ferric complex salt of aminopolycarboxylic acid is used in the form of sodium, potassium and ammonium salts. Of them, the ammonium salt is preferred in terms of the most rapid bleaching speed.

The amount of the bleaching agent used in the bleaching solution is preferably 0.17 to 0.7 mole, more preferably 0.25 to 0.7 mole in terms of a rapid processing and reduction of stain by aging and particularly preferably 0.30 to 0.6 mole, per liter of the bleaching solution. Further, the amount of the bleaching agent used in the bleach-fixing solution is 0.01 to 0.5 mole, more preferably 0.02 to 0.2 mole, per liter of the bleach-fixing solution.

In the present invention, the bleaching agent may be used singly or in a combination of two or more. Where two or more bleaching agents are used, the total amount thereof may fall within the above range.

When the ferric complex salt of aminopoly-carboxylic acid is used in the bleaching solution, it can be added in the form of a complex salt as mentioned above, or aminopolycarboxylic acid which is a complex-forming compound and a ferric salt (for example, ferric sulfate, ferric chloride, ferric nitrate, ferric ammonium salfate and ferric phosphate) may coexist to form the complex salt thereof.

Where the complex salt is formed in the above manner, the aminopolycarboxylic acid may be added in a little more excessive amount than that necessary for forming the complex salt with a ferric ion, wherein it is used preferably in excess of 0.01 to 10%.

In general, the above bleaching solution is used at pH of 2 to 7.0. For rapid processing, the pH of the bleaching solution is preferably 2.5 to 5.0, more preferably 3.0 to 4.8, particularly preferably 3.5 to 4.5. That of the replenishing solution is 2.0 to 4.2.

In the present invention, conventional acids can be used to control pH in the above ranges. The acids used therefor have preferably pKa of 2 to 5.5, wherein pKa is defined by the cologarithm of a dissociation constant of acid and is the value obtained in the conditions of an ionic strength of 0.1 mole/dm and 25° C.

Acids having pKa ranging from 2.0 to 5.5 are preferably incorporated into the bleaching solution in an amount of 0.5 mole/liter or more since bleaching fog and precipitation in the replenishing solution in storing at a lower temperature occur.

The acids having pKa ranging from 2.0 to 5.5 may be inorganic acids such as phosphoric acid and organic acids such as acetic acid, malonic acid and citric acid. The acids showing the above improvement are the organic acids. Among such organic acids, particularly preferred are the organic acids having a carboxyl group.

The organic acids having pKa of 2.0 to 5.5 may be a monobasic acid or a polybasic acid. Where they are polybasic acids, they can be used in the form of metal salts (for example, sodium ad potassium salts) and ammonium salts as long as the pKa values thereof range from 2.0 to 5.5.

The organic acids having a pKa of 2.0 to 5.5 may be used in combination of two or more, provided that aminopolycarboxylic acid, the salt thereof and the Fe complex salt thereof are excluded from the acids as described herein.

The preferred examples of organic acids having a pKa of 2.0 to 5.5 are aliphatic monobasic acids such as acetic acid, monochloroacetic acid, monobromoacetic acid, glycolic acid, propionic acid, monocloropropionic acid, lactic acid, pyruvic acid, acrylic acid, butyric acid, isobutyric acid, pivaric acid, aminobutyric acid, valetic acid, and isovaleric acid; amino acid compounds such as asparagine, alanine, arginine, ethionine, glycine, glutamine, cysteine, serine, methionine, and leucine; aromatic monobasic acids such as benzoic acid, monosubstituted (for example, chloro and hydroxy) benzoic acid, and nicotinic acid; aliphatic dibasic acids such as oxalic acid, malonic acid, succinic acid, tartaric acid, malic acid, maleic acid, fumaric acid, oxaloacetic acid, glutaric acid, and adipic acid; dibasic amino acids such as aspattic acid, glutamic acid, and cystine; aromatic dibasic acids such as phthalic acids and terephthalic acid; and polybasic acids such as citric acid.

Among them, the monobasic acids having a hydroxyl group and a carboxyl group are preferred and particularly preferred are glycolic acid and lactic acid.

Glycolic acid and lactic acid are used in an amount of 0.2 to 2 mole, preferably 0.5 to 1.5 mole per liter of the bleaching solution. These acids are preferred since they can more notably demonstrate the effects of the present invention while they generate no odor and inhibit bleaching fog.

Also, the combined use of acetic acid and glycolic acid or lactic acid is preferred since it can markedly provide the effects of solving either of the problems of precipitation and bleaching fog. The molar ratio of acetic acid to glycolic acid or lactic acid used in combination is preferably 1: 2 to 2: 1.

The total amount of these acids used is suitably 0.5 mole or more, preferably 1.2 to 2.5 mole, and more preferably 1.5 to 2.0 mole, per liter of the bleaching solution.

When the pH of the bleaching solution is controlled in the above-described range, there may be used the above acids and alkali agents (for example, ammonia water, KOH, NaOH, imidazole, monoethanolamine, and diethanolamine). Among them, ammonia water is preferred.

Also, potassium carbonate, ammonia water, imidazole, monoethanolamine or diethanolamine is preferably used as an alkali agent for a bleaching starter used in preparing a starting solution of a bleaching solution from a replenishing solution. The diluted replenishing solution itself may be used without using the bleaching starter.

In the present invention, various bleaching accelerators can be added to the bleaching bath and the prebaths thereof. For example, there can be used the compounds having a mercapto group or a disulfide group, described in U.S. Pat. No. 3,893,858, German Patent 1,290,821, British Patent 1,138,842, JP-A-53-95630, and *Research Disclosure,* vol. 17129 (July 1978); the thiazolidine derivatives described in JP-A-50-140129; the thio-urea derivatives described in U.S. Pat. No. 3,706,561; the iodides described in JP-A-58-16235; the polyethylene oxides described in German Patent 2,748,430; and the polyamine compounds described in JP-B-45-8836. Among the above compounds, particularly preferred are the mercapto compounds described in British Patent 1,138,842 and JP-A-2-190856.

The bleaching solution used in the present invention can contain the rehalogenization agents such as bromides (for example, potassium bromide, sodium bromide and ammonium bromide) and chlorides (for example, potassium chloride, sodium chloride and ammonium chloride). The concentration of the rehalogenization agent is 0.1 to 5.0 mole, preferably 0.5 to 3.0 mole, per liter of the processing solution.

Further, ammonium nitrate is preferably used as an anti-corrosion agent to protect metal.

In the present invention, a replenishing system is preferably applied. The bleaching solution is replenished preferably in amount of 600 ml or less, more preferably 100 to 500 ml, per $m^2$ of the light-sensitive material.

The bleaching time is 120 seconds or shorter, preferably 50 seconds or shorter and more preferably 40 seconds or shorter.

In processing, the bleaching solution containing the ferric complex salt of an aminopolycarboxylic acid is subjected to aeration to oxidize the formed ferric complex salt of aminopolycarboxylic acid, whereby the oxidizing agent is regenerated and the photographic properties are quite stably maintained.

In processing with the bleaching solution in the present invention, particularly the bleaching solution containing a high-potential bleaching agent, a so-called evaporation correction is preferably carried out, in which water corresponding to the evaporated processing solution is supplied.

The concrete methods of replenishing water in such a way are not specifically limited. Preferred among them are the methods described in JP-A-1-254959 and JP-A-1-254960, in which the amount of water evaporated from a monitoring bath settled separately from the bleaching bath is measured and the amount of water evaporated from the bleaching bath are calculated from the above amount of water to replenish the amount of water proportional thereto to the bleaching bath; and the evaporation-correction methods are described in Japanese Patent Application Nos. 2-46743, 2-47777, 2-47778, 2-47779, and 2-117972, in which a solution level sensor and an overflow sensor are used.

In the present invention, a light-sensitive material is processed with a processing solution having a fixing ability after processing with the bleaching solution. To be concrete, the processing solution having the fixing ability as described herein is a fixing solution and a bleach-fixing solution. Where the processing having a bleaching ability is carried out in the bleach-fixing solution, it may be combined with the processing having a fixing ability as shown in the above step 5. In the above steps 2 and 4 in which the processing with the bleach-fixing solution is carried out after the bleaching processing with the bleaching solution, the different bleaching agents may be contained in the bleaching solution and bleach-fixing solution, respectively.

A fixing agent is contained in the processing solution having the fixing ability. The fixing agent may be thiosulfates such as sodium thiosulfate, ammonium thiosulfate, ammonium sodium thiosulfate, and potassium thiosulfate; thiocyanates (rhodanates) such as sodium thiocyanate, ammonium thiocyanate, and potassium thiocyanate; thioureas; and thioethers. Among them, ammonium thiosulfate is preferably used. The fixing agent is used in the amount of 0.3 to 3 mole, preferably 0.5 to 2 mole, per liter of the processing solution having the fixing ability.

Further, from the viewpoint of accelerating of the fixing, preferably used are above ammonium thiocyanate (ammonium rhodanate), thiourea and thioether (for example, 3,6-dithia-1,8-octanediol) in combination with thiosulfates. Of them, most preferably used are thiosulfate and thiocyanate in combination. The combined use of ammonium thiosulfate and ammonium thiocyanate is particularly preferred.

The amount of these compounds used in combination is 0.01 to 1 mole, preferably 0.1 to 0.5 mole per liter of the processing solution having fixing ability. On some occasions, the use of 1 to 3 mole can increase the fixing-acceleration effect toga large extent.

There can be incorporated into the processing solution having the fixing ability, preservatives such as sulfites (for example, sodium sulfite, potassium sulfite and ammonium sulfite), hydroxylamines, hydrazincs, bisulfite adducts of aldehyde compounds (for example, acetaldehyde sodium bisulfite, particularly preferably the compounds described in JP-A-3-158848), and the sulfinic acid compounds described in JP-A-1-231051.

Further, there can be incorporated therein various fluorescent whitening agents, defoaming agents, surfactants, polyvinylpyrrolidone, and organic solvents such as methanol.

The chelating agents such as aminopoly-carboxylic acids and organic phosphonic acids are preferably added to the processing solution having fixing ability. Preferred chelating agents include 1-hydroxyethylidene-1,1-diphosphonic acid, ethylenediamine-N,N,N',N'-tetramethylenephosphonic acid, nitrilotrimethylenephosphonic acid, ethylenediaminetetraacetic acid, diethyelentriaminepentaacetic acid, cyclohexanediaminetetraacetic acid, and 1,2-propylenediaminetetraacetic acid. Among them, particularly preferred are 1-hydroxyethylidene-1,1-diphosphonic acid and ethylenediaminetetraacetic acid.

The addition amount of the chelating agent is 0.01 to 0.3 mole, preferably 0.1 to 0.2 mole, per liter of the processing solution.

The fixing solution has preferably a pH of 5 to 9, more preferably 7 to 8. The bleach-fixing solution has preferably a pH of 4.0 to 7.0, more preferably 5.0 to 6.5. Further, the bleach-fixing solution after processing with a bleaching solution or a first bleach-fixing bath has preferably a pH of 6 to 8.5, more preferably 6.5 to 8.

The processing solution having fixing ability preferably contains a compound having pKa ranging from 6.0 to 9.0 for the purpose of conditioning the pH thereof in the above range and as a buffer agent. The preferred examples of such compounds are imidazoles such as imidazole and 2-methylimidazole. The additional amount of these compound is 0.1 to 10 mole, preferably 0.2 to 3 mole, per liter of the processing solution.

The bleach-fixing solution can contain the foregoing compounds which can be contained in the bleaching solution.

In the present invention, the bleach-fixing solution (a start solution) in starting the processing is prepared by dissolving the foregoing compounds used for the bleach-fixing solution in water. It may be prepared by mixing suitable amounts of a bleaching solution and a fixing solution, each prepared separately.

The replenishing amount of the fixing solution or bleach-fixing solution in applying a replenishing system is preferably 100 to 3000 ml, more preferably 300 to 1800 ml, per $m^2$ of the light-sensitive material.

The bleach-fixing replenishing solution itself may be replenished to the bleach-fixing solution, or the overflow solutions of the bleaching solution and the fixing solution may be used as the replenishing solution, as described in JP-A-61-143755 and Japanese Patent Application No. 2-216389.

Similar to the foregoing bleaching processing, bleach-fixing processing is preferably carried out while replenishing the water in an corresponding to the evaporated amount thereof, in addition to replenishing the processing solution.

In the present invention, the total processing time in the processing having a fixing ability is 0.5 to 4 minutes, preferably 0.5 to 2 minutes and particularly preferably 0.5 to 1 minute.

In the present invention, the total processing time in the desilvering processing comprising the combination of the bleaching, bleach-fixing and fixing steps is preferably 45 seconds to 4 minute, more preferably 1 to 2 minutes. The processing temperature is 25° to 50° C., preferably 35° to 45° C.

In the present invention, silver can be recovered from the used processing solution having fixing ability by conventional methods, and the regenerated solution after silver recovery can be reused. The effective silver recovering methods are an electrolysis method (described in French Paten 2,299,667), a setting method (described in JP-A-52-73037 and German Patent 2,331,220 ), an ion exchange resin method (described in JP-A-51-17114 and German Patent 2,548,237), and a metal substitution method (described in British Patent 1,353,805). These silver recovering methods are preferably carried out for the tank solutions in an inline system since the rapid processability can be further improved.

Usually, a washing processing step is performed after the processing step having the fixing ability.

There can be used a simple processing method in which a stabilizing processing is carried out with the stabilizing solution of the present invention without carrying out substantial washing after processing with the processing solution having fixing ability.

Washing water used in a washing step can contain various surfactants in order to prevent speckles by waterdrop on the light-sensitive material in drying after processing. The surfactant may be polyethylene glycol type nonionic surfactants, polyhydric alcohol type nonionic surfactants, alkylbenzenesulfonate type anionic surfactants, higher alcohol sulphuric ester salt type anionic surfactants, alkylnaphthalenesulfonate type anionic surfactants, quaternary ammonium salt type cationic surfactants, amine salt type cationic surfactants, amino salt type amphoteric surfactants, and betaine type amphoteric surfactants. Among them, the nonionic surfactants are preferably used. Particularly preferred are the alkylphenol-ethylene oxide adducts. Particularly preferred alkylphenols are octyl-, nonyl-, dodecyl- and dinonylphenols. The adduct molar number of ethylene oxide is particularly preferably 8 to 14. Further, silicone type surfactants having a higher defoaming effect are preferably used.

Various bactericides and fungicides may be added to the washing water in order to prevent the generation of fur and growth of mole on a light-sensitive material after processing. Examples of such bactericides and fungicides include thiazolylbenzimidazole type compounds described in JP-A-57-157244 and JP-A-58-105145; isothiazolone type compounds described in JP-A-57-8542; chlorophenol type compounds represented by trichlorophenol; bromophenol type compounds; organic tin and organic zinc compounds; acid amide compounds; diazine and triazine compounds; thiourea compounds; benzotriazole compounds; aklylguanidine compounds; quaternary ammonium compounds represented by benzoalkonium chloride; antibiotics represented by penicillin; and conventional fungicides described in *J. Antibact. Antifung. Agents,* Vol. 1, No. 5, pp. 207 to 223 (1983). They may be used in combination of two or more. Also, the various fungicides described in JP-A-48-83820 can be used.

Further, various chelating agents are preferably contained in the washing water. The preferred chelating agents include aminopolycarboxylic acids such as ethyl enediaminetetraacetic acid and diethylenetriaminepentaacetic acid, organic phosphonic acids such as 1-hydroxyethylidene-1,1-diphosphonic acid, ethylenediaminetetraacetic acid and diethylenetriamine-N,N,N′,N′-tetramethylenephosphonic acid, and the hydrolysis products of maleic anhydride polymer described in EP 345172 A1.

The preservatives which can be contained in the above fixing solution and bleach-fixing solution are preferably contained in the washing water.

The washing step and stabilizing step are preferably in a multi-stage counter current system. The number of stages is preferably 2 to 4. The replenishing amount thereof is 1 to 50 times the amount carried over from the preceding bath, preferably 2 to 30 times, and more preferably 2 to 15 times, per unit area.

Tap water can be used for the washing step. Preferably used are water which has been subjected to a deionization treatment in which Ca and Mg ions are reduced to the concentration of 5 mg/liter or less with ion exchange resins, and water which has been sterilized with halogen or a ultraviolet sterilizing light.

Tap water may be used for correcting water evaporated from the respective processing solutions. Preferably used is deionized or sterilized water preferably used in the above washing step.

Further, an overflowing solution from the washing step or the stabilizing step is preferably flowed in the bath having a fixing ability which is the preceding bath since a waste amount can be reduced.

In processing, a suitable amount of water, a correction solution or a replenishing solution is preferably added not only to the bleaching solution, bleach-fixing solution and fixing solution but also to the other processing solutions (for example, the color developing solution,. washing water and stabilizing solution) in order to correct for the enrichment attributable to evaporation.

The effect of the present invention can be effectively demonstrated especially when the total processing time until the start of the drying step following the bleaching step is 1 to 3 minutes, preferably 1 minute and 20 seconds to 2 minutes.

In the present invention, the drying temperature is preferably 50 to 65° C., more preferably 50 to 60° C. The drying time is preferably 30 seconds to 2 minutes, more preferably 40 to 80 seconds.

The light-sensitive material used in the present invention may be provided on a support with at least one of the silver halide emulsion layers comprising a blue-sensitive layer, a green-sensitive layer and a red-sensitive layer, and there are specifically no limits to the number and order of the silver halide emulsion layers and light-insensitive layers.

One typical example is a silver halide color photographic light-sensitive material having on a support a light-sensitive layer comprising a plurality of the silver halide emulsion layers having substantially the same spectral sensitivities but different sensitivities, wherein the light-sensitive layer comprises a unit light-sensitive layer having spectral sensitivity to any of blue light, green light and red light. In a multi-layer silver halide color photographic light-sensitive material, the unit light-sensitive layers of a red-sensitivity, a green-sensitivity and a blue sensitivity are usually provided in order from the support side. According to purposes, however, the above order may be changed or a layer having a different spectral sensitivity can be interposed between the layers having the same spectral sensitivity.

Various light-insensitive layers such as an intermediate layer may be provided between the above silver halide light-sensitive layers and on the uppermost or lowermost layer.

The intermediate layer may contain the couplers described in JP-A-61-43748, JP-A-59-113438, JP-A-59-113440, JP-A-61-20037, and JP-A-61-20038 and further may contain an anticolor mixing agent, a ultraviolet absorber and an anti-stain agent, as usually used.

The plurality silver halide emulsion layers constituting the respective until light-sensitive layers can preferably have two layer structures consisting of a high-sensitive layer and low-sensitive layer, as described in German Patent 1,121,470 or British Patent 923,045. Usually, a lower-sensitive layer is provided more closely to the support. Also, a light-insensitive layer may be provided between the respective silver halide emulsion layers.

A lower-sensitive layer may be provided farther from the support and a high-sensitive layer more closely, as described in JP-A-57-112751, JP-A-62-200350, JP-A-62-206541, and JP-A-62-206543.

A concrete example is to provide the layers from the side farthest from the support in the order of a low blue-sensitive layer (BL)/a high blue-sensitive layer (BH)/a high green-sensitive layer (GH)/a low green-sensitive layer(GL)/a high red-sensitive layer (RH)/a low red-sensitive layer (RL), the order of BH/BL/GL/GH/RH/RL, or the order of BH/BL/GH/GL/RL/RH.

Further, the layers can be provided from the side farthest from the support in the order of a blue-sensitive layer/GH/RH/GL/RL, as described in JP-B-55-34932. The layers can also be provided from the side farthest from the support in the order of a blue-sensitive layer/GL/RL/GH/RH, as described in JP-A-56-25738 and JP-A-62-63936. There can be given the structure of three layers having the different sensitivities, respectively, comprising a high sensitive silver halide emulsion layer provided on the uppermost side, a middle sensitive silver halide emulsion layer provided on an intermediate side, and a low sensitive silver halide emulsion layer provided on a lower side, as described in JP-B-49-15495, wherein the sensitivity becomes lower toward the support, as described in JP-B-49-15495. Also in the case of the above structure of three layers having the different sensitivities, the layers having the same spectral sensitivity may be provided from the side farthest from the support in the order of an intermediate-sensitive emulsion layer/a high-sensitive emulsion layer/a low-sensitive emulsion layer, as described in JP-A-59-202464. Various layer structures and layer arrangements can be selected according to the purposes of the light-sensitive material as described above.

The dry thickness of the whole constituent layers excluding a support, subbing layer and a back layer, is preferably 12.0 to 20.0 μm, more preferably 12.0 to 18.0 μm from the viewpoint of bleaching fog and aging stain.

The film thickness of a light-sensitive material is measured in the following manner; at the light-sensitive material to be measured is stored for 7 days under conditions of 25° C. and 50% RH after the preparation thereof; the whole thickness of the light-sensitive material is measured and then, after removing the layers coated on the support, the thickness of the light-sensitive material is measured once again; and the film thickness of the whole coated layers excluding the support of the above light-sensitive material is defined by the difference thereof. This thickness can be measured with a film thickness measuring device K-402B Stand. manufactured by Anritsu Electric Co., Ltd., using a contact type piezoelectric conversion element. The coated layers on the support can be removed with an aqueous sodium hypochlorite solution. The section of the light-sensitive material can be photographed with a scanning type electron microscope (magnification: preferably 3000 or more) to measure the whole layer thickness coated on the support.

In the present invention, the swelling rate is preferably 50 to 200%, more preferably 70 to 150%, wherein the swelling rate is defined by the following equation:

$$\text{Swelling rate} = (A - B)/B \times 100\ (\%)$$

A: equilibrium swollen film thickness in water at 25° C.

B: total dry film thickness at 25° C. and 55% RH.

The swelling rate derivating from the above limits increases the residual amount of the color developing agent and badly affects the photographic properties, the image quality such as the desilvering property and the film properties such as film strength.

Further, the swelling speed of the light-sensitive material represented by $T\frac{1}{2}$ is preferably 15 seconds or less, more preferably 9 seconds or less, wherein $T\frac{1}{2}$ is defined as the time spent until the swelling reaches one half of a saturated swollen film thickness which is defined as 90% of the maximum swollen film thickness attained when the light-sensitive material is processed in a color developing solution at 38° C. for 3 minutes and 15 seconds.

Silver halides contained in the photographic emulsion layer of the light-sensitive material used in the present invention may be any of silver iodobromide, silver iodochlorobromide, silver chlorobromide, silver bromide and silver chloride.

Preferred silver halide is silver iodobromide, silver iodochloride or silver iodochlorobromide containing silver iodide in the amount of 0.1 to 30 mole %. Particularly preferred is silver iodobromide containing silver iodide in the amount of 2 to 25 mole %.

The silver halide grains contained in a photographic emulsion may be of a regular crystal such as cube, octahedron or tetradecahedron, an irregular crystal such as sphere or plate, a defective crystal such as twinned crystal, or a composite thereof.

Silver halide may comprise fine grains having a size of about 0.2 μm or less, or large grains having a projected area diameter up to 10 μm and a silver halide emulsion may be polydispersed or monodispersed.

The silver halide photographic emulsion used in the present invention can be prepared by the methods described in, for example, *Research Disclosure* (*RD*) No. 17643 (December 1978), pp. 22 to 23, "I. Emulsion Preparation and Types" and No. 18716 (November 1979), p. 648, *Chimie et Physique Photographique,* by P. Glafkides, published by Paul Montel Co. (1967), *Photographic Emulsion Chemistry,* by G. F. Dufin, published by Focal Press Co. (1966), and *Making and Coating Photographic Emulsion,* by V. L. Zelikman el al, published by Focal Press Co. (1964).

Also preferred are the monodispersed emulsions described in U.S. Pat. Nos. 3,574,628 and 3,655,394, and British Patent 1,413,748. The tabular grains having an aspect ratio of 5 or more can also be used in the present invention. The tabular grains can be prepared by the methods described in *Photographic Science and Engineering,* by Gutoff, vol. 14, pp. 248 to 257 (1970), U.S. Pat. Nos. 4,434,226, 4,414,310, 4,430,048, and 4,439,520, and British Patent 2,112,157.

The crystal structure may be uniform or of a different halogen composition on the inside and a surface or of a stratum structure. Further, silver halides of different compositions may be conjugated with an epitaxial conjugation. Furthermore, silver halides may be conjugated with the compounds other than silver halides, such as silver rhodanide and lead oxide.

Further, a mixture of the grains having the different crystal forms may be used.

Usually, the silver halide emulsions are subjected to physical ripening, chemical ripening and spectral sensitization before use. The additives used in such steps are described in *Research Disclosure,* No. 17643 (December 1978), No. 18716 (November 1979 ) and No. 307105 (November 1989 ), and the corresponding passages are listed in the following table.

The publicly known photographic additives also are described in the above three Research Disclosures (RD) and the corresponding passages described therein are listed as well in the following table:

| Kind of Additives | RD 17643 | RD 18716 | RD 307105 |
|---|---|---|---|
| 1. Chemical sensitizer | p. 23 | p. 648, right col. | p. 866 |
| 2. Sensitivity improver | — | p. 648 right col. | — |
| 3. Spectral sensitizer & Super sensitizer | pp. 23 to 24 | p. 648 right col. to p. 649 right col. | pp. 866 to 868 |
| 4. Whitening agent | p. 24 | p. 647 right col. | p. 868 |
| 5. Anti-foggant & stabilizer | pp. 24 to 25 | p. 649 right col. | pp. 868 to 870 |
| 6. Light absorber, filter, dye, & UV absorber | pp. 25 to 26 | p. 649 right col. to p. 650 left col. | p. 873 |
| 7. Anti-stain agent | p. 25 right col. | p. 650 left to right cols. | p. 872 |
| 8. Dye image stabilizer | p. 25 | p. 650 left col. | p. 872 |
| 9. Hardener | p. 26 | p. 651 left col. | pp. 874 to 875 |
| 10. Binder | p. 26 | p. 651 left col. | pp. 873 to 874 |
| 11. Plasticizer & lubricant | p. 27 | p. 650 right col. | p. 876 |
| 12. Coating aid & surfactant | pp. 26 to 27 | p. 650 right col. | pp. 875 to 876 |
| 13. Anti-static agent | p. 27 | p. 650 right col. | pp. 876 to 877 |
| 14. Matting agent | — | — | pp. 878 to 879 |

In the present invention, various color couplers can be used in combination. Representative examples thereof are described in the patents described in above RD No. 17643, VII-C to G and RD No. 307105, VI I-C to G.

Preferred are the yellow couplers described in, for example, U.S. Pat. Nos. 3,933,501, 4,022,620, 4,326,024, 4,401,752 and 4,248,961, JP-B-58-10739, British Patent 1,425,020 and 1,476,760, U.S. Pat. Nos. 3,973,968, 4,314,023, and 4,511,649, European Patent 249,473A, and Japanese Patent Application Nos. 2-64718, 2-314522, 2-232857, 2-236341 and 2-296401.

Diequivalent and/or tetraequivalent 5-pyrazolone type and pyrazoloazole type compounds are preferred as a magenta coupler. Further preferred are the compounds described in U.S. Pat. Nos. 4,310,619 and 4,351,897, European Patent 73,636, U.S. Pat. Nos. 3,061,432 and 3,725,064, RD No. 24220 (June 1984), JP-A-60-33552, RD No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO (PCT) 88/04795.

In the present invention, the use of at least one kind of the tetraequivalent magenta coupler can provide marked effects.

Of the tetraequivalent magenta couplers, preferred are the tetraequivalent 5-pyrazolone type magenta couplers represented by the following formula (M) or the tetraequivalent pyrazoloazole type magenta couplers represented by the following formula (m):

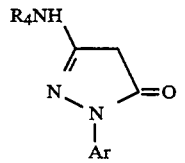

(M)

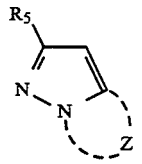

(m)

in formula (M), $R_4$ represents an alkyl group, an aryl group, an acyl group, or a carbamoyl group; Ar represents a substituted or unsubstituted phenyl group, provided that either of $R_4$ and Ar may be a polyvalent group having a divalency or a higher valency to form a polymer, such as a dimer, and that it may link a main coupling structure of the coupler with a principal chain of a polymer to form a polymer coupler as disclosed in U.S. Pat. No. 4,367,282; in formula (m), $R_5$ represents a hydrogen atom or a substituent; and Z represents a group of non-metallic atoms necessary to form a 5-membered azole ring containing 2 to 4 nitrogen atoms, and the azole ring may have a substituent or a condensed ring, provided that either of $R_5$ and Z may be a polyvalent group having a divalency or a higher valency to form a polymer, such as a diamer, and that it may link a main coupling structure of the coupler with a principal chain of a polymer to form a polymer coupler.

In $R_4$ of formula (M), the alkyl group represents a linear or branched alkyl group having 1 to 42 carbon atoms, an aralkyl group, an alkenyl group, an alkynyl group, a cycloalkyl group, or a cycloalkenyl group; the aryl group represents an aryl group having 6 to 46 carbon atoms; the acyl group represents an aliphatic acyl group having 2 to 32 carbon atoms or an aromatic acyl group having 7 to 46 carbon atoms; and the carbamoyl group represents an aliphatic carbamoyl group having 2 to 32 carbon atoms or an aromatic carbamoyl group having 7 to 46 carbon atoms. These groups may have substituents, which are organic substituents having a carbon atom, oxygen atom, nitrogen atom or sulfur atom at a bonding site, or halogen atoms.

In more detail, $R_4$ represents an alkyl group (for example, methyl, ethyl, butyl, propyl, octadecyl, isopropyl, t-butyl, cyclopentyl, cyclohexyl, methoxyethyl, ethoxyethyl, t-butoxyethyl, phenoxyethyl, methanesulfonylethyl, and 2-(2,4-di-tert-amyphenoxy)ethyl); an aryl group (for example, phenyl, 2-chlorophenyl, 2-methoxyphenyl, 2-chloro-5-tetradecaneamidephenyl, 2-chloro-5- (3-octadecenyl-1-succinimide)phenyl, 2-choloro-5-octadecylsulfonamidephenyl, and 5-chloro-5-[2-(4-hydroxy-3-tert-butylphenoxy) tetradecanamidephenyl]); an acyl group (for example, acetyl, pivaloyl, tetradecanoyl, 2-(2,4-di-tert-pentylphenoxy) acetyl, 2-(2,4-di-tert-pentylphenoxy) butanoyl, benzoyl, and 3-(2,4-di-tert-amylphenoxyacetamide) benzoyl; a carbamoyl group (for example, N-methylcarbamoyl, N ,N-dimethylcarbamoyl, N-hexadecylcarbamoyl, N-methyl-N-phenylcabamoyl, and N-[3-(1-(2,4-di-tert-phentylphenoxy) butylamide)]phenylcarbamoyl.

Examples of the substituents of these groups include an alkyl group, an aryl group, a heterocyclic group, a cyano group, a hydroxy group, a nitro group, a carboxy group, an amino group, an acyl group, an aryloxycarbonyl group, an alkoxycarboxy group, a carbamoyl group, an alkoxy group, an aryloxy group, a heterocyclicoxy group, an acyloxy group, a carbamoyloxy group, a silyloxy group, an aryloxycarbonylamino group, an acylamino group, an alkylamino group, an anilino group, a ureido group, a sufamoylamino group, an a lkoxycarbonylamino group, a sulfonamide group, an aryloxycarbonylamino group, an imide group, an alkylthio group, an arylthio group, a heterocyclicthio group, a sulfamoyl group, a sulfonyl group, a sulfinyl group, an azo group, a phosphonyl group, an azolyl group, a fluorine atom, a chlorine atom, and a bromine atom. $R_4$ is preferably an aryl group and an acyl group.

Ar in formula (M) represents a substituted or unsubstituted phenyl group. Preferred substituents include a halogen atom, an alkyl group, a cyano group, an alkoxy group, an alkoxycarbonyl group, and an acylamino group.

Ar is, for example, phenyl, 2,4,6-trichloropheyl, 2,5-dichlorophenyl, 2,4-dimethyl-6-methoxyphenyl, 2,6-dichloro-4-methoxyphenyl, 2,6-dichloro-4-ethoxycarbonylphenyl, 2,6-dichloro-4-cyanophenyl group, or 4-[2- (2,4-di-tert-amylphenoxy) butylamide]phenyl. Ar is preferably a substituted phenyl group, more preferably a phenyl group which is substituted with at least one halogen atom (particularly a chlorine atom) and particularly preferably 2,4,6-trichlorophenyl or 2,5-dichlorophenyl.

Of the pyrazoloazole type magenta couplers represented by formula (m), preferred are the compounds having the skeletal structure of 1H-imidazo [1,2-b ]pyrazole, 1H-pyrazolo [1,5-b ][1,2,4 ]triazole, 1H-pyrazolo [5,1-c ][1,2,4 ]triazole, or 1H-pyrazolo [1,5-d ]tetrazole. They are represented by the following formulas (m-1), (m-2), (m-3) and (m-4), respectively:

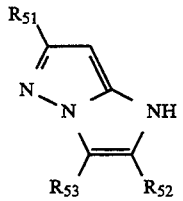
(m-1)

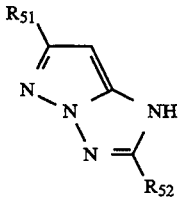
(m-2)

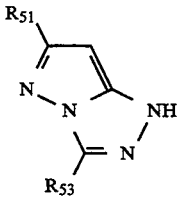
(m-3)

-continued

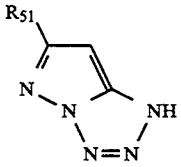
(m-4)

$R_5$, $R_{51}$, $R_{52}$, in formula (m) and these formulas are explained below.

$R_5$ and $R_{51}$ represent independently a hydrogen atom and a substituent. The substituent may be a halogen atom, an alkyl group, an aryl group, a heterocyclic group, a cyano group, a hydroxy group, a sulfo group, a nitro group, a carboxy group, an amino group, an alkoxy group, an aryloxy group, an acylamino group, an alkylamino group, an anilino group, a ureido group, a sulfamoylamino group, an alylthio group, an arylthio group, an alkoxycarbonylamino group, a sulfonamide group, a carbamoyl group, a sulfamoyl group, a sulfonyl group, an alkoxycarbonyl group, a heterocyclicoxy group, an azo group, an acryloxy group, a carbamoyloxy group, a silyloxy group, an aryloxycarbonylamino group, an imide group, a heterocyclicthio group, a sulfinyl group, a phosphonyl group, an aryloxycarbonyl group, an acyl group, and an azolyl group. $R_5$ and $R_{51}$ may be divalent to form a bis product.

In further detail, $R_5$ and $R_{51}$ represent independently a hydrogen atom, a halogen atom (for example, a chlorine atom and a bromine atom), an alkyl group (for example, a linear or branched alkyl group having 1 to 32 carbon atoms, an aralkyl group, an alkenyl group, an alkynyl group, a cycloalkyl group, and a cyaloalkenyl group, and more specifically, methyl, ethyl, propyl, isopropyl, t-butyl, tridecyl, 2-methanesulfonylethyl, 3-(3-pentadecylphenoxy) propyl, 3-{4-{2-[4-(4-hydroxyphenylsulfonyl) phenoxy]dodecanamide}phenyl}propyl, 2-ethoxytridecyl, trifluoromethyl, cyclopentyl, and 3-(2,4-di-tert-amylphenoxy) propyl), an aryl group (for example, phenyl, 4-t-butylphenyl, 2,4-di-t-amylphenyl, and 4-tetradecanamidephenyl), a heterocyclic group (for example, 2-furyl, 2-thienyl, 2-pyrimidinyl, and 2-benzothiazolyl), a cyano group, a hydroxy group, a sulfo group, a nitro group, a carboxy group, an amino group, an alkoxy group (for example, methoxy, ethoxy, 2-methoxyethoxy, 2-dodecyloxyethoxy, and 2-methanesulfonylethoxy), an aryloxy group (for example, phenoxy, 2-methylphenoxy, 4-t-butylphenoxy, 3-nitrophenoxy, 3-t-butyloxycarbamoylphenoxy, and 3-methoxycarbamoylphenoxy), an acylamino group (for example, acetamide, benzamide, tetradecanamide, 2-(2,4-di-t-amylphenoxy) butanamide, 4- (3-t-butyl-4-hydroxyphenoxy) butanamide, and 2-[4-(4-hydroxyphenylsufonyl) phenoxy]decanamide), an alkylamino group (for example, methylamino, butylamino, dodecylamino, diethylamino, and methylbutylamino), an anilino group (for example, phenylamino, 2-chloroanilino, 2-chloro-5-tetradecanaminoanilino, 2-chloro-5-dodecyloxycarbonylanilino, N-acetylanilino, and 2-chloro-5- [a- (3-t-butyl-4-hydroxyphenoxy) dodecaneamide]anilino), a ureido group (for example, phenylureido, methylureido and N ,N-dibutylureido), a sulfamoylamino group (for example, N,N-dipropylsulfamoylamino, and N-methyl-N-decylsulfamoylamino), an alkylthio group (for example, methylthio, octylthio, tetradecylthio, 2-phenoxyethylthio, 3-phenoxypropylthio, and 3- (4-t-butylphenoxy) propylthio) an arylthio group (for example, phenylthio, 2-butoxy-5-t-octylphenylthio, 3-pentadecylphenylthio, 2-carboxyphenylthio, and 4-tetradecanamidephenylthio), an alkoxycarbonylamino group (for example, methoxycarbonylamino and tetradecyloxycarbonylamino), a sulfonamide group (for example, methanesulfonamide, haxadecanesulfonamide, benzenesulfonamide, p-toluenesulfonamide, octadecanesulfonamide, and 2-methoxy-5-t-butylbenzenesulfonamide), a carbamoyl group (for example, N-ethylcarbamoyl, N,N-dibutylcarbamoyl, N-(2-dodecyoxyethyl carbamoyl, N-methyl-N-dodecylcarbamoyl, and N-[3-(2,4-di-t-amylphenoxy) propyl]carbamoyl), a sulfamoyl group (for example, N-ethylsulfamoyl, N,N-dipropylsulfamoyl, N-(2-dodecyloxyethyl) sulfamoyl, N-ethyl-N-dodecylsulfamoyl, and N,N-diethylsulfamoyl), a sulfonyl group (for example, methanesulfonyl, octanesulfonyl, benzenesulfonyl, and toluenesulfonyl), an alkoxycarbonyl group (for example, methoxycarbonyl, butyloxycarbonyl, dodecyloxycarbonyl, and octadecyloxycarbonyl), a heterocyclicoxy group (for example, 1-phenyltetrazole-5-oxy, and 2-tetrahydropyranyloxy), an azo group (for example, phenylazo, 4-methoxyphenylazo, 4-pivaloylaminophenylazo, and 2-hydroxy-4-propanoylphenylazo), an acyloxy group (for example, acetoxy), a carbamoyloxy (for example, N-methylcarbamoyloxy and N-phenylcarbamoyloxy), a silyloxy group (for example, trimethylsilyloxy and dibutylmethylsilyloxy), an aryloxycarbonylamino group (for example, phenoxycarbonylamino), an imide group (for example, N-succinimide, N-phthalimide, and 3-octadecenylsuccinimide), a heterocyclicthio group (for example, 2-benzothiazolylthio, 2,4-di-phenoxy-1,3,5-triazole-6-thio, and 2-pyridylthio), a sulfinyl group (for example, dodecanesulfinyl, 3-pentadecylphenylsulfinyl, and 3-phenoxypropylsulfinyl), a phosphonyl group (for example, phenoxyphosphonyl, octyloxyphosphonyl, and phenylphosphonyl), an aryloxycarbonyl group (for example, phenoxycarbonyl), an acyl group (for example, acetyl, 3-phenylpropanoyl, benzoyl, and dodecyloxybenzoyl), and an azolyl group (for example, imidazolyt, pyrazolyl, 3-chloro-pyrazole-1-yl, and triazoyl).

Of these groups, the groups capable of having further substituents may have the organic substituents linked with a carbon atom, an oxygen atom, a nitrogen atom or a sulfur atom, or a halogen atom.

Of these groups, the preferred groups represented by $R_5$ and $R_{51}$ are an alkyl group, an aryl group, an alkoxy group, an aryloxy group, an alkyl thio group, a ureido group, a carbomoyloxy group, and an acylamino group.

$R_{52}$ represents the same groups as those defined for $R_{51}$, and preferred are a hydrogen atom, an alkyl group, an aryl group, a heterocyclic group, an alkoxycarbonyl group, a carbamoyl group, a sulfamoyl group, a sulfinyl group, an acyl group, and a cyano group.

$R_{53}$ represents the same groups as those defined for $R_{51}$, and preferred are a hydrogen atom, an alkyl group, an aryl group, a heterocyclic group, an alkoxy group, an aryloxy group, an alkylthio group, and arylthio group, an alkoxycarbonyl group, a carbamoyl group, and an acyl group. More preferred are an alkyl group, an aryl group, a heterocyclic group, an alkylthio group, and an arylthio group.

Z represents a group of non-metallic atoms necessary to form a 5-membered azole ring containing 2 to 4 nitrogen atoms, and the azole ring may have a substituent or a condensed ring. The substituent can include those defined for $R_5$ described above.

The magenta couplers represented by formulas (m-1), (m-2), (m-3) and (m-4) can be synthesized by the methods disclosed in U.S. Pat. Nos. 4,540,654, 4,705,863, 3,725,067, 2,710,871, 3,684,514, 3,928,044 and 3,928,044.

The use of the tetraequivalent 5-pyrazolone type magenta coupler of formula (M) can particularly demonstrate the effects of the present invention.

Examples of the tetraequivalent magenta coupler are shown below:

(M-1)

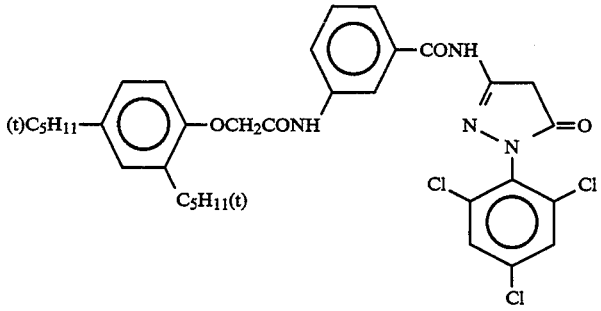

(M-2)

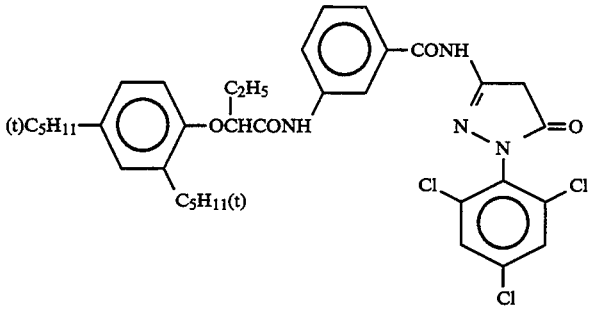

-continued
(M-3)
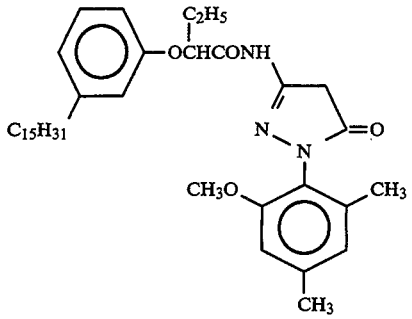
(M-4)
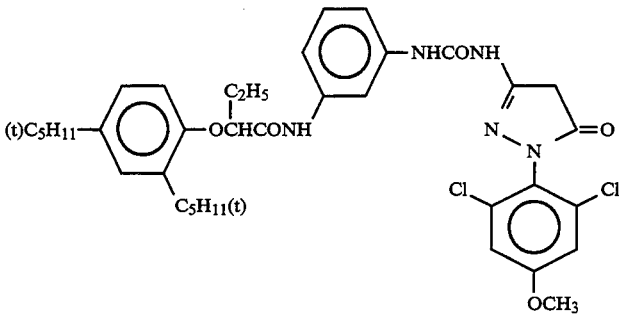
(M-5)
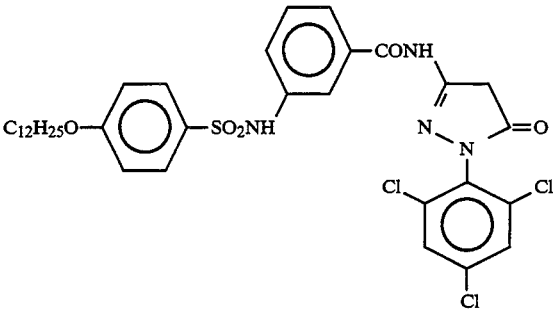
(M-6)
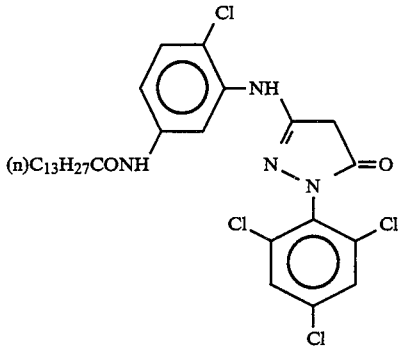
(M-7)
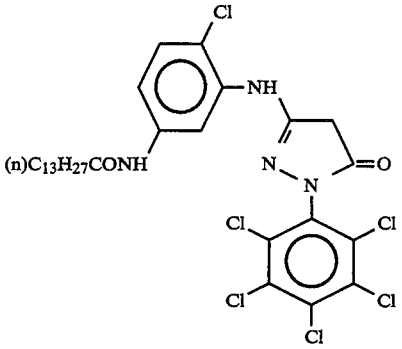

-continued
(M-8)
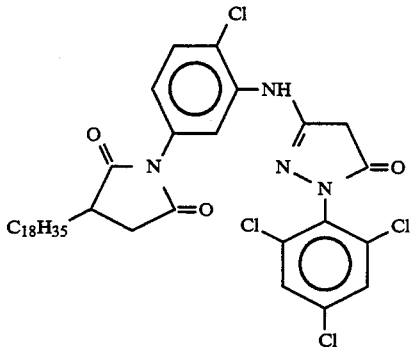
(M-9)
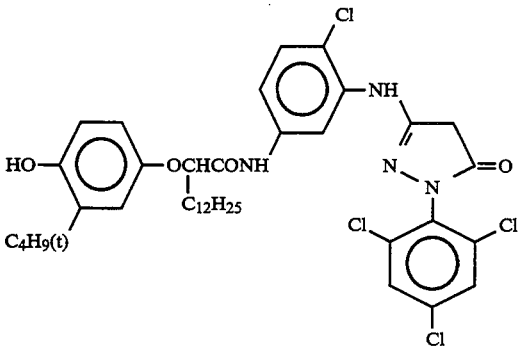
(M-10)
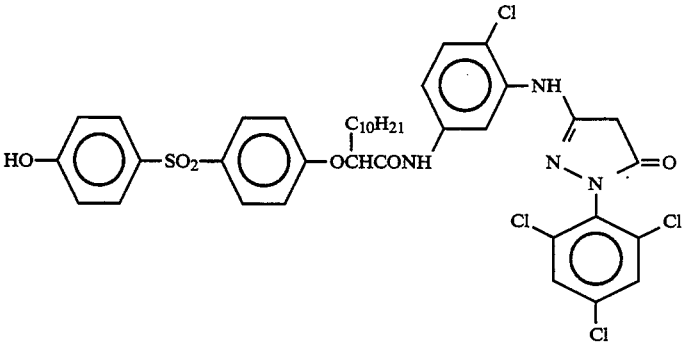
(M-11)
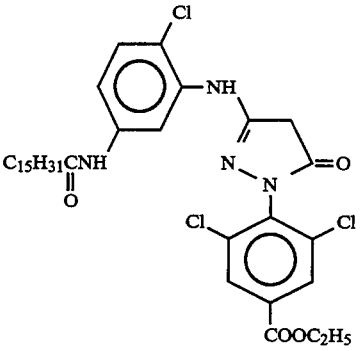

-continued
(M-12)
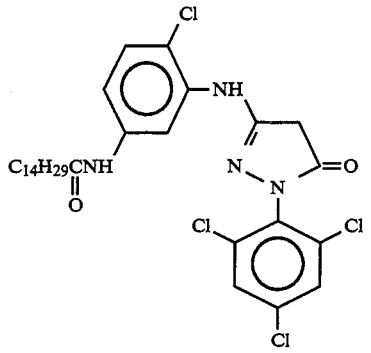
(M-13)
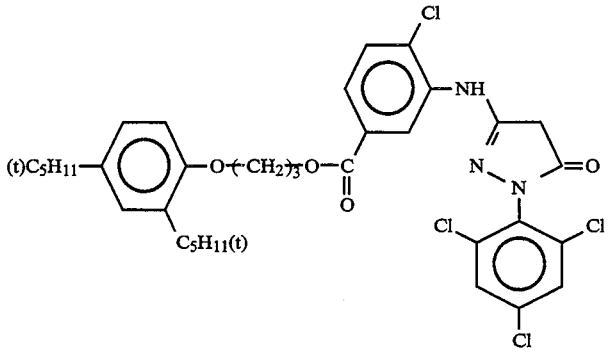
(M-14)
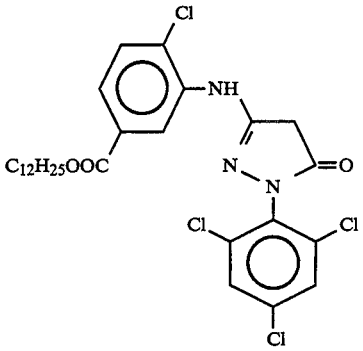
(M-15)
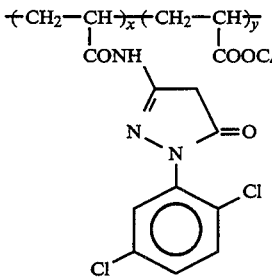
x/y = 50/50 (by weight)
average molecular weight:
about 25,000
(M-16)
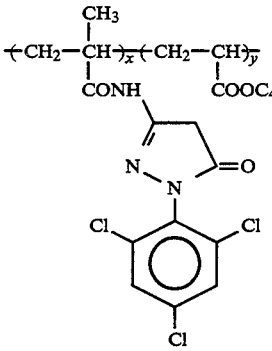
x/y = 45/55 (by weight)
average molecular weight:
about 30,000

-continued
(M-17)
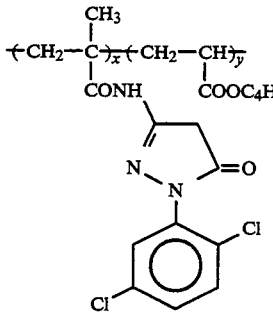
x/y = 50/50 (by weight)
average molecular weight:
about 30,000
(M-18)
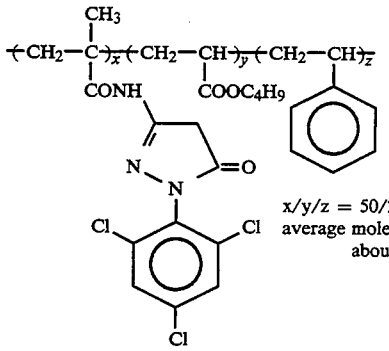
x/y/z = 50/25/25 (by weight)
average molecular weight:
about 20,000
(M-19)
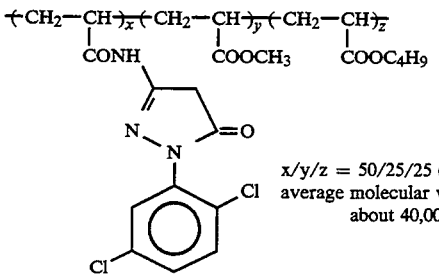
x/y/z = 50/25/25 (by weight)
average molecular weight:
about 40,000
(M-20)
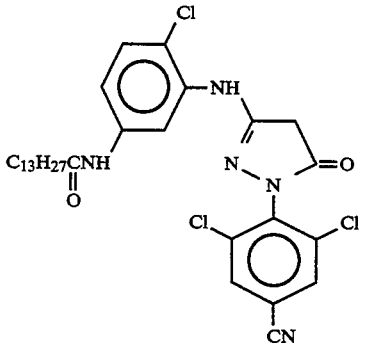
(M-21)
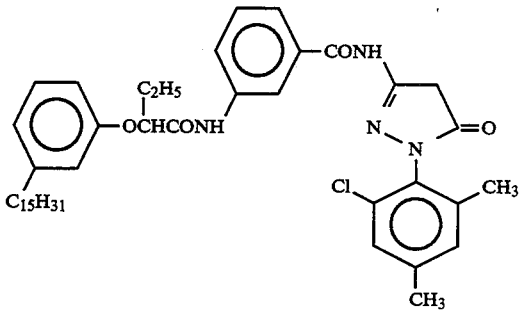

-continued
(M-22)
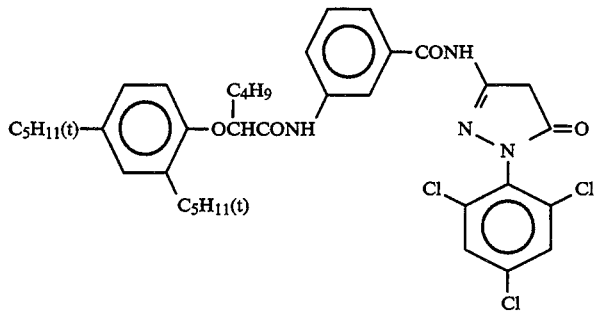
(M-23)
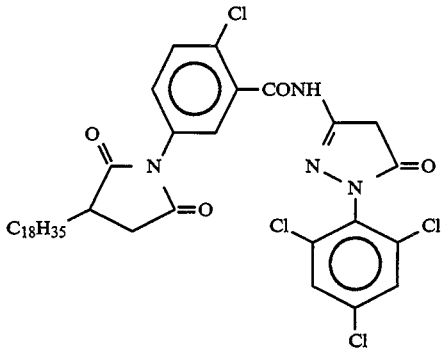
(M-24)
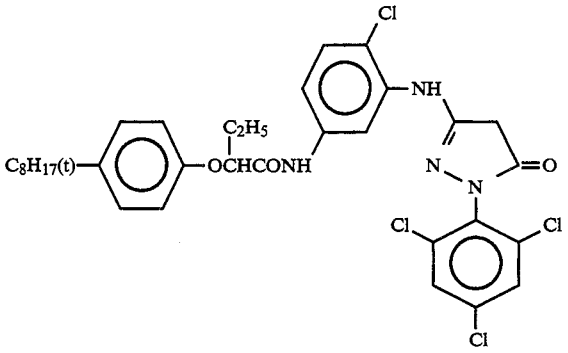
(M-25)
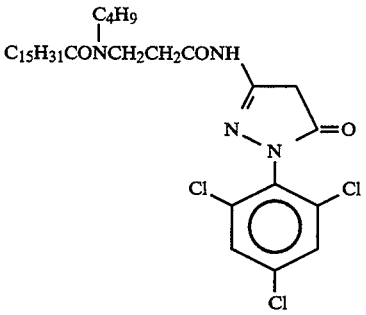
(M-26)
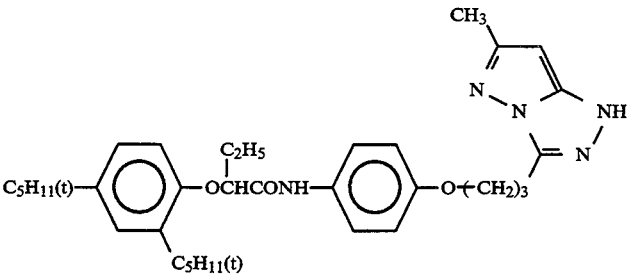

-continued
(M-27)
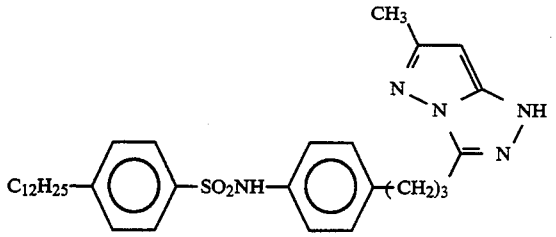
(M-28)
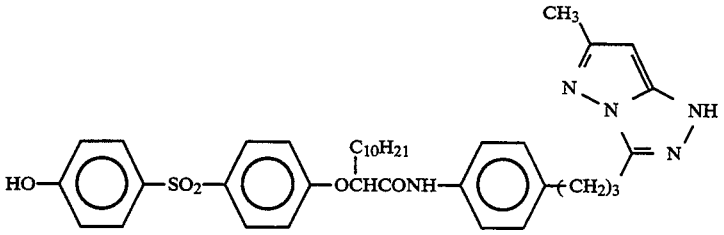
(M-29)
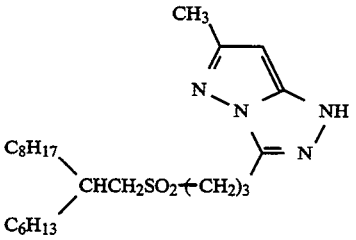
(M-30)
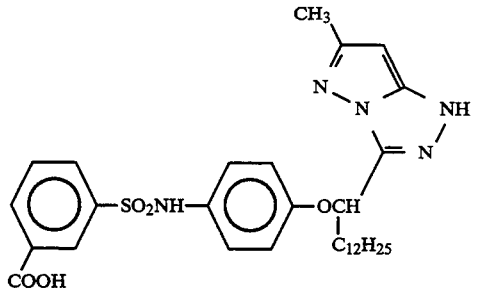
(M-31)
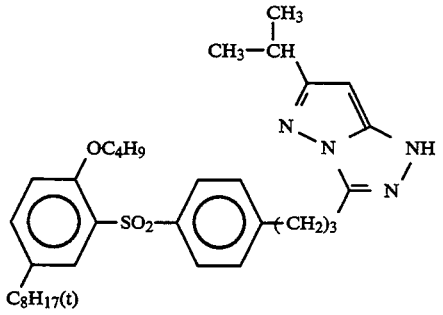
(M-32)
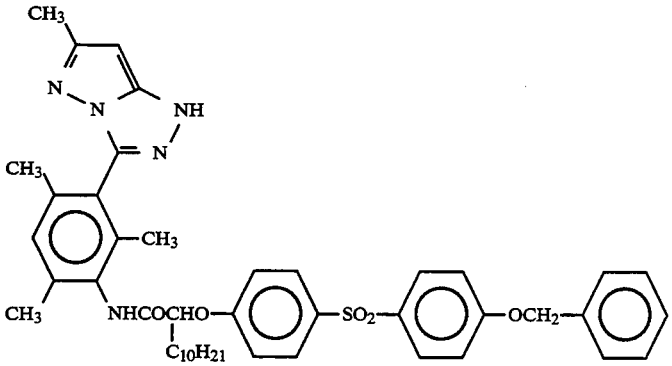

-continued
(M-33)
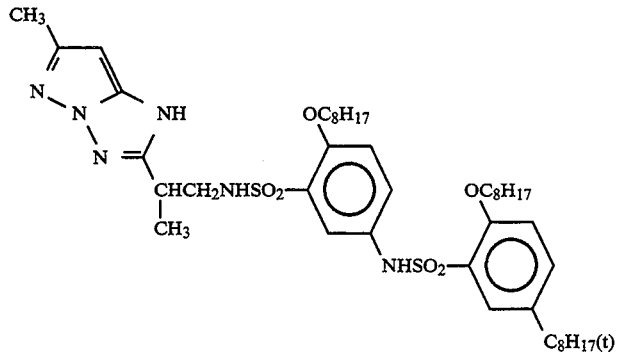
(M-34)
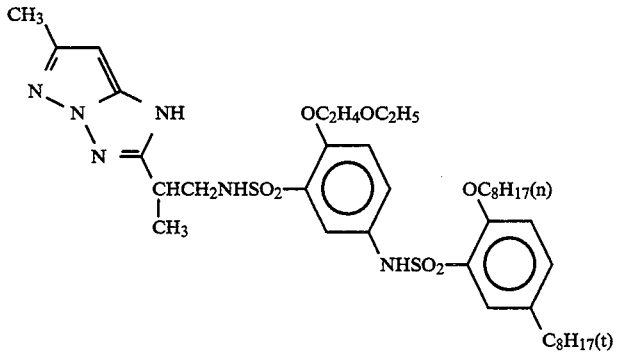
(M-35)
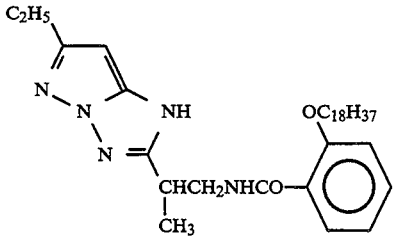
(M-36)
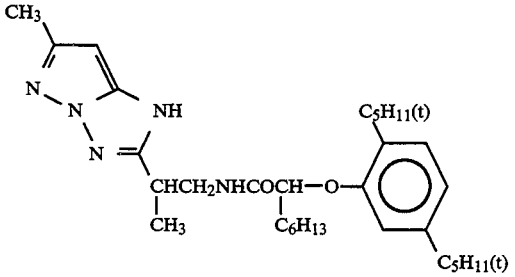
(M-37)
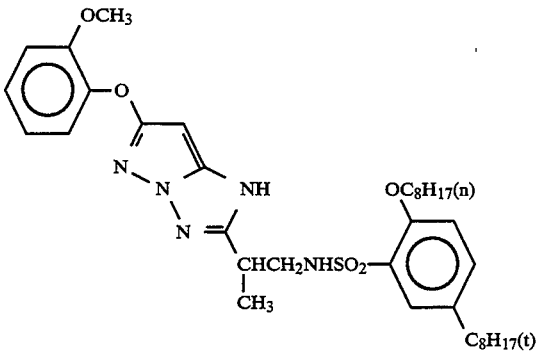

-continued (M-38)

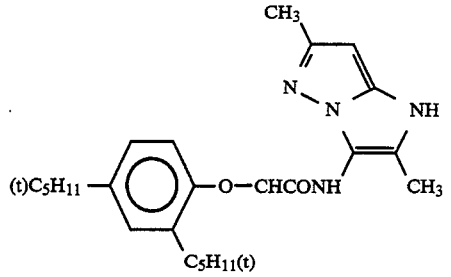

(M-39)

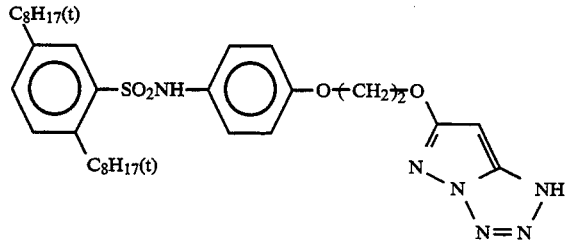

(M-40)

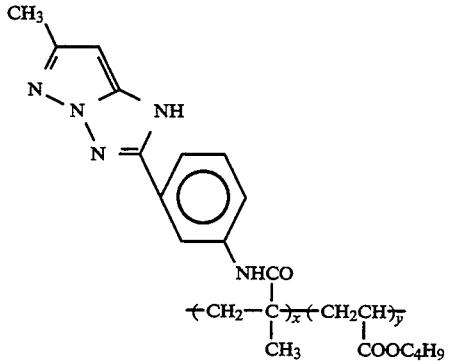

x/y = 50/50 (by weight)
average molecular weight:
about 30,000

(M-41)

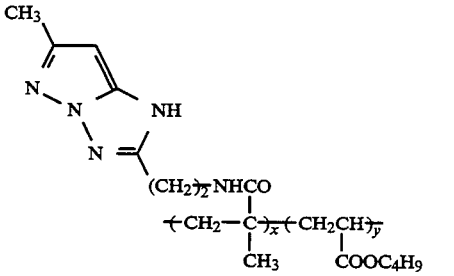

x/y = 50/50 (by weight)
average molecular weight:
about 20,000

In the present invention, the coated amount of the tetraequivalent magenta coupler is preferably $0.4\times10^{-3}$ to $3.5\times10^{-3}$ mole per $m^2$ of the light-sensitive material. This coupler can be used in combination with a diequivalent magenta coupler without causing any problem.

There can be mentioned as a cyan coupler the phenol and naphthol type couplers. Preferred are the compounds described in U.S. Pat. Nos. 4,052,212, 4,146,396, 4,228, 233, 4,296,200, 2,369,929, 2,801,171, 2,772,162, 2,895,826, 3,772,002, 3,758,308, 4,334,011, and 4,327,173; German Patent (OLS) 3,329,729; European Patents 121,365A, and 249,453A; U.S. Pat. Nos. 3,446,622, 4,333,999, 4,753,871, 4,451,559, 4,427,767, 4,690,889, 4,254,212, and 4,296,199; and JP-A-61-42658.

Preferred as a colored coupler used for correcting any unnecessary absorption of a formed image are the compounds described in RD No. 17643, VII-G, U.S. Patent 4,163,670, JP-B-57-39413, U.S. Patents 4,004,929 and 4,138,258, British Patent 1,146,368, and Japanese Patent Application No. 2-50137. Also, preferably used are the couplers which correct any unnecessary absorption of a formed image with a fluorescent dye released in coupling, described in U.S. Pat. No. 4,774,181, and the couplers having as a releasing group a dye precursor group capable of reacting with a developing agent to form a dye, described in U.S. Pat. No. 4,777,120.

Preferred as a coupler capable of forming a dye having an appropriate diffusing property are the compounds descried in U.S. Pat. No. 4,366,237, British Patent 2,125,570, European Patent 96,570, and German Patent (OLS) 3,234,533.

The typical examples of a dye-forming polymer coupler are described in U.S. Pat. Nos. 3,451,820, 4,080,211, 4,367,282, 4,409,320, and 4,576,910, and British Patent 2,102,173.

Also, there can be preferably used a coupler releasing a photographically useful residue by coupling. Preferred as a coupler releasing imagewise a nucleus-forming agent or a development accelerator in developing are the couplers described in British Patents 2,097,140 and 2,131,188, and JP-A-59-157638 and JP-A-59-170840.

In addition to the above, there are given as couplers capable of being used in light-sensitive material, the competitive couplers described in U.S. Pat. No. 4,130,427; the couplers releasing a dye whose color is recovered after releasing, described in European Patent 173,302A; the bleaching accelerator-releasing couplers described in RD No. 11449 and 24241, and JP-A-61-201247; the ligand-releasing couplers described in U.S. Pat. No. 4,553,477; the couplers releasing a leuco dye described in JP-A-63-75747; and the couplers releasing a fluorescent dye described in U.S. Pat. No. 4,774,181.

The couplers used in the present invention can be incorporated into a light-sensitive material by various conventional dispersing methods.

Examples of a high boiling-solvent used in an oil-in-water dispersion method are described in U.S. Pat. No. 2,322,027. Representative examples of the high-boiling organic solvent which has a boiling point at normal pressure of 175° C. or higher and is used in the oil-in-water dispersion method include phthalic esters (dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, and bis(1,1-diethylpropyl)phthalate), phosphoric or phosphonic esters (triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, and di-2-ethylhexyl phosphonate), benzoic esters (2-ethylhexyl benzoate, dodecyl benzoate, and 2-ethylhexyl-p-hydroxybenzoate), amides (N,N-diethyldecanamide, N,N-diethyllaurylamide, and N-tetradecylpyrrolidone), alcohols and phenols (isostearyl alcohol and 2,4-di-tert-amylphenol), aliphatic carboxylic esters (bis(2-ethylhexyl) sebacate, dioctyl azelate, glycerol tributylate, isostearyl lactate, and trioctyl citrate), aniline derivatives (N,N-dibutyl-2-butoxy-5-tert-octyl-aniline), and hydrocarbons (paraffin, dodecylbenzene, and diisopropylnaphthalene).

There can be used as an auxiliary solvent, organic solvents having a boiling point of about 30° C. or higher, preferably 50° C. or higher and about 160° C. or lower. Typical examples thereof include ethyl acetate, butyl acetate, ethyl propionate, methyl ethyl ketone, cyclohexanone, 2-ethoxyethyl acetate, and dimethylformamide.

Concrete examples of the steps and effect of a latex dispersing method and latexes for impregnation are described in U.S. Pat. No. 4,199,363, and German Patents (OLS) 2,541,274 and 2,541,230.

These couplers can be dispersed and emulsified in a hydrophilic colloid solution after they are impregnated into a loadable latex in the presence or absence of a high-boiling organic solvent (for example, U.S. Pat. No. 4,203,716), or they can be dissolved in a water insoluble and organic solvent-soluble polymer. Preferably used is a homopolymer or copolymer described on pages 12 to 30 of the specification of International Publication No. W088/00723. Particularly, a polyacrylamide type polymer is preferably used in terms of stabilizing a dye image.

A support suitable for use in the present invention is described in, for example, RD No. 17643, p. 28 and No. 18716, p. 647, right column to p. 648, left column.

The present invention can be applied to various light-sensitive materials. Particularly, it is used preferably for color negative films for general purpose and cinema and reversal films for slide and TV.

EXAMPLES

The present invention is explained in detail with reference to the following Examples, but the present invention is not to be construed as being limited thereto.

EXAMPLE 1

The layers having the following compositions were provided on a cellulose triacetate film support having thereon a subbing layer to prepare a multilayered color light-sensitive material Sample No. 101.

Composition of the light-sensitive layers

The coated amounts below are expressed in terms of $g/m^2$ of silver for silver halide and colloidal silver, in terms of $g/m^2$ for couplers, additives and gelatin and in terms of mole per mole of silver halide for the spectral sensitizers.

| | |
|---|---|
| First layer: anti-halation layer | |
| Black colloidal silver | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-i | 0.30 |
| Solv-2 | $1.2 \times 10^{-2}$ |
| Second layer: intermediate layer | |
| Silver iodobromide fine grains (AgI: 1.0 mole %, circle-corresponding diameter: 0.07 μm) | 0.15 |
| Gelatin | 1.00 |
| ExC-4 | $6.0 \times 10^{-2}$ |
| Cpd-3 | $2.0 \times 10^{-2}$ |
| Third layer: first red-sensitive layer | |
| Silver iodobromide emulsion (AgI: 5.0 mole %, higher AgI content on surface, circle-corresponding diameter: 0.9 μm, fluctuation coefficient of circle-corresponding diameter: 21%, tabular grains, diameter/thickness ratio: 7.5) | 0.42 |
| Silver iodobromide emulsion (AgI: 4.0 mole %, higher AgI content in internal portion of grains, circle-corresponding diameter: 0.4 μm, fluctuation coefficient of circle-corresponding diameter: 18%, tetradecahedron grains) | 0.40 |
| Gelatin | 1.90 |
| ExS-1 | $4.5 \times 10^{-4}$ |
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |

-continued

| | |
|---|---|
| **Fourth layer: second red-sensitive layer** | |
| Silver iodobromide emulsion (AgI: 8.5 mole %, higher AgI content in internal portion of grains, circle-corresponding diameter: 1.0 μm, fluctuation coefficient of circle-corresponding diameter: 25%, tabular grains, diameter/thickness ratio: 3.0) | 0.85 |
| Gelatin | 0.91 |
| ExS-1 | $3.0 \times 10^{-4}$ |
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| Solv-1 | 0.10 |
| **Fifth layer: third red-sensitive layer** | |
| Silver iodobromide emulsion (AgI: 11.3 mole %, higher AgI content in internal portion of grains, circle-corresponding diameter: 1.4 μm, fluctuation coefficient of circle-corresponding diameter: 28%, tabular grains, diameter/thickness ratio: 6.0) | 1.50 |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| Solv-1 | 0.12 |
| Solv-2 | 0.12 |
| **Sixth layer: intermediate layer** | |
| Gelatin | 1.00 |
| Cpd-4 | $8.0 \times 10^{-2}$ |
| Solv-1 | $8.0 \times 10^{-2}$ |
| **Seventh layer: first green-sensitive layer** | |
| Silver iodobromide emulsion (AgI: 5.0 mole %, higher AgI content on surface, circle-corresponding diameter: 0.9 μm, fluctuation coefficient of circle-corresponding diameter: 21%, tabular grains, diameter/thickness ratio: 7.0) | 0.28 |
| Silver iodobromide emulsion (AgI: 4.0 mole %, higher AgI content in internal portion of grains, circle-corresponding diameter: 0.4 μm, fluctuation coefficient of circle-corresponding diameter: 18%, tetra-decahedron grains) | 0.16 |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |
| ExM-2 | 0.10 |
| ExM-5 | $3.5 \times 10^{-2}$ |
| Solv-1 | 0.20 |
| Solv-3 | $3.0 \times 10^{-2}$ |
| **Eighth layer: second green-sensitive layer** | |
| Silver iodobromide emulsion (AgI: 8.5 mole %, higher AgI content in internal portion of grains, circle-corresponding diameter: 1.0 μm, fluctuation coefficient of circle-corresponding diameter: 25%, tabular grains, diameter/thickness ratio: 3.0) | 0.57 |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |

-continued

| | |
|---|---|
| ExM-2 | $7.1 \times 10^{-3}$ |
| ExM-3 | $3.5 \times 10^{-2}$ |
| Solv-1 | 0.15 |
| Solv-3 | $1.0 \times 10^{-2}$ |
| **Ninth layer: intermediate layer** | |
| Gelatin | 0.50 |
| Solv-1 | $2.0 \times 10^{-2}$ |
| **Tenth layer: third green-sensitive layer** | |
| Silver iodobromide emulsion (AgI: 11.3 mole %, higher AgI content in internal portion of grains, circle-corresponding diameter: 1.4 μm, fluctuation coefficient of circle-corresponding diameter: 28%, tabular grains, diameter/thickness ratio: 6.0) | 1.30 |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $4.5 \times 10^{-2}$ |
| ExM-6 | $1.0 \times 10^{-2}$ |
| ExC-2 | $4.5 \times 10^{-3}$ |
| Cpd-5 | $1.0 \times 10^{-2}$ |
| Solv-1 | 0.25 |
| **Eleventh layer: yellow filter layer** | |
| Gelatin | 0.50 |
| Cpd-6 | $5.2 \times 10^{-2}$ |
| Solv-1 | 0.12 |
| **Twelfth layer: intermediate layer** | |
| Gelatin | 0.45 |
| Cpd-3 | 0.10 |
| **Thirteenth layer: first blue-sensitive layer** | |
| Silver iodobromide emulsion (AgI: 2 mole %, uniform AgI content circle-corresponding diameter: 0.55 μm, fluctuation coefficient of circle-corresponding diameter: 25%, tabular grains, diameter/thickness ratio: 7.0) | 0.20 |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| **Fourteenth layer: second blue-sensitive layer** | |
| Silver iodobromide emulsion (AgI: 19.0 mole %, higher AgI content in internal portion of grains, circle-corresponding diameter: 1.0 μm, fluctuation coefficient of circle-corresponding diameter: 16%, octahedron grains) | 0.19 |
| Gelatin | 0.35 |
| ExS-7 | $2.0 \times 10^{-4}$ |
| ExY-1 | 0.22 |
| Solv-1 | $7.0 \times 10^{-2}$ |
| **Fifteenth layer: intermediate layer** | |
| Silver iodobromide fine grain emulsion (AgI: 2 mole %, uniform AgI content, circle-corresponding diameter: 0.13 μm) | 0.20 |
| Gelatin | 0.36 |
| **Sixteenth layer: third blue-sensitive layer** | |
| Silver iodobromide emulsion (AgI: 14.0 mole %, higher AgI content in internal portion of grains, circle-corresponding diameter: 1.7 μm, fluctuation coefficient of circle-corresponding diameter: 28%, tabular grains, diameter/thickness ratio: 5.0) | 1.55 |
| Gelatin | 1.00 |
| ExS-8 | $1.5 \times 10^{-4}$ |
| ExY-1 | 0.21 |
| Solv-1 | $7.0 \times 10^{-2}$ |
| **Seventeenth layer: first protective layer** | |

-continued

| | |
|---|---|
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth layer: second protective layer | |
| Silver chloride fine grains (circle-corresponding diameter: 0.07 μm) | 0.36 |
| Gelatin | 0.70 |
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |

-continued

| | |
|---|---|
| H-1 | 0.35 |
| Cpd-7 | 1.00 |

To this sample were added 1,2-benzoisothiazoline-3-one (average 200 ppm to gelatin), n-butyl-p-hydroxybenzoate (about 1,000 ppm to gelatin), and 2-phenoxyethanol (about 10,000 ppm to gelatin). Furthermore, the sample contained B-4, B-5, W-2, W-3, F-I, F-2, F-3, F-4, F-5, F-6, F-7, F-8, F-9, F-10, F-11, F-12, F-13, iron salts, lead salts, gold salts, platinum salts, iridium salts, and rhodium salts.

The above noted compounds are shown below:

UV-1

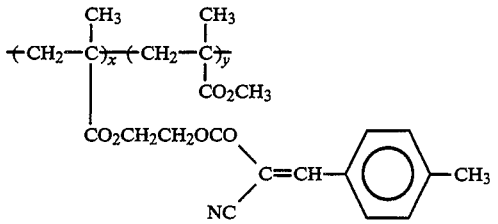

x/y = 7/3 (weight ratio)

UV-2

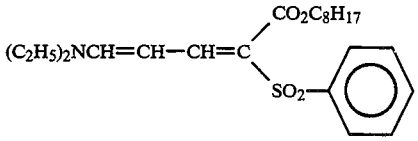

ExC-1

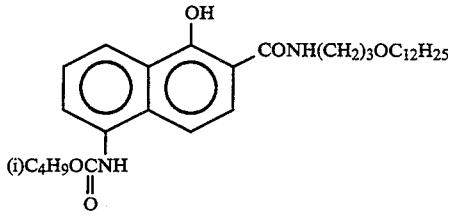

ExC-2

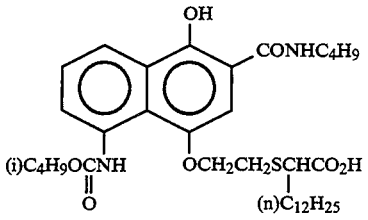

ExC-3

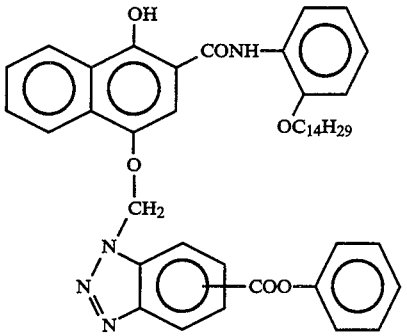

-continued
ExC-4
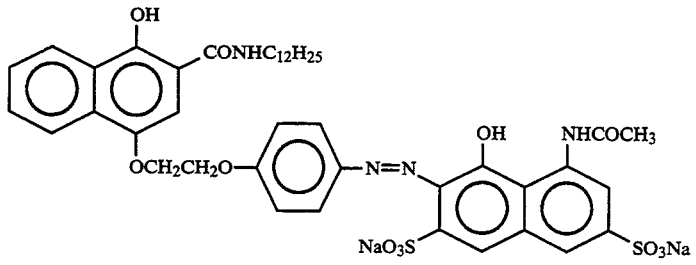
ExC-5
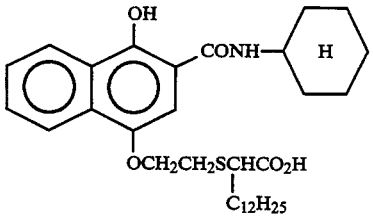
ExM-1
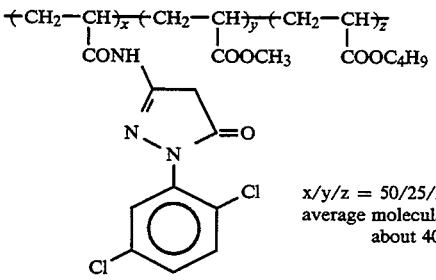
x/y/z = 50/25/25 (by weight)
average molecular weight:
about 40,000
ExM-2
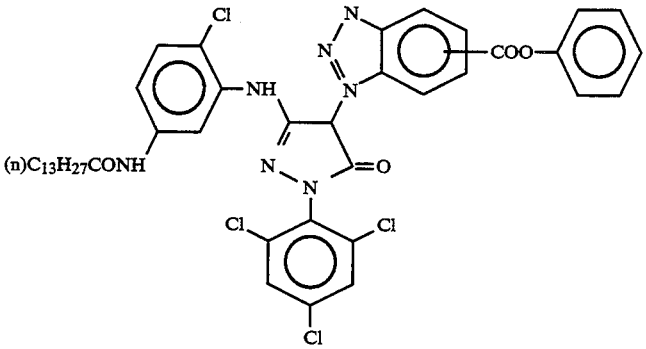
ExM-3
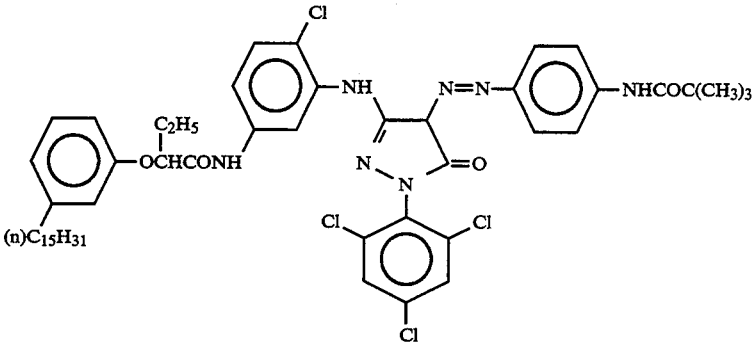

-continued
ExM-4
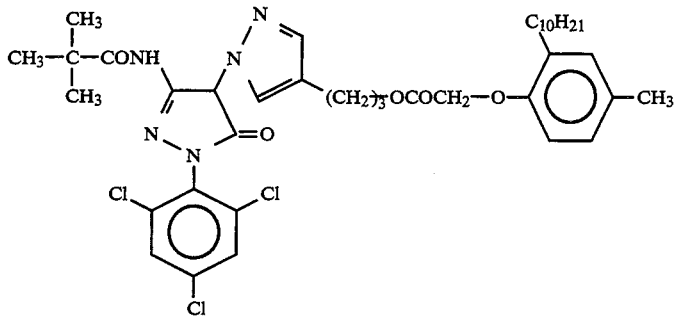
ExM-5
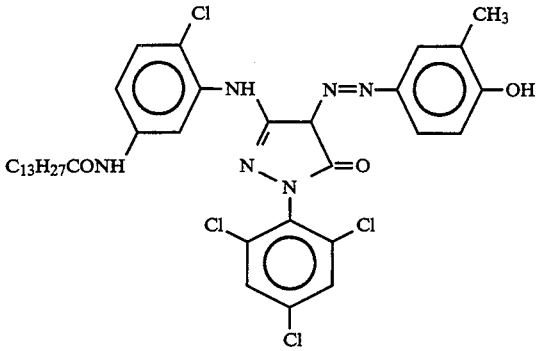
ExM-6
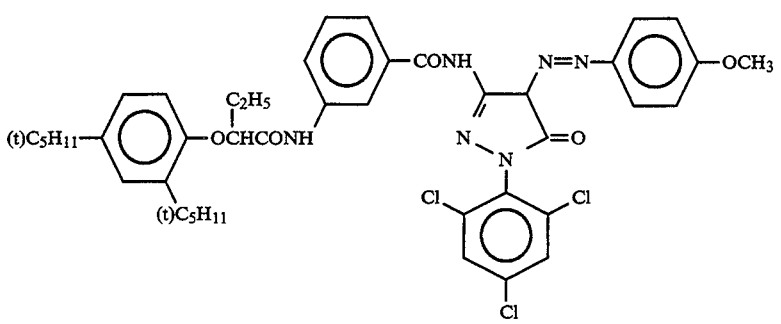
ExY-1
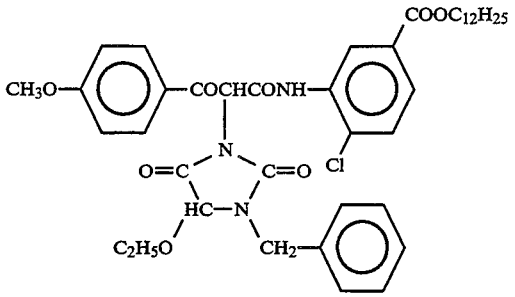
ExY-2
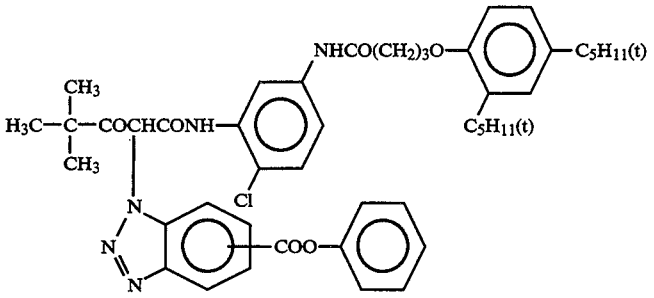

-continued
Cpd-1
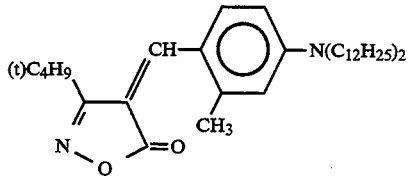
Cpd-2
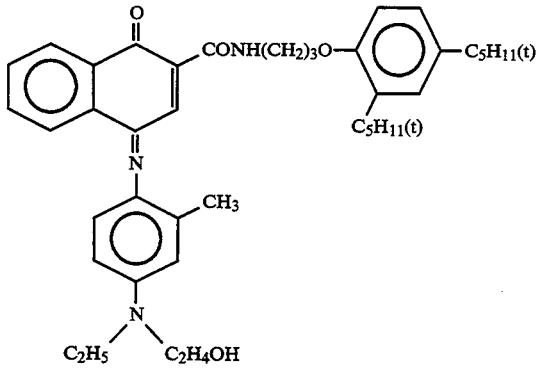
Cpd-3
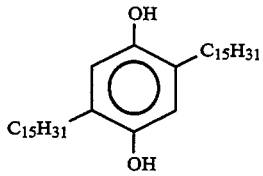
Cpd-4
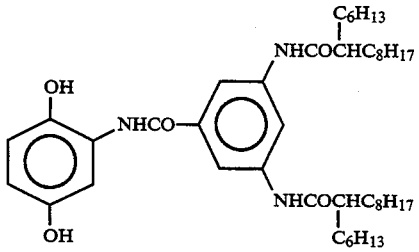
Cpd-5
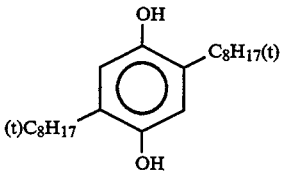
Cpd-6
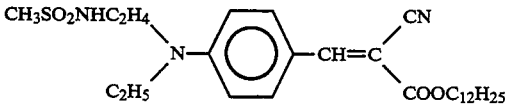
Cpd-7
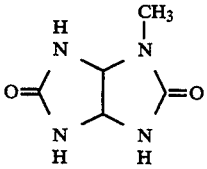
Solv-1
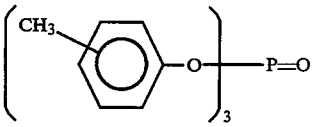

-continued
Solv-2
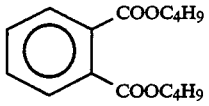
Solv-3
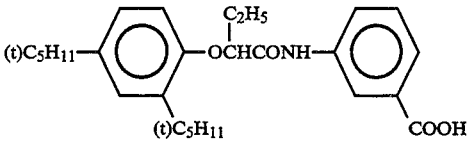
ExS-1
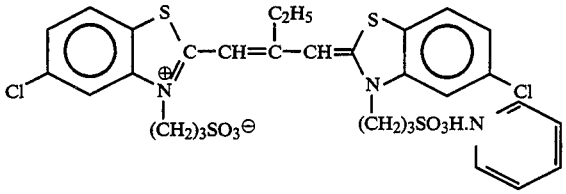
ExS-2
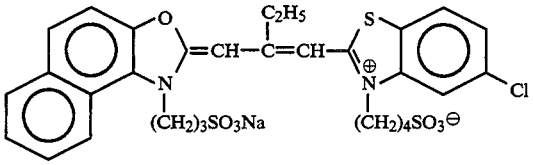
ExS-3
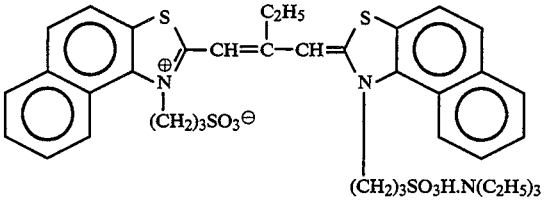
ExS-4
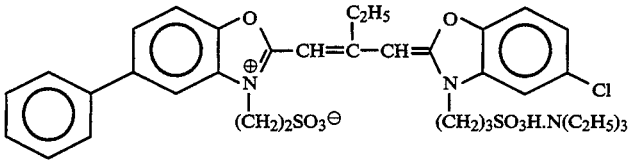
ExS-5
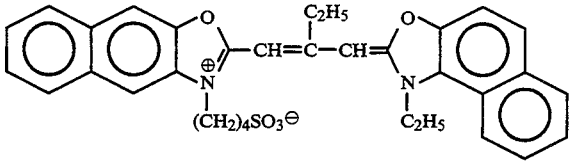
ExS-6
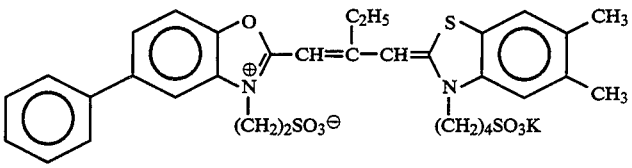
ExS-7
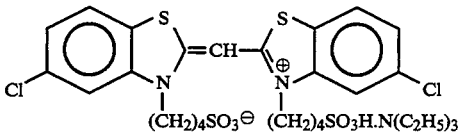

-continued
ExS-8
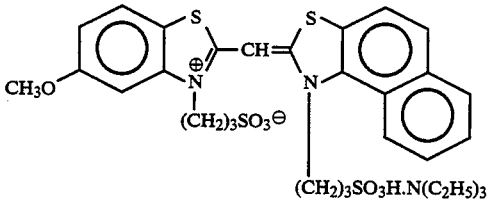
B-1
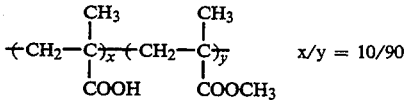
x/y = 10/90
B-2
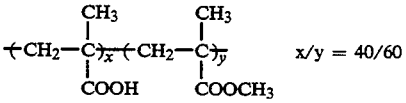
x/y = 40/60
B-3
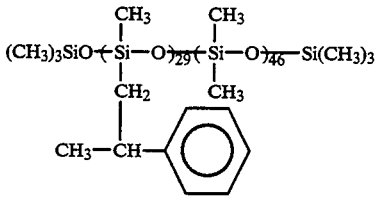
B-4
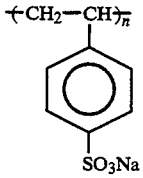
B-5
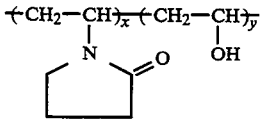
x/y = 70/30
W-1
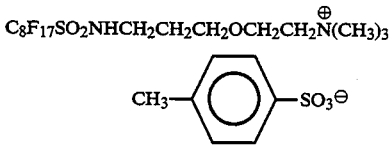
W-2
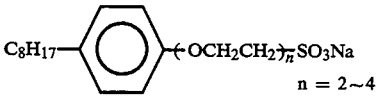
n = 2~4
W-3
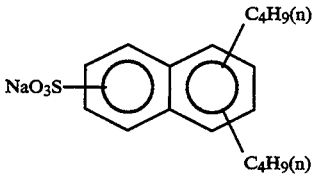
H-1
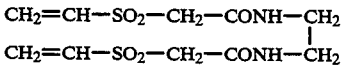
F-1
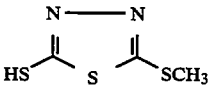

-continued
F-2
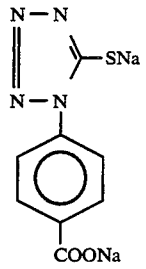
F-3
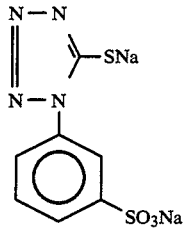
f-4
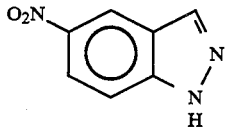
F-5
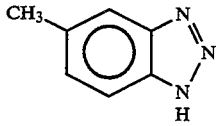
F-6
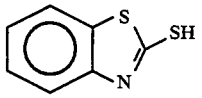
F-7
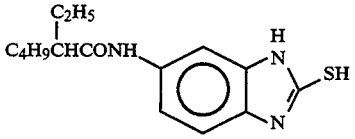
F-8
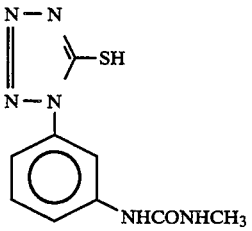
F-9
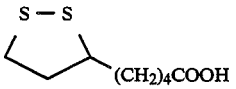
F-10
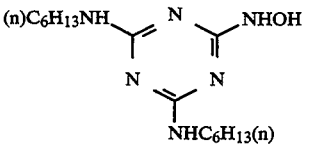

-continued

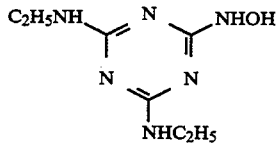

F-11

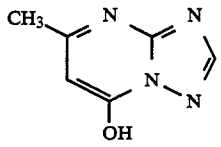

F-12

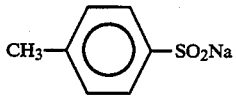

F-13

The dry layer thickness excluding that of the support of above Sample 101 was 22 μm and the swelling speed $T_{\frac{1}{2}}$ was 9 seconds.

Sample 101 thus prepared was cut to a length of 9 meters and a width of 35 min. A cut sample was image-wise exposed to white light of 50 lux for 0.01 second and was then processed with an automatic developing machine under the following conditions. In the following experimentation, the stabilizing solution was changed but the other processing steps ware carried out in the same manner to evaluate image preservability.

The processing steps and the compositions of the processing solutions are shown below.

| | Processing steps | | | |
|---|---|---|---|---|
| Step | Processing time | Processing temperature (°C.) | Replenishing amount (ml) | Tank capacity (l) |
| Color developing | 3 minutes & 5 seconds | 38.0 | 600 | 17 |
| Bleaching | 50 seconds | 38.0 | 140 | 5 |
| Bleach-fixing | 50 seconds | 38.0 | — | 5 |
| Fixing | 50 seconds | 38.0 | 420 | 5 |
| Washing | 30 seconds | 38.0 | 980 | 3 |
| Stabilizing (1) | 20 seconds | 38.0 | — | 3 |
| Stabilizing (2) | 20 seconds | 38.0 | 560 | 3 |
| Drying | 1 minute | 60 | | |

Note: replenishing amount: per $m^2$ of the light-sensitive material processed.

The direction of flow of the stabilizing solution was from (2) to (1) in a counter-current manner, and all the overflow solution from the washing water was introduced to the fixing bath. All of the overflow solution from the bleaching bath and fixing bath (overflow generated by supply thereto of replenishing solutions) was introduced into the bleach-fixing bath as a replenishing solution. The amount of developing solution carried over to the bleaching bath, the bleaching solution to the bleach-fixing bath, the bleach-fixing solution to the fixing bath, and the fixing solution to the washing bath were 65, 50, 50 and 50 ml per $m^2$ of the light-sensitive material processed, respectively. The crossover time for each step was 6 seconds, and its time was included in the processing time of the preceding bath.

The same solution as the respective tank solutions were used as the replenishing solutions therefor.

The compositions of the processing solutions are shown below. The units are given in grams unless otherwise noted.

| | A | B |
|---|---|---|
| Color Developing solution | | |
| Diethylenetriaminepentacetic acid | 2.0 | 2.0 |
| 1-Hydroxyethylidene-1,1-diphosphonic acid | 3.3 | 3.3 |
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| 2-Methyl-4-[N-ethyl-N-(β-hydroxyethyl)amino]aniline sulfate | 4.5 | 6.0 |
| Water to make | 1.0 l | 1.0 l |
| pH | 10.05 | 10.15 |
| Bleaching solution | | |
| Ferric ammonium 1,3-diaminopropanetetraacetic acid monohydrate | 130 | 195 |
| Ammonium bromide | 80 | 120 |
| Ammonium nitrate | 15 | 25 |
| Hydroxyacetic acid | 50 | 75 |
| Acetic acid | 40 | 60 |
| Water to make | 1.0 l | 1.0 l |
| pH was adjusted with aqueous ammonia to | 4.3 | 4.0 |

Note:
A: starting solution
B: replenishing solution

Bleach-fixing solution

The mixed solution of the above bleaching-starting solution and the following fixing starting solution in the ratio of 15 to 85 volume. pH: 7.0.

| Fixing-replenishing solution | |
|---|---|
| Ammonium sulfite | 55 |
| Ammonium thiosulfate aqueous solution (700 g/liter) | 840 ml |
| Imidazole | 50 |
| Ethylenediaminetetracetic acid | 40 |
| Water to make | 1.0 l |
| pH (adjusted with aqueous ammonia and acetic acid) | 7.45 |

Fixing-starting solution

The solution prepared by diluting the fixing-replenishing solution by three times with tap water (pH 7.4).

Washing water

Tap water was introduced into a mixed-bed type column filled with H type strong acidic cation exchange resins Amberlite IR-120B and OH type strong base anion exchange resins Amberlite IRA-400 each manufactured by Rohm & Haas Co., Ltd. to reduce the ion concentrations of calcium and magnesium to 3 mg/liter or less. Subsequently sodium dichloroisocyanurate 20 mg/liter and sodium sulfate 150 mg/liter were added. The pH range of this solution was 6.5 to 7.5.

| Stabilizing solution | | A/B common |
|---|---|---|
| Sodium p-toluenesulfinate | | 0.1 |
| Polyoxyethylene-p-monononylphenyl ether (average polymerization degree: 10) | | 0.2 |
| Disodium ethylenediaminetetraacetate | | 0.05 |
| Image stabilizer | | |
| Amine compound | described in Table A | |
| Formalin | described in Table A | |
| Water to make | | 1.0 l |
| pH | | 7.2 |

Evaluation of image preservability

The magenta densities of the respective samples thus processed were measured with a densitometer FSD 103 manufactured by Fuji Photo Film Co.,. Ltd. Then, each of the samples was subjected to an aging test under conditions of 25° C. and a relative humidity of 55% for two months, and the magenta densities were measured once again in the same manner.

The image preservability was evaluated by the reduction thereof upon aging (M fading), wherein the magenta densities of the respective samples after processing were 1.5.

Evaluation of aging stability of a processing solution

Two liters of each of the above stabilizing solutions after processing was put in a 2 liter tall beaker (opening-area: 100 $cm^2$). Then, each 20 ml of the fixing solution after processing was added and mixed well, and the beaker was covered with a lid made of transparent polyvinyl chloride. This test solution was left standing under conditions of 40° C. and a relative humidity of 70% for 60 days to determine the number of days until turbidity and precipitation were generated. The lid had a round hole with a diameter of 1 mm for ventilation.

Measurement of a formaldehyde vapor concentration 500 ml of each of the stabilizing solutions prepared by the above procedure were placed in a beaker (opening area: 200 $cm^2$), which beaker was then placed in a closed glass vessel having a volume of five liters and allowed to stand at 40° C. for two days. Then, the formaldehyde vapor concentration in the glass vessel was measured with an instant reading L type formaldehyde gas detecting tube manufactured by Gastech Co. (HCHO concentration).

Furthermore, the condensed solutions were prepared by concentrating the respective stabilizing solutions by a factor of 25 times to measure the formaldehyde vapor concentration in the same manner as described above (HCHO concentration of the condensed solution).

The evaluation results are shown in Table A together with the type and amount of amine compound and the amount of formaldehyde added to the stabilizing solution.

TABLE A

| | Image stabilizer | | | Solution | HCHO vapor concentration (ppm) | |
|---|---|---|---|---|---|---|
| Sample No. | Combination | Add. amount | M fading | stability | Tank solution | Condensed sol. |
| 1 (Comp.) | — | — | 0.30 | 60*5 | — | — |
| 2 (Comp.) | Formalin*1 | 0.02*2 | 0.00 | 8 | 5 or more | 5 or more |
| 3 (Comp.) | HMT*3 | 0.02 | 0.28 | 40 | 0 | 0 |
| 4 (Comp.) | TEA*4 | 0.06 | 0.30 | 20 | 5 or more | 5 or more |
| | Formalin | 0.02 | | | | |
| 5 (Comp.) | I-1 | 0.06 | 0.30 | 60 | 0 | 0 |
| 6 (Comp.) | I-1 | 0.02 | 0.01 | 9 | 3 | 5 or more |
| | Formalin | 0.02 | | | | |
| 7 (Inv.) | I-1 | 0.024 | 0.01 | 35 | 0.8 | 2 |
| | Formalin | 0.02 | | | | |
| 8 (Inv.) | I-1 | 0.03 | 0.01 | 43 | 0.3 | 0.3 |
| | Formalin | 0.02 | | | | |
| 9 (Inv.) | I-1 | 0.06 | 0.01 | 55 | 0.1 | 0 |
| | Formalin | 0.02 | | | | |
| 10 (Inv.) | I-2 | 0.06 | 0.01 | 55 | 0.2 | 0 |
| | Formalin | 0.02 | | | | |
| 11 (Inv.) | I-3 | 0.06 | 0.01 | 55 | 0.2 | 0 |
| | Formalin | 0.02 | | | | |
| 12 (Inv.) | I-5 | 0.06 | 0.02 | 55 | 0.2 | 0 |
| | Formalin | 0.02 | | | | |
| 13 (Inv.) | I-26 | 0.07 | 0.02 | 55 | 0.2 | 0.1 |
| | Formalin | 0.02 | | | | |
| 14 (Inv.) | Ip-1 | 0.10 | 0.02 | 55 | 0.2 | 0.2 |
| | Formalin | 0.02 | | | | |
| 15 (Inv.) | Ip-4 | 0.12 | 0.02 | 54 | 0.2 | 0.2 |
| | Formalin | 0.02 | | | | |
| 16 (Inv.) | I-1 | 0.06 | 0.01 | 55 | 0.1 | 0 |
| | N-Methylol | 0.02*6 | | | | |

TABLE A-continued

| Sample No. | Image stabilizer Combination | Image stabilizer Add. amount | M fading | Solution stability | HCHO vapor concentration (ppm) Tank solution | HCHO vapor concentration (ppm) Condensed sol. |
|---|---|---|---|---|---|---|
| | of I-1*7 | | | | | |

Note:
*1 37% aqueous solution of formaldehyde
*2 mole/liter
*3 Hexamethylenetetramine (described in JP-A-63-244036)
*4 Triethanolamine (described in U.S. Pat. No. 4,859,574)
*5 days
*6 initial concentration (amount added as powder)
*7

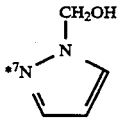

It is clearly seen from the results shown in Table A that the present invention can provide a processing method having a reduced formaldehyde vapor concentration of formalin and a stabilizing solution having excellent stability and which method further provides excellent image storage stability.

EXAMPLE 2

Samples 201 and 202 were prepared in the same manner as Example 1, except that the magenta coupler ExM-1 of Sample 101 was replaced with equimolar amounts of M-1 and M-17, respectively. The samples thus prepared were evaluated in the same manner as Example 1 and similar results were obtained.

Furthermore, Samples 203 and 204 were prepared in the same manner as Example 1, except that the magenta coupler ExM-4 of Sample 101 was replaced with equimolar amounts of M-1 and an equimolar mixture of ExM-4 and M-1 (1:1), respectively, Samples 201 and 202 were evaluated in the same manner as Example 1 and similar results were obtained.

EXAMPLE 3

Sample 101 was processed in the following processing steps and solutions with an automatic developing machine using the respective stabilizing solutions containing the compounds as indicated in Table A. The samples thus processed were evaluated with respect to image preservability as in Example 1. Similar results were obtained.

| Step | Processing time | Processing steps: Processing temperature (°C.) | Replenishing amount (ml) | Tank capacity (l) |
|---|---|---|---|---|
| Color developing | 3 minutes & 15 seconds | 38 | 33 | 20 |
| Bleaching | 6 minutes & 30 seconds | 38 | 25 | 40 |
| Washing | 2 minutes & 10 seconds | 24 | 1200 | 20 |
| Fixing | 4 minutes & 20 seconds | 38 | 25 | 30 |
| Washing (1) | 1 minute & 5 seconds | 24 | — | 10 |
| Washing (2) | 1 minute | 24 | 1200 | 10 |
| Stabilizing | 1 minute & 5 seconds | 38 | 25 | 10 |
| Drying | 4 minutes & 20 seconds | 55 | | |

-continued

| Step | Processing time | Processing steps: Processing temperature (°C.) | Replenishing amount (ml) | Tank capacity (l) |
|---|---|---|---|---|

Note:
Replenishing amount is per 1 m × 35 mm (width) of the light-sensitive material processed.
Washing was done in a counter current-system from (2) to (1).

The compositions of the processing solutions are shown below. The units are given in grams unless indicated otherwise.

| | A | B |
|---|---|---|
| Color developing solution (unit: g) | | |
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-Ethyl-N-(β-hydroxyethylamino)]-2-methylaniline sulfate | 4.5 | 5.5 |
| Water to make | 1.0 l | 1.0 l |
| pH | 10.05 | 10.10 |
| Bleaching solution | | |
| Ferric sodium ethylenediaminetetraacetic acid trihydrate | 100.0 | 120.0 |
| Disodium ethylenediaminetetraacetic acid | 10.0 | 10.0 |
| Ammonium bromide | 140.0 | 160.0 |
| Ammonium nitrate | 30.0 | 35.0 |
| Aqueous ammonia (27 wt %) | 6.5 ml | 4.0 ml |
| Water to make | 1.0 l | 1.0 l |
| pH | 6.0 | 5.7 |
| Fixing solution | | |
| Disodium ethylenediaminetetraacetate | 0.5 | 0.7 |
| Sodium sulfite | 7.0 | 8.0 |
| Sodium bisulfite | 5.0 | 5.5 |
| Ammonium thiosulfate aqueous Solution (700 g/liter) | 170.0 ml | 200.0 ml |
| Water to make | 1.0 l | 1.0 l |
| pH | 6.7 | 6.6 |
| Stabilizing solution | | |
| Image stabilizer (described in Table A) | 2.0 ml | 3.0 ml |
| Polyoxyethylene-p-monononylphenyl ether (average polymerization degree: 10) | 0.3 | 0.45 |
| Disodium ethylenediaminetetraacetate | 0.05 | 0.08 |
| Water to make | 1.0 l | 1.0 l |

-continued

| | A | B |
|---|---|---|
| pH | 5.0–8.0 | 5.0–8.0 |

Note:
A: mother solution
B: replenishing solution

EXAMPLE 4

Sample 101 was processed in the stabilizing solution No. 1 (obtaining no image stabilizer) of Example 3 and the bleaching solution prepared by adding Compound I-1 in an amount of 0.3 mole/liter and formalin (37 wt%) in an amount of 0.1 mole/liter to the bleaching solution of Example 3. The processed sample was evaluated with respect to image preservability as in Example 1. Excellent results were obtained similar to those of Sample No. 8 of Example 1.

EXAMPLE 5

Preparation of Sample 501

The respective layers having the following compositions were provided on a 127 μm thick cellulose triacetate film support having thereon a subbing layer to prepare a multi-layered color light-sensitive material Sample 501. The addition amounts are expressed in terms of g/m$^2$ and those of colloidal silver and silver halides are expressed in terms of the amounts expressed as silver, unless noted otherwise.

| | |
|---|---|
| **First layer: anti-halation layer** | |
| Black colloidal silver | 0.25 |
| Gelatin | 1.9 |
| UV absorber U-1 | 0.04 |
| UV absorber U-2 | 0.1 |
| UV absorber U-3 | 0.1 |
| UV absorber U-4 | 0.1 |
| UV absorber U-6 | 0.1 |
| High-boiling solvent Oil-1 | 0.1 |
| **Second layer: intermediate layer** | |
| Gelatin | 0.40 |
| Compound Cpd-D | 10 mg |
| High-boiling organic solvent Oil-3 | 0.1 |
| Dye D-4 | 0.4 mg |
| **Third layer: intermediate layer** | |
| Silver iodobromide fine grains having fogged surface and inside portions (average grain size: 0.06 μm, fluctuation coefficient: 18%, AgI content: 1 mole %) | 0.05 |
| Gelatin | 0.4 |
| **Fourth layer: low speed red-sensitive layer** | |
| Emulsion A | 0.2 |
| Emulsion B | 0.3 |
| Gelatin | 0.8 |
| Coupler C-1 | 0.15 |
| Coupler C-2 | 0.05 |
| Coupler C-9 | 0.05 |
| Compound Cpd-D | 10 mg |
| High-boiling organic solvent Oil-2 | 0.1 |
| **Fifth layer: medium speed red-sensitive layer** | |
| Emulsion B | 0.2 |
| Emulsion C | 0.3 |
| Gelatin | 0.8 |
| Coupler C-1 | 0.2 |
| Coupler C-2 | 0.05 |
| Coupler C-3 | 0.2 |
| High-boiling organic solvent Oil-2 | 0.1 |
| **Sixth layer: high speed red-sensitive layer** | |
| Emulsion D | 0.4 |
| Gelatin | 1.1 |
| Coupler C-1 | 0.3 |
| Coupler C-3 | 0.7 |
| Additive P-1 | 0.1 |

-continued

| | |
|---|---|
| **Seventh layer: intermediate layer** | |
| Gelatin | 0.6 |
| Additive M-1 | 0.3 |
| Anti-stain agent Cpd-K | 2.6 mg |
| UV absorber U-1 | 0.1 |
| UV absorber U-6 | 0.1 |
| Dye D-1 | 0.02 |
| **Eighth layer: intermediate layer** | |
| Silver iodobromide grains having fogged surface and inside portions (average grain size: 0.06 μm, fluctuation coefficient: 16%, AgI content: 0.3 mole %) | 0.02 |
| Gelatin | 1.0 |
| Additive P-1 | 0.2 |
| Anti-stain agent Cpd-J | 0.1 |
| Anti-stain agent Cpd-A | 0.1 |
| **Ninth layer: low speed green-sensitive layer** | |
| Emulsion E | 0.3 |
| Emulsion F | 0.1 |
| Emulsion G | 0.1 |
| Gelatin | 0.5 |
| Coupler C-7 | 0.05 |
| Coupler C-8 | 0.20 |
| Compound Cpd-B | 0.03 |
| Compound Cpd-D | 10 mg |
| Compound Cpd-E | 0.02 |
| Compound Cpd-F | 0.02 |
| Compound Cpd-G | 0.02 |
| Compound Cpd-H | 0.02 |
| High-boiling organic solvent Oil-1 | 0.1 |
| High-boiling organic solvent Oil-2 | 0.1 |
| **Tenth layer: medium speed green-sensitive layer** | |
| Emulsion G | 0.3 |
| Emulsion H | 0.1 |
| Gelatin | 0.6 |
| Coupler C-7 | 0.2 |
| Coupler C-8 | 0.1 |
| Compound Cpd-B | 0.03 |
| Compound Cpd-E | 0.02 |
| Compound Cpd-F | 0.02 |
| Compound Cpd-G | 0.05 |
| Compound Cpd-H | 0.05 |
| High-boiling organic solvent Oil-2 | 0.1 |
| **Eleventh layer: high speed green-sensitive layer** | |
| Emulsion I | 0.5 |
| Gelatin | 1.0 |
| Coupler C-4 | 0.3 |
| Coupler C-8 | 0.1 |
| Compound Cpd-B | 0.08 |
| Compound Cpd-E | 0.02 |
| Compound Cpd-F | 0.02 |
| Compound Cpd-G | 0.02 |
| Compound Cpd-H | 0.02 |
| High-boiling organic solvent Oil-1 | 0.02 |
| High-boiling organic solvent Oil-2 | 0.02 |
| **Twelfth layer: intermediate layer** | |
| Gelatin | 0.6 |
| Dye D-1 | 0.1 |
| Dye D-2 | 0.05 |
| Dye D-3 | 0.07 |
| **Thirteenth layer: yellow filter layer** | |
| Yellow colloidal silver | 0.1 |
| Gelatin | 1.1 |
| Anti-stain agent Cpd-A | 0.01 |
| High-boiling organic solvent Oil-1 | 0.01 |
| **Fourteenth layer: intermediate layer** | |
| Gelatin | 0.6 |
| **Fifteenth layer: low speed blue-sensitive layer** | |
| Emulsion J | 0.4 |
| Emulsion K | 0.1 |
| Emulsion L | 0.1 |
| Gelatin | 0.8 |
| Coupler C-5 | 0.6 |
| **Sixteenth layer: medium speed blue-sensitive layer** | |
| Emulsion L | 0.1 |
| Emulsion M | 0.4 |
| Gelatin | 0.9 |
| Coupler C-5 | 0.3 |
| Coupler C-6 | 0.3 |

-continued

| | |
|---|---|
| **Seventeenth layer: high speed blue-sensitive layer** | |
| Emulsion N | 0.4 |
| Gelatin | 1.2 |
| Coupler C-6 | 0.7 |
| **Eighteenth layer: first protective layer** | |
| Gelatin | 0.7 |
| UV absorber U-1 | 0.04 |
| UV absorber U-2 | 0.01 |
| UV absorber U-3 | 0.03 |
| UV absorber U-4 | 0.03 |
| UV absorber U-5 | 0.05 |
| UV absorber U-6 | 0.05 |
| High-boiling organic solvent Oil-1 | 0.02 |
| Formalin scavenger | |
| Cpd-C | 0.2 |
| Cpd-I | 0.4 |
| Dye D-3 | 0.05 |
| **Nineteenth layer: second protective layer** | |
| Colloidal silver | 0.1 mg |
| Silver iodobromide fine grains (average grain size: 0.06 μm, AgI content: 1 mole %) | 0.1 |
| Gelatin | 0.4 |
| **Twentieth layer: third protective layer** | |
| Gelatin | 0.4 |
| Polymethyl methacrylate (average grain size: 1.5 μm) | 0.1 |
| Copolymer of methyl methacrylate and acrylic acid (4:6) (average grain size: 1.5 μm) | 0.1 |
| Silicone oil | 0.03 |
| Surfactant W-1 | 3.0 mg |
| Surfactant W-2 | 0.03 |

In addition to the above components, the additives F-1 to F-8 were added to each of the layers. Furthermore, a gelatin hardener H-1 and the surfactants W-3 and W-4 for coating and emulsifying in addition to the above components were added to each of the layers.

Furthermore, phenol, 1,2-benzisothiazoline-3-one, 2-phenoxyethanol, phenethyl alcohol and p-hydroxy benzoate butyl ester were added as a fungicide and an anti-mold agent.

The characteristics of silver iodobromide emulsions used in the above examples are shown below:

| Emulsion | Average grain size (μm) | Fluctuation coefficient (%) | AgI content (%) |
|---|---|---|---|
| A. Monodispersed tetra-decahedral grains | 0.25 | 16 | 3.7 |
| B. Monodispersed cubic, internal latent image type grains | 0.30 | 10 | 3.3 |
| C. Monodispersed tetra-decahedral grains | 0.30 | 18 | 5.0 |
| D. Polydispersed twinned grains | 0.60 | 25 | 2.0 |
| E. Monodispersed cubic grains | 0.17 | 17 | 4.0 |
| F. Monodispersed cubic grains | 0.20 | 16 | 4.0 |
| G. Monodispersed cubic, internal latent image type grains | 0.25 | 11 | 3.5 |
| H. Monodispersed cubic, internal latent image type grains | 0.30 | 9 | 3.5 |
| I. Polydispersed tabular grains (average aspect ratio: 4.0) | 0.80 | 28 | 1.5 |
| J. Monodispersed tetra-decahedral grains | 0.30 | 18 | 4.0 |
| K. Monodispersed tetra-decahedral grains | 0.37 | 17 | 4.0 |
| L. Monodispersed cubic, internal latent image type grains | 0.46 | 14 | 3.5 |
| M. Monodispersed cubic grains | 0.55 | 13 | 4.0 |
| N. Polydispersed tabular grains (average aspect ratio: 7.0) | 1.00 | 33 | 1.3 |

Spectral sensitization of Emulsions A to N

| Emulsion | Sensitizing dye | Addition amount per mol of AgX (g) | Timing for addition of sensitizing dye |
|---|---|---|---|
| A | S-1 | 0.025 | IV |
| | S-2 | 0.25 | IV |
| B | S-1 | 0.01 | II |
| | S-2 | 0.25 | II |
| C | S-1 | 0.02 | IV |
| | S-2 | 0.25 | IV |
| D | S-1 | 0.01 | IV |
| | S-2 | 0.10 | IV |
| | S-7 | 0.01 | IV |
| E | S-3 | 0.5 | IV |
| | S-4 | 0.1 | IV |
| F | S-3 | 0.3 | IV |
| | S-4 | 0.1 | IV |
| G | S-3 | 0.25 | II |
| | S-4 | 0.08 | II |
| H | S-3 | 0.2 | I |
| | S-4 | 0.06 | I |
| I | S-3 | 0.3 | III |
| | S-4 | 0.07 | III |
| | S-8 | 0.1 | III |
| J | S-6 | 0.2 | I |
| | S-5 | 0.05 | I |
| K | S-6 | 0.2 | I |
| | S-5 | 0.05 | I |
| L | S-6 | 0.22 | II |
| | S-5 | 0.06 | II |
| M | S-6 | 0.15 | IV |
| | S-5 | 0.04 | IV |
| N | S-6 | 0.22 | II |
| | S-5 | 0.06 | II |

I: during grain formation
II: immediately after grain formation but prior to chemical sensitization
III: immediately prior to chemical sensitization
IV: immediately after chemical sensitization

C-1

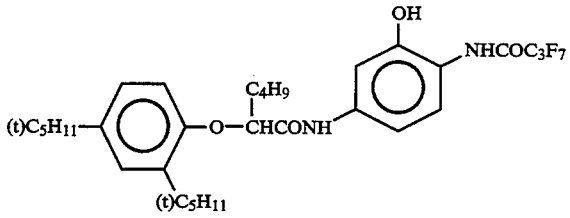

C-2

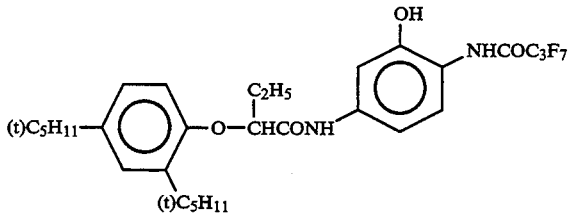

C-3

C-4

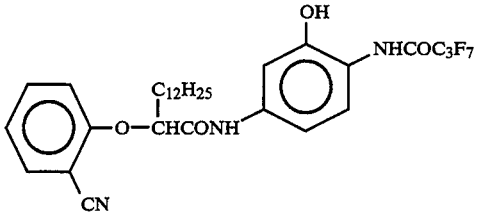
-continued
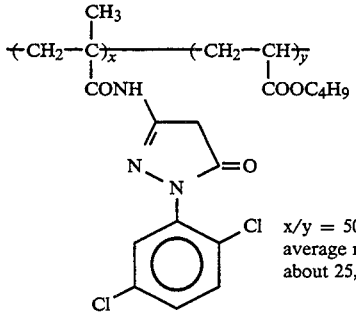
x/y = 50/50 (by weight)
average molecular weight: about 25,000
C-5
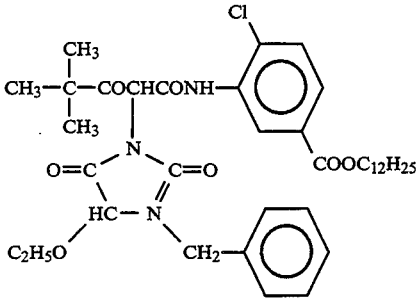
C-6
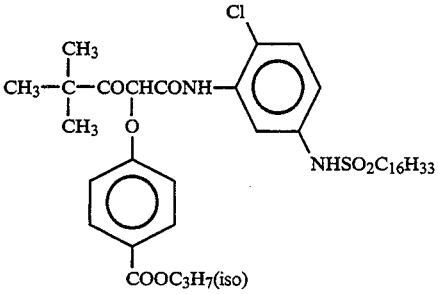
C-7
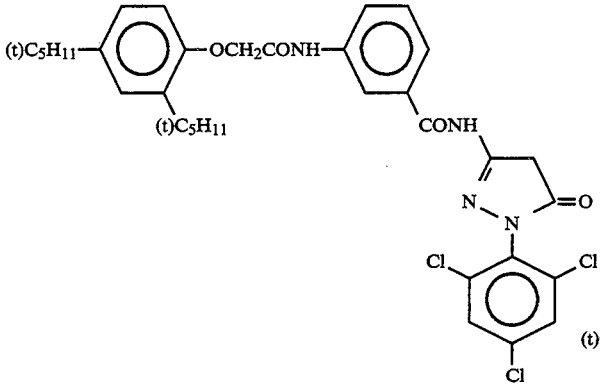
C-8
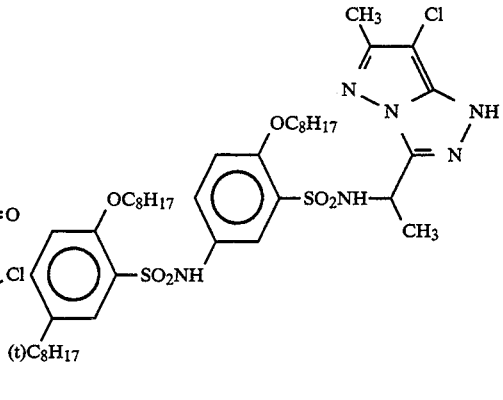
C-9
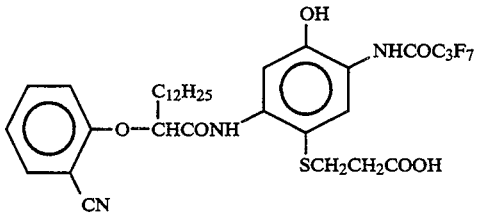
Oil-1
Dibutyl phthalate
Oil-2
Tricresyl phosphate
Oil-3
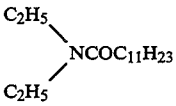
Cpd-A
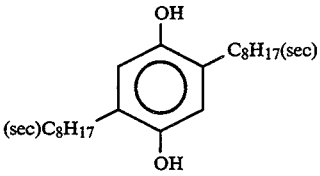
Cpd-B -continued
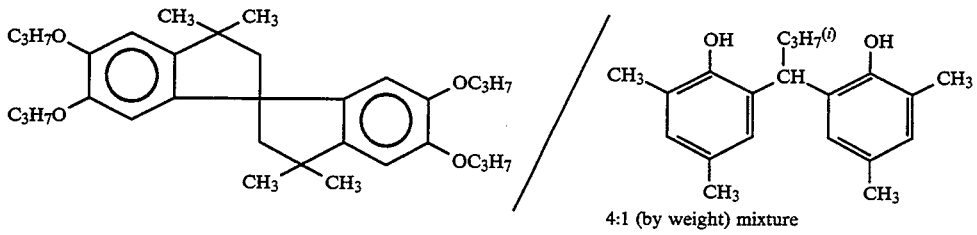
Cpd-C
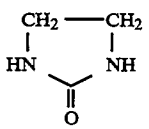
Cpd-D
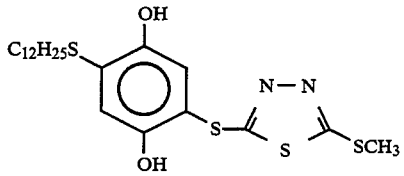
Cpd-E
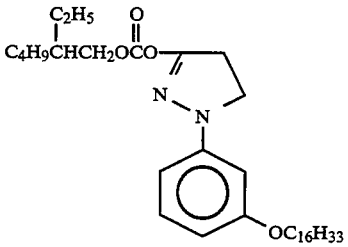
Cpd-F
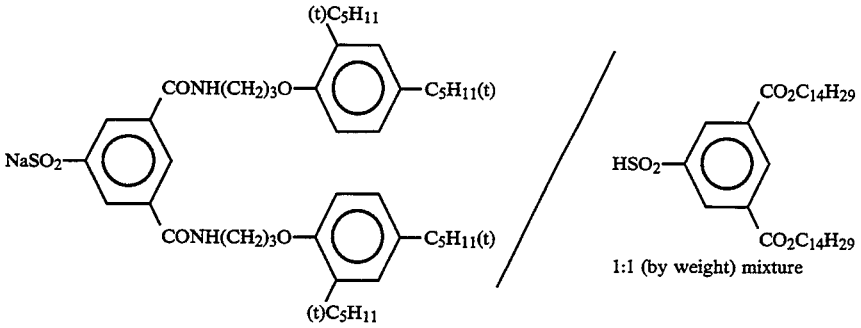
Cpd-G
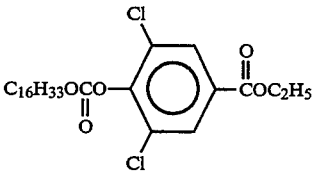
Cpd-H
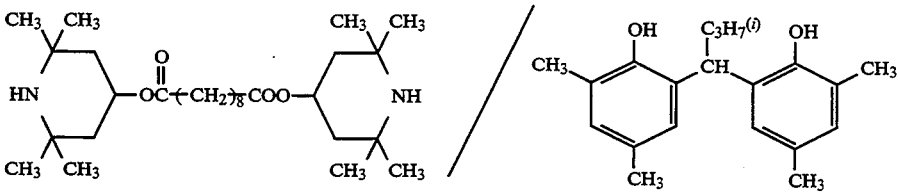
Cpd-I
Cpd-J

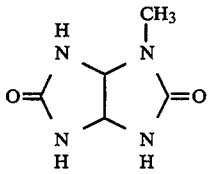
Cpd-K
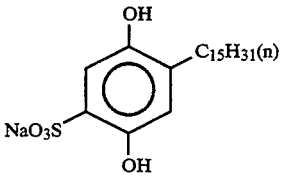
-continued
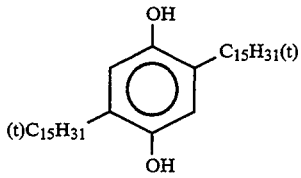
U-1
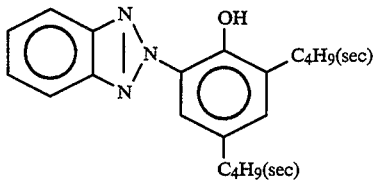
U-2
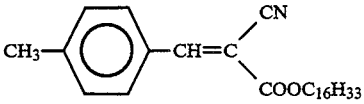
U-3
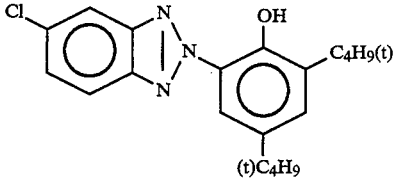
U-4
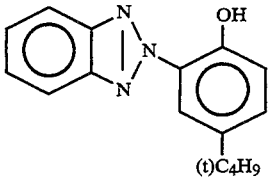
U-5
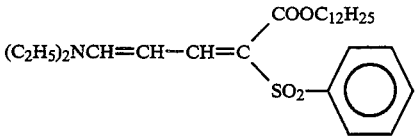
U-6
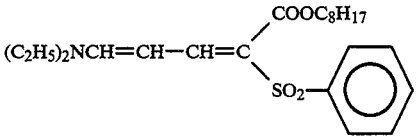
S-1
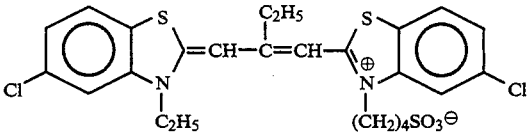
S-2
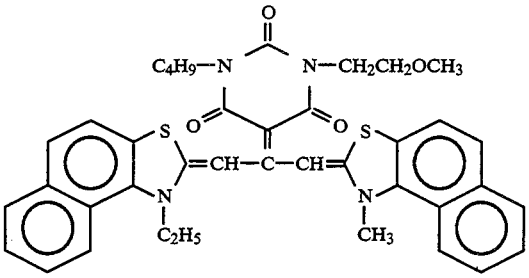
S-3
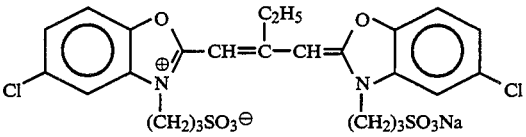
S-4
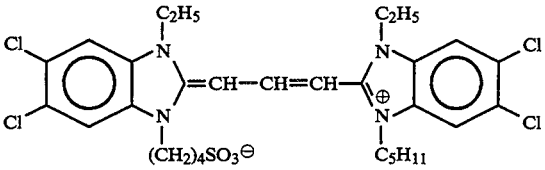
S-5
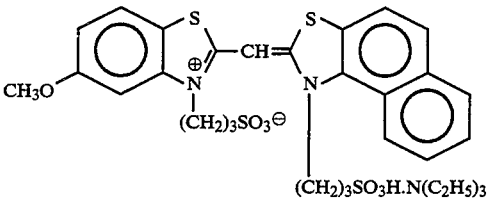
S-6
S-7

-continued
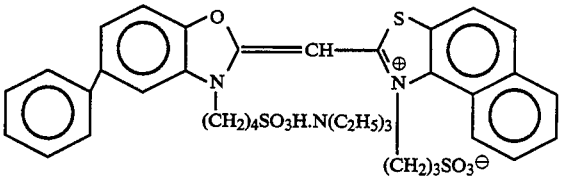
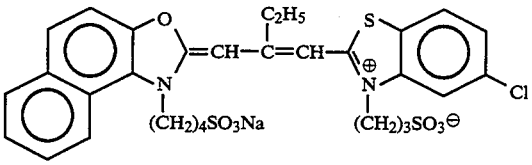
S-8
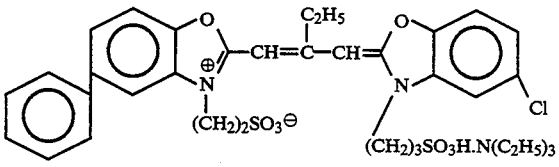
D-1
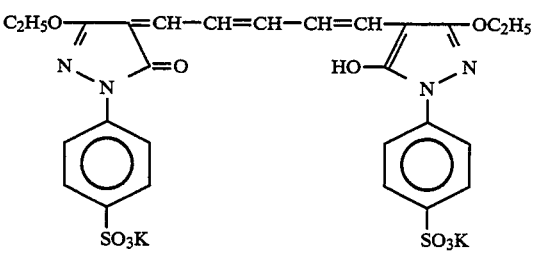
D-2
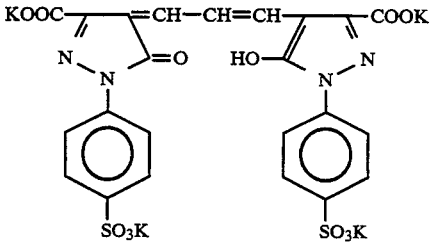
D-3
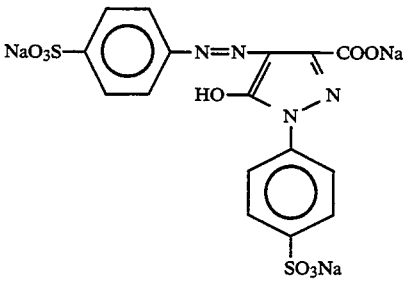
D-4
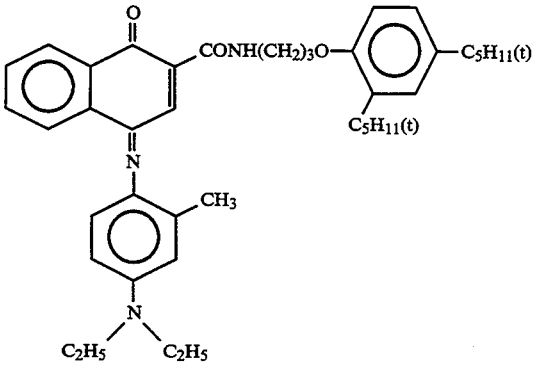
H-1
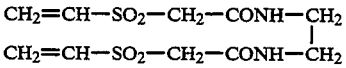
W-1
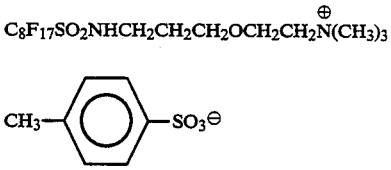
W-2
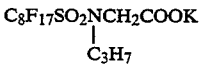
W-3
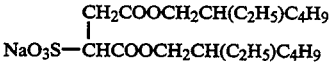
W-4
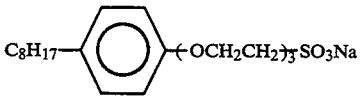
P-1
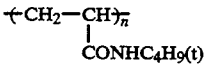
M-1
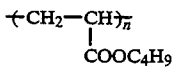
F-1
F-2

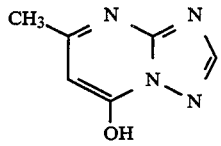

-continued

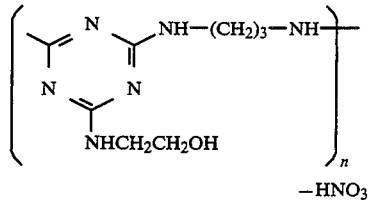

F-3

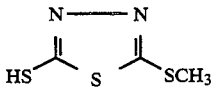

F-4

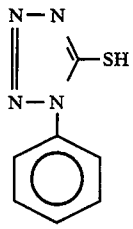

F-5

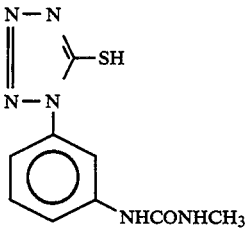

F-6

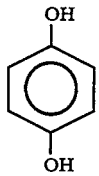

F-7

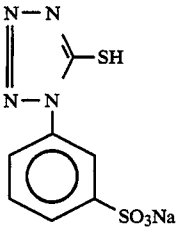

F-8

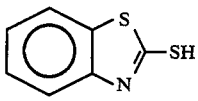

Sample 501 thus prepared was imagewise exposed and then processed with a cine type automatic developing machine according to the following processing steps. One half of the sample was first processed with the bleaching solution 1 and then with the respective stabilizing solutions. The same procedure was repeated with the second half of the sample with bleaching solution 2. The samples thus processed were evaluated in the same manner as in Example 1.

| | Processing steps | | | |
|---|---|---|---|---|
| Step | Time (min.) | Temperature (°C.) | Replenishing amount (l) | Tank capacity (l) |
| Black and white developing | 6 | 38 | 1.5 | 12 |
| 1st washing | 1 | 38 | 7.5 | 4 |
| Reversal | 1 | 38 | 1.1 | 4 |
| Color developing | 4 | 38 | 2.0 | 12 |
| Conditioning | 2 | 38 | 1.1 | 4 |
| Bleaching | 4 | 38 | 1.3 | 12 |
| Fixing | 3 | 38 | 1.3 | 12 |
| 2nd washing (1) | 1 | 38 | — | 4 |
| 2nd washing (2) | 1 | 38 | 7.5 | 4 |
| Stabilizing | 1 | 38 | 1.1 | 4 |
| Drying | 2 | 50 | | |

Replenishing amount: per $m^2$ of the light-sensitive material processed

The overflow solution of the second washing bath (2) was introduced into the second washing bath (1).

The compositions of the respective processing solutions are shown below:

| | Starting solution | Replenishing solution |
|---|---|---|
| Black and white developing solution | | |
| Pentasodium nitrilo-N,N,N-trimethylenephosphonate | 2.0 g | 2.0 g |
| Pentasodium diethylenetriaminepentaacetate | 3.0 | 3.0 |
| Potassium sulfite | 30 | 30 |
| Hydroquinone.potassium monosulfonate | 20 | 20 |
| Potassium carbonate | 33 | 33 |
| 1-Phenyl-4-methyl-4-hydroxymethyl-3-pyrazolidone | 2.0 | 2.0 |
| Potassium bromide | 2.5 | 0.9 |
| Potassium thiocyanate | 1.2 | 1.2 |
| Potassium iodide | 2.0 mg | 2.0 mg |
| Water to make | 1.0 l | 1.0 l |
| pH (25° C.) | 9.60 | 9.70 |
| pH was adjusted with hydrochloric acid or potassium hydroxide. | | |
| | Starting solution/ replenishing solution common | |

-continued

| Reversal solution | |
|---|---|
| Pentasodium nitrilo-N,N,N-trimethylenephosphonate | 2.0 g |
| Stannous chloride dihydrate | 1.0 |
| p-Aminophenol | 0.1 |
| Sodium hydroxide | 8.0 |
| Glacial acetic acid | 15 ml |
| Ammonium sulfite | 20 |
| Water to make | 1.0 liter |
| pH (25° C.) was adjusted with acetic acid or aqueous ammonia to: | 6.60 |

| | Starting solution | Replenishing solution |
|---|---|---|
| Color developing solution | | |
| Pentasodium nitrilo-N,N,N-trimethylenephosphonate | 2.0 g | 2.0 g |
| Pentasodium diethylenetriaminepentaacetate | 2.0 | 2.0 |
| Sodium sulfite | 7.0 | 7.0 |
| Tripotassium phosphate 12 hydrate | 36 | 36 |
| Potassium bromide | 1.0 | — |
| Potassium iodide | 90 mg | — |
| Sodium hydroxide | 3.0 | 3.0 |
| Citrazinic acid | 1.5 | 1.5 |
| N-Ethyl-(β-methanesulfonamid ethyl)-3-mehyl-4-aminoaniline sulfate | 10.5 | 10.5 |
| 3,6-Dithiaoctane-1,8-diol | 3.5 | 3.5 |
| Water to make | 1.0 l | 1.0 l |
| pH (25° C.) | 11.90 | 12.05 |
| pH was adjusted with hydrochloric acid or potassium hydroxide. | | |

| | Starting solution/ replenishing solution common |
|---|---|
| Conditioning solution | |
| Disodium ethylenediamine tetraacetate dihydrate | 8.0 g |
| Sodium sulfite | 12 |
| 2-Mercapto-1,3,4-triazole | 0.5 |
| pH (25° C.) | 6.00 |
| pH was adjusted with hydrochloric acid or sodium hydroxide. | |
| Bleaching solution (1) | |
| Ethylenediaminetetraacetic acid | 3 g |
| Ferric ammonium ethylenediaminetetraacetate dihydrate | 150 |
| 2-Mercapto-1,3,4-triazole | 0.5 |
| Ammonium bromide | 120 |
| Ammonium nitrate | 25 |
| Water to make | 1.0 l |
| pH (25° C.) | 4.20 |
| pH was adjusted with acetic acid and aqueous ammonia. | |
| Bleaching solution (2) | |
| 1,3-Diaminopropanetetracetic acid | 3 g |
| Ferric ammonium 1,3-diaminopropanetetraacetate dihydrate | 120 |
| Glycolic acid | 40 |
| Acetic acid | 30 |
| Ammonium bromide | 120 |
| Ammonium nitrate | 25 |
| Water to make | 1.0 l |
| pH (25° C.) | 4.20 |
| pH was adjusted with acetic acid or aqueous ammonia. | |
| Fixing solution | |
| Disodium ethylenediaminetetraacetate dihydrate | 1.7 |
| Sodium benzaldehyde-o-sulfonate | 20 |
| Sodium bisulfite | 15 |
| Ammonium thiosulfate (700 g/liter) | 250 ml |
| Water to make | 1.0 l |
| pH (25° C.) | 6.00 |
| pH was adjusted with acetic acid or aqueous ammonia. | |

-continued

Stabilizing solution

The respective stabilizing solutions as used in Example 1 were also used in this Example (starting solution/replenishing solution were common).

Image preservability was evaluated on the gray-developed portions of the respective processed samples (as in Example 1), in which the magenta density prior to storage was 0.5.

Results similar to those of Example 1 were obtained, namely, excellent image preservability was obtained with the stabilizing solutions containing the compounds of the present invention.

Furthermore, the samples were processed according to the above processing procedure except for using the stabilizing solution containing no image stabilizer. To the conditioning solution were added either 0.04 mole/liter of formalin alone, 0.04 mole/liter of formalin and 0.16 mole/liter of the amine compound shown in Table B, or none of formalin and the amine compound. The respective samples thus processed were evaluated with respect to image preservability as in Example 1, the results of which are shown in Table B.

TABLE B

| Sample No. | Image stabilizer | Image preservability*1 Bleacher 1 | Bleacher 2 |
|---|---|---|---|
| 1 (Comp.) | — | 0.20 | 0.20 |
| 2 (Comp.) | Formalin | 0 | 0 |
| 3 (Inv.) | Compound I-1 & formalin | 0.01 | 0 |
| 4 (Inv.) | Compound I-2 & formalin | 0.02 | 0.01 |
| 5 (Inv.) | Compound I-3 & formalin | 0.02 | 0.01 |
| 6 (Inv.) | Compound I-4 & formalin | 0.02 | 0.01 |
| 7 (Inv.) | Compound I-5 & formalin | 0.02 | 0.01 |
| 8 (Inv.) | Compound I-26 & formalin | 0.02 | 0.01 |
| 9 (Inv.) | Compound Ip-1 & formalin | 0.02 | 0.01 |
| 10 (Inv.) | Compound Ip-4*2 & formalin | 0.02 | 0.02 |
| 11 (Inv.) | I-1 & N-methylol of I-1*3 | 0.01 | 0 |

*1M fading
*2Addition amounts
formalin (37 wt % aqueous formaldehyde solution): 0.04 mole/liter
Ip-4: 0.20 mole/liter
*3Initial concentration of N-methylol product of I-1: 0.04 mole/liter
Addition amount of I-1: 0.16 mole/liter It is clearly seen from the results shown in Table B that processing in a processing solution containing formalin and an amine compound in accordance with the present invention provides a satisfactory anti-fading effect for a magenta dye image. Excellent results were obtained especially when a ferric complex salt of 1,3-diaminopropanetetraacetic acid in the bleaching solution was used.

No staining was observed on the surfaces of the respective samples in Table B.

EXAMPLE 6

Samples 601 to 605 were prepared in the following manner. The respective additives are represented by the following symbols, provided that the additives having plural effects are represented by only one symbol.

UV: UV absorber
Solv: High-boiling organic solvent
ExF: Dye
ExS: Sensitizing dye
ExC: Cyan coupler
ExM: Magenta coupler
ExY: Yellow coupler
Cpd: Additive The coated amounts of silver halide and colloidal silver are given in terms of g/m$^2$ expressed as silver; the coated amounts of couplers, dyes and additives are given in terms of g/m$^2$: and the coated amounts of the sensitizing dyes are given in terms of mole per mole of silver halide present in the same layer.

Preparation of Sample 601

The layers having the following compositions were provided on a cellulose triacetate film support having thereon a subbing layer to prepare a multilayered color light-sensitive material Sample No. 601.

| | |
|---|---|
| **First layer: anti-halation layer** | |
| Black colloidal silver | 0.20 |
| Gelatin | 2.20 |
| UV-1 | 0.11 |
| UV-2 | 0.20 |
| Cpd-1 | $4.0 \times 10^{-2}$ |
| Cpd-2 | $1.9 \times 10^{-2}$ |
| Solv-1 | 0.30 |
| Solv-2 | $1.2 \times 10^{-2}$ |
| **Second layer: intermediate layer** | |
| Silver iodobromide fine grains (AgI: 1.0 mole %, circle-corresponding diameter: 0.07 μm) | 0.15 |
| Gelatin | 1.00 |
| ExC-4 | $6.0 \times 10^{-2}$ |
| Cpd-3 | $2.0 \times 10^{-2}$ |
| **Third layer: first red-sensitive layer** | |
| Silver iodobromide emulsion (AgI: 5.0 mole %, higher AgI content on surface of grains, circle-corresponding diameter: 0.9 μm, fluctuation coefficient of circle-corresponding diameter: 21%, tabular grains, diameter/thickness ratio: 7.5) | 0.42 |
| Silver iodobromide emulsion (AgI: 4.0 mole %, higher AgI content in inside portion of grains, circle-corresponding diameter: 0.4 μm, fluctuation coefficient of circle-corresponding diameter: 18%, tetra-decahedron grains) | 0.40 |
| Gelatin | 1.90 |
| ExS-1 | $4.5 \times 10^{-4}$ |
| ExS-2 | $1.5 \times 10^{-4}$ |
| ExS-3 | $4.0 \times 10^{-5}$ |
| ExC-1 | 0.65 |
| ExC-3 | $1.0 \times 10^{-2}$ |
| ExC-4 | $2.3 \times 10^{-2}$ |
| Solv-1 | 0.32 |
| **Fourth layer: second red-sensitive layer** | |
| Silver iodobromide emulsion (AgI: 8.5 mole %, higher AgI content in inside portion of grains, circle-corresponding diameter: 1.0 μm, fluctuation coefficient of circle-corresponding diameter: 25%, tabular grains, diameter/thickness ratio: 3.0) | 0.85 |
| Gelatin | 0.91 |
| ExS-1 | $3.0 \times 10^{-4}$ |

-continued

| | |
|---|---|
| ExS-2 | $1.0 \times 10^{-4}$ |
| ExS-3 | $3.0 \times 10^{-5}$ |
| ExC-1 | 0.13 |
| ExC-2 | $6.2 \times 10^{-2}$ |
| ExC-4 | $4.0 \times 10^{-2}$ |
| Solv-1 | 0.10 |
| **Fifth layer: third red-sensitive layer** | |
| Silver iodobromide emulsion (AgI: 11.3 mole %, higher AgI content in inside portion of grains, circle-corresponding diameter: 1.4 μm, fluctuation coefficient of circle-corresponding diameter: 28%, tabular grains diameter/thickness ratio: 6.0) | 1.50 |
| Gelatin | 1.20 |
| ExS-1 | $2.0 \times 10^{-4}$ |
| ExS-2 | $6.0 \times 10^{-5}$ |
| ExS-3 | $2.0 \times 10^{-5}$ |
| ExC-2 | $8.5 \times 10^{-2}$ |
| ExC-5 | $7.3 \times 10^{-2}$ |
| ExC-6 | $1.0 \times 10^{-2}$ |
| Solv-1 | 0.12 |
| Solv-2 | 0.12 |
| **Sixth layer: intermediate layer** | |
| Gelatin | 1.00 |
| Cpd-4 | $8.0 \times 10^{-2}$ |
| Solv-1 | $8.0 \times 10^{-2}$ |
| **Seventh layer: first green-sensitive layer** | |
| Silver iodobromide emulsion (AgI: 5.0 mole %, higher AgI content on surface of grains, circle-corresponding diameter: 0.9 μm, fluctuation coefficient of circle-corresponding diameter: 21%, tabular grains, diameter/thickness ratio: 7.5) | 0.28 |
| Silver iodobromide emulsion (AgI: 4.0 mole %, higher AgI content in inside portion of grains, circle-corresponding diameter: 0.4 μm, fluctuation coefficient of circle-corresponding diameter: 18%, tetra-decahedron grains) | 0.16 |
| Gelatin | 1.20 |
| ExS-4 | $5.0 \times 10^{-4}$ |
| ExS-5 | $2.0 \times 10^{-4}$ |
| ExS-6 | $1.0 \times 10^{-4}$ |
| ExM-1 | 0.50 |
| ExM-2 | 0.10 |
| ExM-5 | $3.5 \times 10^{-2}$ |
| Solv-1 | 0.20 |
| Cpd-16 | $3.0 \times 10^{-2}$ |
| **Eighth layer: second green-sensitive layer** | |
| Silver iodobromide emulsion (AgI: 8.5 mole %, higher AgI content in inside portion of grains, circle-corresponding diameter: 1.0 μm, fluctuation coefficient of circle-corresponding diameter: 25%, tabular grains, diameter/thickness ratio: 3.0) | 0.57 |
| Gelatin | 0.45 |
| ExS-4 | $3.5 \times 10^{-4}$ |
| ExS-5 | $1.4 \times 10^{-4}$ |
| ExS-6 | $7.0 \times 10^{-5}$ |
| ExM-1 | 0.12 |
| ExM-2 | $7.1 \times 10^{-3}$ |
| ExM-3 | $3.5 \times 10^{-2}$ |
| Solv-1 | 0.15 |
| Cpd-16 | $1.0 \times 10^{-2}$ |
| **Ninth layer: intermediate layer** | |
| Gelatin | 0.50 |
| Solv-1 | $2.0 \times 10^{-2}$ |
| **Tenth layer: third green-sensitive layer** | |
| Silver iodobromide emulsion (AgI: 11.3 mole %, higher AgI content in inside portion of | 1.30 |

-continued

| | |
|---|---|
| grains, circle-corresponding diameter: 1.4 μm, fluctuation coefficient of circle-corresponding diameter: 28%, tabular grains, diameter/thickness ratio: 6.0) | |
| Gelatin | 1.20 |
| ExS-4 | $2.0 \times 10^{-4}$ |
| ExS-5 | $8.0 \times 10^{-5}$ |
| ExS-6 | $8.0 \times 10^{-5}$ |
| ExM-4 | $5.8 \times 10^{-2}$ |
| ExM-6 | $5.0 \times 10^{-3}$ |
| ExC-2 | $4.5 \times 10^{-3}$ |
| Cpd-5 | $1.0 \times 10^{-2}$ |
| Solv-1 | 0.25 |
| Eleventh layer: yellow filter layer | |
| Gelatin | 0.50 |
| Cpd-6 | $5.2 \times 10^{-2}$ |
| Solv-1 | 0.12 |
| Twelfth layer: intermediate layer | |
| Gelatin | 0.45 |
| Cpd-3 | 0.10 |
| Thirteenth layer: first blue-sensitive layer | |
| Silver iodobromide emulsion (AgI: 2 mole %, uniform AgI content, circle-corresponding diameter: 0.55 μm, fluctuation coefficient of circle-corresponding diameter: 25%, tabular grains, diameter/thickness ratio: 7.0) | 0.20 |
| Gelatin | 1.00 |
| ExS-7 | $3.0 \times 10^{-4}$ |
| ExY-1 | 0.60 |
| ExY-2 | $2.3 \times 10^{-2}$ |
| Solv-1 | 0.15 |
| Fourteenth layer: second blue-sensitive layer | |
| Silver iodobromide emulsion (AgI: 19.0 mole %, higher AgI content in inside portion of grains, circle-corresponding diameter: 1.0 μm, fluctuation coefficient of circle-corresponding diameter: 16%, octahedron grains) | 0.19 |
| Gelatin | 0.35 |
| ExS-7 | $2.0 \times 10^{-4}$ |
| ExY-1 | 0.22 |
| Solv-1 | $7.0 \times 10^{-2}$ |
| Fifteenth layer: intermediate layer | |
| Silver iodobromide fine grain emulsion (AgI: 2 mole %, uniform AgI content, circle-corresponding diameter: 0.13 μm) | 0.20 |
| Gelatin | 0.36 |
| Sixteenth layer: third blue-sensitive layer | |
| Silver iodobromide emulsion (AgI: 14.0 mole %, higher AgI content in inside portion of grains, circle-corresponding diameter: 1.7 μm, fluctuation coefficient of circle-corresponding diameter: 28%, tabular grains, diameter/thickness ratio: 5.0) | 1.55 |
| Gelatin | 1.00 |
| ExS-8 | $1.5 \times 10^{-4}$ |
| ExY-1 | 0.21 |
| Solv-1 | $7.0 \times 10^{-2}$ |
| Seventeenth layer: first protective layer | |
| Gelatin | 1.80 |
| UV-1 | 0.13 |
| UV-2 | 0.21 |
| Solv-1 | $1.0 \times 10^{-2}$ |
| Solv-2 | $1.0 \times 10^{-2}$ |
| Eighteenth layer: second protective layer | |
| Silver chloride fine grains (circle-corresponding diameter: 0.07 μm) | 0.36 |
| Gelatin | 0.70 |

-continued

| | |
|---|---|
| B-1 (diameter: 1.5 μm) | $2.0 \times 10^{-2}$ |
| B-2 (diameter: 1.5 μm) | 0.15 |
| B-3 | $3.0 \times 10^{-2}$ |
| W-1 | $2.0 \times 10^{-2}$ |
| H-1 | 0.35 |
| Cpd-7 | 1.00 |

To the sample thus prepared was added 1,2-benzoisothiazoline-3-one (average 200 ppm to gelatin), n-butyl-p-hydroxybenzoate (about 1,000 ppm to gelatin), and 2-phenoxyethanol (about 10,000 ppm to gelatin). Furthermore, to the sample thus prepared were added B-4, B-5, W-2, W-3, F-i, F-2, F-3, F-4, F-5, F-6, F-7, F-8, F-9, F-10, F-11, F-12, F-13, iron salts, lead salts, gold salts, platinum salts, iridium salts, and rhodium salts.

Preparation of Sample 602

The respective layers having the following compositions were provided on a cellulose triacetate film support having thereon a subbing layer to prepare a multilayered color light-sensitive material Sample No. 602.

| | |
|---|---|
| First layer: anti-halation layer | |
| Black colloidal silver | 0.15 |
| Gelatin | 1.90 |
| ExM-6 | $5.0 \times 10^{-3}$ |
| Second layer: intermediate layer | |
| Gelatin | 2.10 |
| UV-3 | $3.0 \times 10^{-2}$ |
| UV-4 | $6.0 \times 10^{-2}$ |
| UV-5 | $7.0 \times 10^{-2}$ |
| ExF-1 | $4.0 \times 10^{-3}$ |
| Solv-2 | $7.0 \times 10^{-2}$ |
| Third layer: low speed red-sensitive layer | |
| Silver iodobromide emulsion (AgI: 2 mole %, higher AgI content in inside portion of grains, circle-corresponding diameter: 0.3 μm, fluctuation coefficient of circle-corresponding diameter: 29%, mixture of regular grains and tabular grains, diameter/thickness ratio: 2.5) | 0.50 |
| Gelatin | 1.50 |
| ExS-2 | $1.0 \times 10^{-4}$ |
| ExS-1 | $3.0 \times 10^{-4}$ |
| ExS-3 | $1.0 \times 10^{-5}$ |
| ExC-8 | 0.11 |
| ExC-1 | 0.11 |
| ExC-9 | $3.0 \times 10^{-2}$ |
| ExC-6 | $1.0 \times 10^{-2}$ |
| Solv-1 | $7.0 \times 10^{-3}$ |
| Fourth layer: medium speed red-sensitive layer | |
| Silver iodobromide emulsion (AgI: 4 mole %, higher AgI content in inside portion of grains, circle-corresponding diameter: 0.55 μm, fluctuation coefficient of circle-corresponding diameter: 20%, mixture of regular grains and tabular grains, diameter/thickness ratio: 1.0) | 0.85 |
| Gelatin | 2.00 |
| ExS-2 | $1.0 \times 10^{-4}$ |
| ExS-1 | $3.0 \times 10^{-4}$ |
| ExS-3 | $1.0 \times 10^{-5}$ |
| ExC-8 | 0.16 |
| ExC-4 | $8.0 \times 10^{-2}$ |
| ExC-1 | 0.17 |
| ExC-6 | $1.5 \times 10^{-2}$ |
| ExY-3 | $2.0 \times 10^{-2}$ |
| ExY-4 | $1.0 \times 10^{-2}$ |
| F-3 | $1.0 \times 10^{-4}$ |
| Solv-1 | 0.10 |

-continued

| | |
|---|---|
| **Fifth layer: high speed red-sensitive layer** | |
| Silver iodobromide emulsion (AgI: 10 mole %, higher AgI content in inside portion of grains, circle-corresponding diameter: 0.7 μm, fluctuation coefficient of circle corresponding diameter: 30%, mixture of regular grains and tabular grains, diameter/thickness ratio: 2.0) | 0.70 |
| Gelatin | 1.60 |
| ExS-2 | $1.0 \times 10^{-4}$ |
| ExS-1 | $3.0 \times 10^{-4}$ |
| ExS-3 | $1.0 \times 10^{-5}$ |
| ExC-10 | $7.0 \times 10^{-2}$ |
| ExC-11 | $8.0 \times 10^{-2}$ |
| ExC-6 | $1.5 \times 10^{-2}$ |
| Solv-1 | 0.15 |
| Solv-2 | $8.0 \times 10^{-2}$ |
| **Sixth layer: intermediate layer** | |
| Gelatin | 1.10 |
| P-2 | 0.17 |
| Cpd-4 | 0.10 |
| Cpd-9 | 0.17 |
| Solv-1 | $5.0 \times 10^{-2}$ |
| **Seventh layer: low speed green-sensitive layer** | |
| Silver iodobromide emulsion (AgI: 2 mole %, higher AgI content in inside portion of grains, circle-corresponding diameter: 0.3 μm, fluctuation coefficient of circle-corresponding diameter: 28%, mixture of regular grains and tabular grains, diameter/thickness ratio: 2.5) | 0.30 |
| Gelatin | 0.50 |
| ExS-9 | $5.0 \times 10^{-4}$ |
| ExS-5 | $2.0 \times 10^{-4}$ |
| ExS-6 | $0.3 \times 10^{-4}$ |
| ExM-6 | $3.0 \times 10^{-2}$ |
| ExM-1 | 0.20 |
| ExY-3 | $3.0 \times 10^{-2}$ |
| Cpd-16 | $7.0 \times 10^{-3}$ |
| Solv-1 | 0.20 |
| **Eighth layer: medium speed green-sensitive layer** | |
| Silver iodobromide emulsion (AgI: 4 mole %, higher AgI content in inside portion of grains, circle-corresponding diameter: 0.55 μm, fluctuation coefficient of circle-corresponding diameter: 20%, mixture of regular grains and tabular grains, diameter/thickness ratio: 4.0) | 0.70 |
| Gelatin | 1.00 |
| ExS-9 | $5.0 \times 10^{-4}$ |
| ExS-5 | $2.0 \times 10^{-4}$ |
| ExS-6 | $3.0 \times 10^{-5}$ |
| ExM-6 | $3.0 \times 10^{-2}$ |
| ExM-1 | 0.25 |
| ExM-3 | $1.5 \times 10^{-2}$ |
| ExY-3 | $4.0 \times 10^{-2}$ |
| Cpd-16 | $9.0 \times 10^{-3}$ |
| Solv-1 | 0.20 |
| **Ninth layer: high speed green-sensitive layer** | |
| Silver iodobromide emulsion (AgI: 10 mole %, higher AgI content in inside portion of grains, circle-corresponding diameter: 0.7 μm, fluctuation coefficient of circle-corresponding diameter: 30%, mixture of regular grains and tabular grains, diameter/thickness ratio: 2.0) | 0.50 |
| Gelatin | 0.90 |
| ExS-9 | $2.0 \times 10^{-4}$ |
| ExS-5 | $2.0 \times 10^{-4}$ |

-continued

| | |
|---|---|
| ExS-6 | $2.0 \times 10^{-5}$ |
| ExS-10 | $3.0 \times 10^{-4}$ |
| ExM-6 | $1.0 \times 10^{-2}$ |
| ExM-7 | $3.9 \times 10^{-2}$ |
| ExM-4 | $2.6 \times 10^{-2}$ |
| Cpd-5 | $1.0 \times 10^{-2}$ |
| Cpd-14 | $2.0 \times 10^{-4}$ |
| F-3 | $2.0 \times 10^{-4}$ |
| Solv-1 | 0.20 |
| Solv-2 | $5.0 \times 10^{-2}$ |
| **Tenth layer: yellow filter layer** | |
| Gelatin | 0.90 |
| Yellow colloid | $5.0 \times 10^{-2}$ |
| Cpd-4 | 0.20 |
| Solv-1 | 0.15 |
| **Eleventh layer: a low speed blue-sensitive layer** | |
| Silver iodobromide emulsion (AgI: 4 mole %, higher AgI content in inside portion of grains, circle-corresponding diameter: 0.5 μm, fluctuation coefficient of circle-corresponding diameter: 15%, octahedral grains) | 0.40 |
| Gelatin | 1.00 |
| ExS-11 | $2.0 \times 10^{-4}$ |
| ExY-3 | $9.0 \times 10^{-2}$ |
| ExY-1 | 0.90 |
| Cpd-5 | $1.0 \times 10^{-2}$ |
| Solv-1 | 0.30 |
| **Twelfth layer: high speed blue-sensitive layer** | |
| Silver iodobromide emulsion (AgI: 10 mole %, higher AgI content in inside portion of grains, circle-corresponding diameter: 1.3 μm, fluctuation coefficient of circle-corresponding diameter: 25%, mixture of regular grains and tabular grains, diameter/thickness ratio: 4.5) | 0.50 |
| Gelatin | 0.60 |
| ExS-11 | $1.0 \times 10^{-4}$ |
| ExY-1 | 0.12 |
| Cpd-5 | $1.0 \times 10^{-3}$ |
| Solv-1 | $4.0 \times 10^{-2}$ |
| **Thirteenth layer: first protective layer** | |
| Silver iodobromide fine grains (average grain size: 0.07 μm, AgI content: 1 mole %) | 0.20 |
| Gelatin | 0.80 |
| UV-4 | 0.10 |
| UV-5 | 0.10 |
| UV-2 | 0.20 |
| Solv-3 | $4.0 \times 10^{-2}$ |
| P-2 | $9.0 \times 10^{-2}$ |
| **Fourteenth layer: second protective layer** | |
| Gelatin | 0.90 |
| B-1 (diameter: 1.5 μm) | 0.10 |
| B-2 (diameter: 1.5 μm) | 0.10 |
| B-3 | $2.0 \times 10^{-2}$ |
| H-1 | 0.40 |

Furthermore, in order to improve preservability, processability, pressure resistance, anti-mold and anti-fungus, anti-static and coating properties, to the sample thus prepared were added the following Cpd-8, Cpd-10, Cpd-11, Cpd-12, Cpd-13, P-1, W-2, W-4, and W-5.

In addition to the above compounds, n-butyl-p-hydroxybenzoate was added. Furthermore, to the sample were added therein, B-4, F-1, F-4, F-5, F-6, F-7, F-9, F-10, F-11, F-13, iron salts, lead salts gold salts, platinum salts, iridium salts, and rhodium salts.

Preparation of Sample 603

The layers having the following compositions were provided on a cellulose triacetate film support having thereon a subbing layer to prepare a multilayered color light-sensitive material Sample No. 603.

| | |
|---|---|
| First layer: anti-halation layer | |
| Black colloidal silver | 0.15 |
| Gelatin | 2.33 |
| ExM-4 | 0.11 |
| UV-3 | $3.0 \times 10^2$ |
| UV-4 | $6.0 \times 10^2$ |
| UV-5 | $7.0 \times 10^2$ |
| Solv-1 | 0.16 |
| Solv-2 | 0.10 |
| ExF-2 | $1.0 \times 10^2$ |
| ExF-3 | $4.0 \times 10^2$ |
| ExF-1 | $5.0 \times 10^3$ |
| Cpd-12 | $1.0 \times 10^3$ |
| Second layer: low speed red-sensitive layer | |
| Silver iodobromide emulsion (AgI: 4.0 mole %, uniform AgI content, circle-corresponding diameter: 0.4 μm, fluctuation coefficient of circle-corresponding diameter: 30%, tabular grains, diameter/thickness ratio: 3.0) | 0.35 |
| Silver iodobromide emulsion (AgI: 6.0 mole %, higher AgI content in inside portion of grains with core/shell ratio of 1:2, circle-corresponding diameter: 0.45 μm, fluctuation coefficient of circle-corresponding diameter: 23%, tabular grains, diameter/thickness ratio: 2.0) | 0.18 |
| Gelatin | 0.77 |
| ExS-2 | $2.4 \times 10^4$ |
| ExS-1 | $1.4 \times 10^4$ |
| ExS-6 | $2.3 \times 10^4$ |
| ExS-3 | $4.1 \times 10^6$ |
| ExC-1 | 0.09 |
| ExC-9 | $4.0 \times 10^2$ |
| ExC-12 | $8.0 \times 10^2$ |
| ExC-8 | 0.08 |
| Third layer: medium speed red-sensitive layer | |
| Silver iodobromide emulsion (AgI: 6.0 mole %, higher AgI content in inside portion of grains with core/shell ratio of 12, circle-corresponding diameter: 0.65 μm, fluctuation coefficient of circle-corresponding diameter: 23%, tabular grains, diameter/thickness ratio: 2.0) | 0.80 |
| Gelatin | 1.46 |
| ExS-2 | $2.4 \times 10^4$ |
| ExS-1 | $1.4 \times 10^4$ |
| ExS-6 | $2.4 \times 10^4$ |
| ExS-3 | $4.3 \times 10^6$ |
| ExC-1 | 0.19 |
| ExC-9 | $2.0 \times 10^2$ |
| ExC-12 | 0.10 |
| ExC-8 | 0.19 |
| ExC-6 | $2.0 \times 10^2$ |
| ExM-5 | $2.0 \times 10^2$ |
| UV-4 | $5.7 \times 10^2$ |
| UV-5 | $5.7 \times 10^2$ |
| Fourth layer: high speed red-sensitive layer | |
| Silver iodobromide emulsion (AgI: 19.3 mole %, multi layered grains with core/shell ratio of 3:4:2, AgI content of 24, 0 and 6 mole % from inside, respectively, circle-corresponding diameter: 0.75 μm, fluctuation coefficient of circle-corresponding diameter: 23%, tabular grains, diameter/thickness ratio: 2.5) | 1.49 |
| Gelatin | 1.38 |
| ExS-2 | $2.0 \times 10^4$ |
| ExS-1 | $1.1 \times 10^4$ |
| ExS-6 | $1.9 \times 10^4$ |
| ExS-3 | $1.4 \times 10^5$ |
| ExC-1 | $8.0 \times 10^2$ |
| ExC-11 | $9.0 \times 10^2$ |
| ExC-6 | $2.0 \times 10^2$ |
| Solv-1 | 0.20 |
| Solv-2 | 0.53 |
| Fifth layer: intermediate layer | |
| Gelatin | 0.62 |
| Cpd-4 | 0.13 |
| Polyethyl acrylate latex | $8.0 \times 10^2$ |
| Solv-1 | $8.0 \times 10^2$ |
| Sixth layer: low speed green-sensitive layer | |
| Silver iodobromide emulsion (AgI: 4.0 mole %, uniform AgI content, circle-corresponding diameter: 0.33 μm, fluctuation coefficient of circle-corresponding diameter: 37%, tabular grains, diameter/thickness ratio: 2.0) | 0.19 |
| Gelatin | 0.44 |
| ExS-16 | $1.5 \times 10^4$ |
| ExS-4 | $4.4 \times 10^4$ |
| ExS-6 | $9.2 \times 10^5$ |
| ExM-1 | 0.17 |
| ExM-5 | $3.0 \times 10^2$ |
| Solv-1 | 0.13 |
| Cpd-16 | $1.0 \times 10^2$ |
| Seventh layer: medium speed green-sensitive layer | |
| Silver iodobromide emulsion (AgI: 4.0 mole %, uniform AgI content, circle-corresponding diameter: 0.55 μm, fluctuation coefficient of circle-corresponding diameter: 15%, tabular grains, diameter/thickness ratio: 4.0) | 0.24 |
| Gelatin | 0.54 |
| ExS-16 | $2.1 \times 10^4$ |
| ExS-4 | $6.3 \times 10$-: |
| ExS-6 | $1.3 \times 10^4$ |
| ExM-1 | 0.15 |
| ExM-5 | $4.0 \times 10^2$ |
| ExY-4 | $3.0 \times 10^2$ |
| Solv-1 | 0.13 |
| Cpd-16 | $1.0 \times 10^2$ |
| Eighth layer: high speed green-sensitive layer | |
| Silver iodobromide emulsion (AgI: 8.8 mole %, multi-layered grains with core/shell ratio of 3:4:2, AgI content of 24, 0 and 3 mole% from inside, respectively, circle-corresponding diameter: 0.75 μm, fluctuation coefficient of circle-corresponding diameter: 23%, tabular grains, diameter/thickness ratio: 1.6) | 0.49 |
| Gelatin | 0.61 |
| ExS-4 | $4.3 \times 10^4$ |
| ExS-6 | $8.6 \times 10^5$ |
| ExS-5 | $2.8 \times 10^5$ |
| ExM-1 | $8.0 \times 10^2$ |
| ExM-6 | $3.0 \times 10^2$ |
| ExY-4 | $3.0 \times 10^2$ |
| ExC-1 | $1.0 \times 10^2$ |
| ExC-11 | $1.0 \times 10^2$ |
| Solv-1 | 0.23 |
| Solv-2 | $5.0 \times 10^2$ |
| Cpd-16 | $1.0 \times 10^2$ |
| Cpd-5 | $1.0 \times 10^2$ |
| Ninth layer: an intermediate layer | |
| Gelatin | 0.56 |
| Cpd-4 | $4.0 \times 10^2$ |
| Polyethyl acrylate latex | $5.0 \times 10^2$ |
| Solv-1 | $3.0 \times 10^2$ |

-continued

| | |
|---|---|
| UV-1 | $3.0 \times 10^2$ |
| UV-2 | $4.0 \times 10^2$ |
| Tenth layer: Donor layer with a superposing effect to the red-sensitive layer | |
| Silver iodobromide emulsion (AgI: 8.0 mole %, higher AgI content in inside portion of grains with core/shell ratio of 1:2, circle-corresponding diameter: 0.65 μm, fluctuation coefficient of circle-corresponding diameter: 25%, tabular grains, diameter/thickness ratio: 2.0) | 0.67 |
| Silver iodobromide emulsion (AgI: 4.0 mole %, uniform AgI content, circle-corresponding diameter: 0.4 μm, fluctuation coefficient of circle-corresponding diameter: 30%, tabular grains, diameter/thickness ratio: 3.0) | 0.20 |
| Gelatin | 0.87 |
| ExS-16 | $6.7 \times 10^4$ |
| ExM-2 | 0.16 |
| Solv-1 | 0.30 |
| Solv-5 | $3.0 \times 10^2$ |
| Eleventh layer: yellow filter layer | |
| Yellow colloidal silver | $9.0 \times 10^2$ |
| Gelatin | 0.84 |
| Cpd-15 | 0.13 |
| Solv-1 | 0.13 |
| Cpd-4 | $8.0 \times 10^2$ |
| Cpd-12 | $2.0 \times 10^3$ |
| H-1 | 0.25 |
| Twelfth layer: low speed blue-sensitive layer | |
| Silver iodobromide emulsion (AgI: 4.5 mole %, uniform AgI content, circle-corresponding diameter: 0.7 μm, fluctuation coefficient of circle-corresponding diameter: 15%, tabular grains, diameter/thickness ratio: 7.0) | 0.50 |
| Silver iodobromide emulsion (AgI: 3.0 mole %, uniform AgI content, circle-corresponding diameter: 0.3 μm, fluctuation coefficient of circle-corresponding diameter: 30%, tabular grains, diameter/thickness ratio: 7.0) | 0.30 |
| Gelatin | 2.18 |
| ExS-7 | $9.0 \times 10^4$ |
| ExC-1 | 0.14 |
| ExY-3 | 0.17 |
| ExY-1 | 1.0 |
| Solv-1 | 0.54 |
| Thirteenth layer: intermediate layer | |
| Gelatin | 0.40 |
| ExY-2 | 0.19 |
| Solv-1 | 0.19 |
| Fourteenth layer: high speed blue-sensitive layer | |
| Silver iodobromide emulsion (AgI: 10.0 mole %, higher AgI content in inside portion of grains, circle-corresponding diameter: 1.0 μm, fluctuation coefficient of circle corresponding diameter: 25%, tabular grains, diameter/thickness ratio: 2.0) | 0.40 |
| Gelatin | 0.49 |
| ExS-7 | $2.6 \times 10^4$ |
| ExY-3 | $1.0 \times 10^2$ |
| ExY-1 | 0.20 |
| ExC-1 | $1.0 \times 10^2$ |
| Solv-1 | $9.0 \times 10^2$ |
| Fifteenth layer: first protective layer | |
| Silver iodobromide fine grains (AgI: 2.0 mole %, uniform AgI content, circle-corresponding diameter: 0.07 m) | 0.12 |
| Gelatin | 0.63 |
| UV-1 | 0.11 |
| UV-2 | 0.18 |
| Solv-4 | $2.0 \times 10^2$ |
| Cpd-7 | 0.10 |
| Polyethyl acrylate latex | $9.0 \times 10^2$ |
| Sixteenth layer: second protective layer | |
| Silver iodobromide emulsion fine grains (AgI: 2.0 mole %, uniform AgI content, circle-corresponding diameter: 0.07 μm) | 0.36 |
| Gelatin | 0.85 |
| B-1 (diameter: 1.5 m) | $8.0 \times 10^2$ |
| B-2 (diameter: 1.5 m) | $8.0 \times 10^2$ |
| B-3 | $2.0 \times 10^2$ |
| W-5 | $2.0 \times 10^2$ |
| H-1 | 0.18 |

To the sample thus prepared were added 1,2-benzoisothiazoline-3-one (average 200 ppm to gelatin), n-butyl-p-hydroxybenzoate (about 1,000 ppm to gelatin), and 2-phenoxyethanol (about 10,000 ppm to gelatin). Furthermore, to the sample thus prepared were added B-4, B-5, F-1, F-2, F-3, F-4, F-5, F-6, F-7, F-9, F-10, F-11, F-12, F-13, iron salts, lead salts, gold salts, platinum salts, iridium salts, and rhodium salts.

In addition to the above components, the surfactants W-2, W-6 and W-4 were added to each of the layers as a coating aid and an emulsification-dispersing agent.

Preparation of Sample 604

The layers having the following compositions were provided on a cellulose triacetate film support having thereon a subbing layer to prepare a multi-layered color light-sensitive material Sample No. 604.

| | |
|---|---|
| First layer: anti-halation layer | |
| Black colloidal silver | 0.18 |
| Gelatin | 1.40 |
| Second layer: intermediate layer | |
| 2,5-Di-t-pentadecylhydroquinone | 0.18 |
| ExM-6 | 0.18 |
| ExC-4 | 0.020 |
| ExF-1 | $2.0 \times 10^3$ |
| UV-3 | 0.060 |
| UV-4 | 0.080 |
| UV-5 | 0.10 |
| Solv-1 | 0.10 |
| Solv-2 | 0.020 |
| Gelatin | 1.04 |
| Third layer: first red-sensitive layer | |
| Emulsion A | 0.25 |
| Emulsion B | 0.25 |
| ExS-2 | $6.9 \times 10^5$ |
| ExS-3 | $1.8 \times 10^5$ |
| ExS-1 | $3.1 \times 10^4$ |
| ExC-1 | 0.17 |
| ExC-9 | 0.020 |
| ExC-8 | 0.17 |
| UV-3 | 0.070 |
| UV-4 | 0.050 |
| UV-5 | 0.070 |
| Solv-1 | 0.060 |
| Gelatin | 0.87 |
| Fourth layer: second red-sensitive layer | |
| Emulsion G | 1.00 |
| ExS-2 | $5.1 \times 10^5$ |
| ExS-3 | $1.4 \times 10^5$ |
| ExS-1 | $2.3 \times 10^4$ |
| ExC-1 | 0.20 |
| ExC-4 | 0.050 |
| ExC-9 | 0.015 |
| ExC-8 | 0.20 |

-continued

| | |
|---|---|
| UV-3 | 0.070 |
| UV-4 | 0.050 |
| UV-5 | 0.070 |
| Gelatin | 1.30 |
| Fifth layer: third red-sensitive layer | |
| Emulsion D | 1.60 |
| ExS-2 | $5.4 \times 10^5$ |
| ExS-3 | $1.4 \times 10^5$ |
| ExS-1 | $2.4 \times 10^4$ |
| ExC-1 | 0.097 |
| ExC-4 | 0.010 |
| ExC-11 | 0.080 |
| Solv-1 | 0.22 |
| Solv-2 | 0.10 |
| Gelatin | 1.63 |
| Sixth layer: intermediate layer | |
| Cpd-4 | 0.040 |
| Solv-1 | 0.020 |
| Gelatin | 0.80 |
| Seventh layer: first green-sensitive layer | |
| Emulsion A | 0.15 |
| Emulsion B | 0.15 |
| ExS-6 | $3.0 \times 10^5$ |
| ExS-5 | $1.0 \times 10^4$ |
| ExS-4 | $3.8 \times 10^4$ |
| ExM-6 | 0.021 |
| ExM-1 | 0.26 |
| ExM-3 | 0.030 |
| ExY-3 | 0.025 |
| Solv-1 | 0.10 |
| Cpd-16 | 0.010 |
| Gelatin | 0.63 |
| Eighth layer: second green sensitive layer | |
| Emulsion C | 0.45 |
| ExS-6 | $2.1 \times 10^5$ |
| ExS-5 | $7.0 \times 10^5$ |
| ExS-4 | $2.6 \times 10^4$ |
| ExM-1 | 0.094 |
| ExM-3 | 0.026 |
| ExY-3 | 0.018 |
| Solv-1 | 0.16 |
| Cpd-16 | $8.0 \times 10^3$ |
| Gelatin | 0.50 |
| Ninth layer: third green-sensitive layer | |
| Emulsion E | 1.20 |
| ExS-6 | $3.5 \times 10^5$ |
| ExS-5 | $8.0 \times 10^5$ |
| ExS-4 | $3.0 \times 10^4$ |
| ExM-6 | 0.013 |
| ExM-7 | 0.065 |
| ExM-4 | 0.019 |
| Solv-1 | 0.25 |
| Solv-2 | 0.10 |
| Gelatin | 1.54 |

-continued

| | |
|---|---|
| Tenth layer: yellow filter layer | |
| Yellow colloidal layer | 0.050 |
| Cpd-4 | 0.080 |
| Solv-1 | 0.030 |
| Gelatin | 0.95 |
| Eleventh layer: first blue sensitive layer | |
| Emulsion A | 0.080 |
| Emulsion B | 0.070 |
| Emulsion F | 0.070 |
| ExS-7 | $3.5 \times 10^4$ |
| ExY-3 | 0.042 |
| ExY-1 | 0.72 |
| Solv-1 | 0.28 |
| Gelatin | 1.10 |
| Twelfth layer: second blue-sensitive layer | |
| Emulsion G | 0.45 |
| ExS-7 | $2.1 \times 10^4$ |
| ExY-1 | 0.15 |
| ExC-9 | $7.0 \times 10^3$ |
| Solv-1 | 0.050 |
| Gelatin | 0.78 |
| Thirteenth layer: third blue-sensitive layer | |
| Emulsion H | 0.77 |
| ExS-7 | $2.2 \times 10^4$ |
| ExY-1 | 0.20 |
| Solv-1 | 0.070 |
| Gelatin | 0.69 |
| Fourteenth layer: first protective layer | |
| Emulsion I | 0.20 |
| UV-1 | 0.11 |
| UV-2 | 0.17 |
| Solv-1 | $5.0 \times 10^2$ |
| Gelatin | 1.00 |
| Fifteenth layer: second protective layer | |
| H-1 | 0.40 |
| B-1 (diameter: 1.7 m) | $5.0 \times 10^2$ |
| B-2 (diameter: 1.7 m) | 0.10 |
| B-3 | 0.10 |
| Cpd-7 | 0.20 |
| Gelatin | 1.20 |

Furthermore, in order to improve preservability, processability, pressure resistance, anti-mold and anti-fungus, anti-static and coating properties, to the sample thus prepared were added W-1, W-2, W-3, B-4, B-5, F-1, F-2, F-3, F-4, F-5, F-6, F-7, F-8, F-9, F-10, F-11, F-12, F-13, iron salts, lead salts, gold salts, platinium salts, iridium salts, and rhodium salts.

TABLE 6

| Emulsion | Average AGI content (%) | Average grain diameter (μm) | Variation coefficient with respect to grain diameter (%) | Diameter/ thickness ratio | Silver weight ratio (AgI content, %) |
|---|---|---|---|---|---|
| A | 4.0 | 0.45 | 27 | 1 | Core/shell = ⅓ (13/1) double structure grain |
| B | 8.9 | 0.70 | 14 | 1 | Core/shell = 3/7 (25/2) double structure grain |
| C | 10 | 0.75 | 30 | 2 | Core/shell = ½ (24/3) double structure grain |
| D | 16 | 1.05 | 35 | 2 | Core/shell = 4/6 (40/0) double structure grain |
| E | 10 | 1.05 | 35 | 3 | Core/shell = ½ (24/3) double structure grain |
| F | 4.0 | 0.25 | 28 | 1 | Core/shell = ⅓ (13/1) double structure grain |
| G | 14.0 | 0.75 | 25 | 2 | Core/shell = ½ (42/0) double structure grain |
| H | 14.5 | 1.30 | 25 | 3 | Core/shell = 37/63 (34/3) double structure grain |
| I | 1 | 0.07 | 15 | 1 | uniform grain |

Preparation of Sample 605

The layers having the following compositions were provided on a cellulose triacetate film support having thereon a subbing layer to prepare a multi-layered color light-sensitive material Sample No. 605.

| | |
|---|---|
| First layer: anti-halation layer | |
| Black colloidal silver | 0.24 |
| Gelatin | 2.02 |
| UV-3 | $4.4 \times 10^2$ |
| UV-4 | $8.8 \times 10^2$ |
| UV-5 | $10.0 \times 10^2$ |
| Solv-2 | 0.30 |
| Second layer: intermediate layer | |
| Gelatin | 1.51 |
| Third layer: low speed red-sensitive layer | |
| Silver iodobromide emulsion (AgI: 10 mole %, higher AgI content in inside portion of grains with core/shell ratio of 1:2, circle-corresponding diameter: 0.93 μm, fluctuation coefficient of circle-corresponding diameter: 43%, tabular grains, diameter/thickness ratio: 2.0) | 1.80 |
| Silver iodobromide emulsion (AgI: 4.0 mole %, higher AgI content in inside portion of grains with core/shell ratio of 1:2, circle-corresponding diameter: 0.45 μm, fluctuation coefficient of circle-corresponding diameter: 5%, tetradecahedron grains) | 0.75 |
| Silver iodobromide emulsion (AgI: 6 mole %, higher AgI content in inside portion of grains with core/shell ratio of 1:2, circle-corresponding diameter: 0.62 μm, fluctuation coefficient of circle-corresponding diameter: 12%, tabular grains, diameter/thickness ratio: 2.0) | 0.52 |
| Gelatin | 5.20 |
| ExS-12 | $5.16 \times 10^3$ |
| ExS-1 | $2.84 \times 10^3$ |
| ExS-3 | $3.80 \times 10^4$ |
| ExS-13 | $4.6 \times 10^4$ |
| ExC-10 | 0.84 |
| ExC-3 | $3.6 \times 10^2$ |
| ExC-4 | $5.0 \times 10^2$ |
| ExY-4 | $4.2 \times 10^2$ |
| Solv-1 | 0.38 |
| Solv-2 | 0.76 |
| Fourth layer: high speed red-sensitive layer | |
| Silver iodobromide emulsion (AgI: 10.0 mole %, higher AgI content in inside portion of grains with core/shell ratio of 1:2, circle corresponding diameter: 0.98 μm, fluctuation coefficient of circle-corresponding diameter: 43%, tabular grains, diameter/thickness ratio: 3.0) | 0.88 |
| Gelatin | 0.86 |
| ExS-12 | $0.13 \times 10^3$ |
| ExS-1 | $0.70 \times 10^3$ |
| ExS-3 | $0.92 \times 10^4$ |
| ExS-13 | $0.12 \times 10^4$ |
| ExC-10 | $2.90 \times 10^2$ |
| ExC-4 | $6.20 \times 10^2$ |
| ExC-5 | $6.60 \times 10^2$ |
| Solv-1 | 0.18 |
| Fifth layer: intermediate layer | |
| Gelatin | 0.94 |
| Cpd-5 | $3.20 \times 10^2$ |

-continued

| | |
|---|---|
| Polyethyl acrylate latex | 0.24 |
| Solv-1 | $5.0 \times 10^2$ |
| Solv-2 | $2.1 \times 10^2$ |
| Sixth layer: low speed green-sensitive layer | |
| Silver iodobromide emulsion (AgI: 6.0 mole %, higher AgI content in inside portion of grains with core/shell ratio of 1:2, circle-corresponding diameter: 0.60 μm, fluctuation coefficient of circle-corresponding diameter: 15%, tabular grains, diameter/thickness ratio: 2.0) | 0.68 |
| Silver iodobromide emulsion (AgI: 4.0 mole %, higher AgI content in inside portion of grains with core/shell ratio of 1:2, circle-corresponding diameter: 0.45 μm, fluctuation coefficient of circle-corresponding diameter: 10%, tetradecahedron grains) | 0.32 |
| Silver iodobromide emulsion (AgI: 4.0 mole %, higher AgI content in inside portion of grains with core/shell ratio of 1:2, circle-corresponding diameter: 0.52 μm, fluctuation coefficient of circle-corresponding diameter: 23%, tabular grains, diameter/thickness ratio: 2.0) | 0.23 |
| Gelatin | 1.77 |
| ExS-14 | $2.21 \times 10^3$ |
| ExS-4 | $2.19 \times 10^3$ |
| ExS-15 | $2.32 \times 10^3$ |
| ExM-8 | 0.48 |
| ExM-2 | $3.1 \times 10^2$ |
| ExM-6 | 0.15 |
| ExM-9 | $2.0 \times 10^2$ |
| ExY-4 | $3.1 \times 10^2$ |
| Solv-1 | 0.40 |
| Seventh layer: high speed green-sensitive layer | |
| Silver iodobromide emulsion (AgI: 10 mole %, higher AgI content in inside portion of grains with core/shell ratio of 1:2, circle-corresponding diameter: 0.93 μm, fluctuation coefficient of circle-corresponding diameter: 43%, tabular grains, diameter/thickness ratio: 3.0) | 0.57 |
| Silver iodobromide emulsion (AgI: 10 mole %, higher AgI content in inside portion of grains with core/shell ratio of 1:2, circle-corresponding diameter: 0.75 μm, fluctuation coefficient of circle-corresponding diameter: 33%, tabular grains, diameter/thickness ratio: 3.5) | 0.38 |
| Gelatin | 1.21 |
| ExS-14 | $1.06 \times 10^3$ |
| ExS-4 | $1.05 \times 10^3$ |
| ExS-15 | $1.11 \times 10^3$ |
| ExM-10 | $5.1 \times 10^2$ |
| ExM-11 | $0.9 \times 10^2$ |
| ExM-12 | $1.7 \times 10^2$ |
| ExM-6 | $2.4 \times 10^2$ |
| Cpd-5 | $1.4 \times 10^2$ |
| Solv-1 | 0.21 |
| Solv-2 | $3.0 \times 10^2$ |
| Eighth layer: yellow filter layer | |
| Yellow colloidal silver | 0.12 |
| Gelatin | 1.58 |
| Cpd-5 | 0.13 |
| Solv-1 | 0.21 |
| Solv-2 | $8.6 \times 10^2$ |

-continued

| | |
|---|---|
| Polyethyl acrylate latex | 0.31 |
| Ninth layer: low speed blue-sensitive layer | |
| Silver iodobromide emulsion (AgI: 10 mole %, higher AgI content in inside portion of grains with core/shell ratio of 1:2, circle-corresponding diameter: 0.98 μm, fluctuation coefficient of circle-corre sponding diameter: 43%, tabular grains, diameter/thickness ratio: 3.0) | 0.25 |
| Silver iodobromide emulsion (AgI: 4 mole %, higher AgI content in inside portion of grains with core/shell ratio of 1:2, circle-corre-sponding diameter: 0.35 μm, fluctuation coefficient of circle-corresponding diameter: 13%, tetradecahedron grains) | 0.11 |
| Silver iodobromide emulsion (AgI: 8 mole %, higher AgI content in inside portion of grains with core/shell ratio of 1:2, circle-corre-sponding diameter: fluctuation coefficient of circle-corresponding diameter: 8%, octahedral grains ) | 0.14<br>0.55 μm, |
| Gelatin | 1.77 |
| ExY-1 | 0.97 |
| ExY-2 | $6.9 \times 10^2$ |
| Cpd-5 | $1.2 \times 10^2$ |
| Solv-1 | 0.32 |
| Tenth layer: intermediate layer | |
| Gelatin | 0.56 |
| ExY-2 | 0.15 |
| Solv-1 | 0.26 |
| Eleventh layer: high speed blue-sensitive layer | |
| Silver iodobromide emulsion (AgI: 10 mole %, higher AgI content in inside portion of grains with core/shell ratio of 1:2, circle-corre-sponding diameter: 1.45 μm, fluctuation coefficient of circle-corresponding diameter: 23%, tabular grains, diameter/ thickness ratio: 3.0) | 0.87 |
| Silver iodobromide emulsion (AgI: 10 mole %, higher AgI content in inside portion of grains with core/shell ratio of 1:2, circle-corre-sponding diameter: 0.75 μm, fluctuation coefficient of circle-corresponding diameter: 23%, tabular grains, diameter/ thickness ratio: 2.5) | 0.42 |
| Gelatin | 2.05 |
| ExY-1 | 0.23 |
| Cpd-5 | $2.7 \times 10^3$ |
| Solv-1 | $7.7 \times 10^2$ |
| Polyethyl acrylate latex | 0.48 |
| Twelfth layer: intermediate layer | |
| Silver iodobromide fine grains (AgI: 1.0 mole %, uniform AgI content, circle-corresponding diameter: 0.07 μm) | 0.26 |
| Gelatin | 0.74 |
| UV-1 | 0.11 |
| UV-2 | 0.17 |
| Solv-4 | $1.9 \times 10^2$ |
| Polyethyl acrylate latex | $8.7 \times 10^2$ |
| Thirteenth layer: protective layer | |
| Gelatin | 0.47 |
| B-1 (diameter: 1.5 m) | $3.0 \times 10^2$ |
| B-2 (diameter: 1.5 m) | $3.6 \times 10^2$ |
| B-3 | $1.8 \times 10^2$ |
| W-5 | $1.8 \times 10^2$ |
| H-1 | 0.24 |

To the sample thus prepared was added 1,2-benzoisothiazoline-3-one (average 200 ppm to gelatin), n-butyl-p-hydroxybenzoate (about 1,000 ppm to gelatin), and 2-phenoxyethanol (about 10,000 ppm to gelatin). Furthermore, to the sample thus prepared were added B-4, B-5, F-i, F-2, F-3, F-4, F-5, F-6, F-7, F-8, F-9, F-10, F-11, F-12, F-13, iron salts, lead salts, gold salts, platinum salts, iridium salts, and rhodium salts.

In addition to the above components, the surfactants W-2, W-4 and W-6 were added to each of the layers as a coating aid and an emulsification-dispersing agent.

Shown below are the chemical structures of the compounds used to prepare Samples 601 to 605.

UV-1

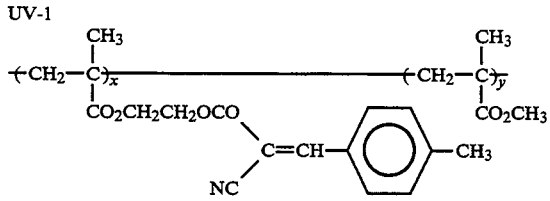

x/y = 7/3 (weight ratio)

UV-2

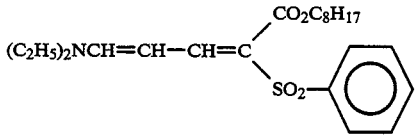

UV-3

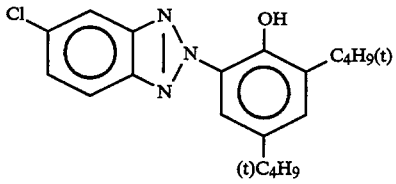

-continued
UV-4
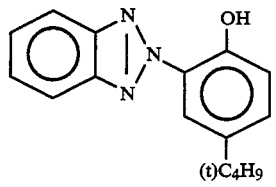
UV-5
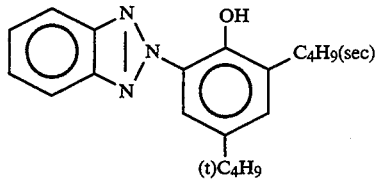
Solv-1 Tricresyl phosphate
Solv-2 Dibutyl phthalate
Solv-3 Tri(2-ethylhexyl)phosphate
Solv-4 Trihexyl phosphate
Solv-5
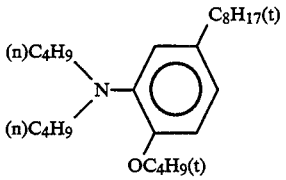
ExC-1
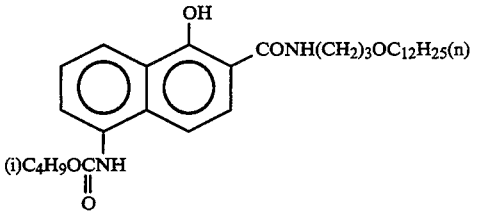
ExC-2
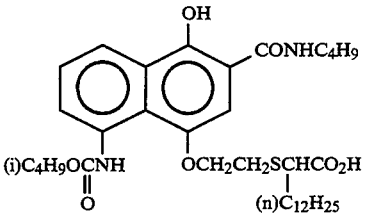
ExC-3
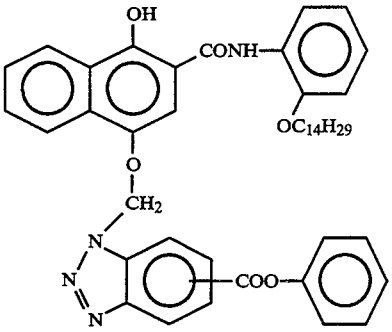
ExC-4

-continued
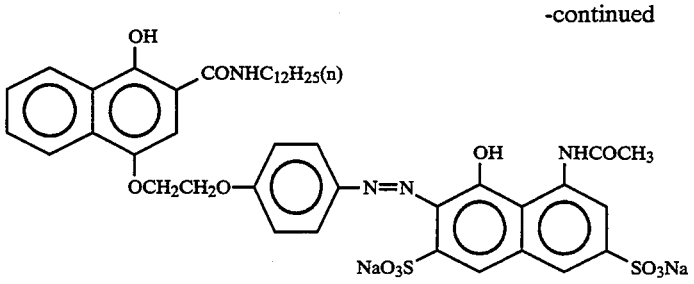
ExC-5
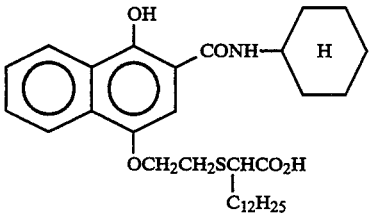
ExC-6
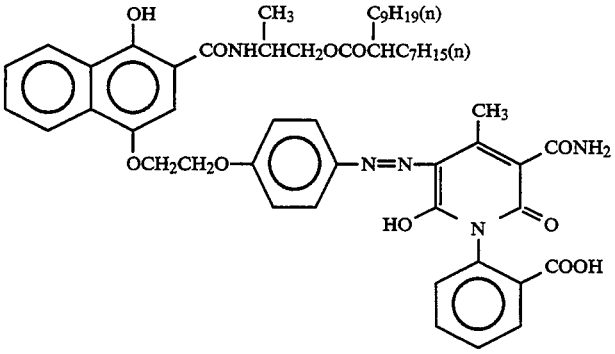
ExC-8
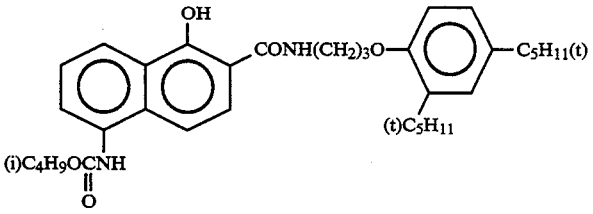
ExC-9
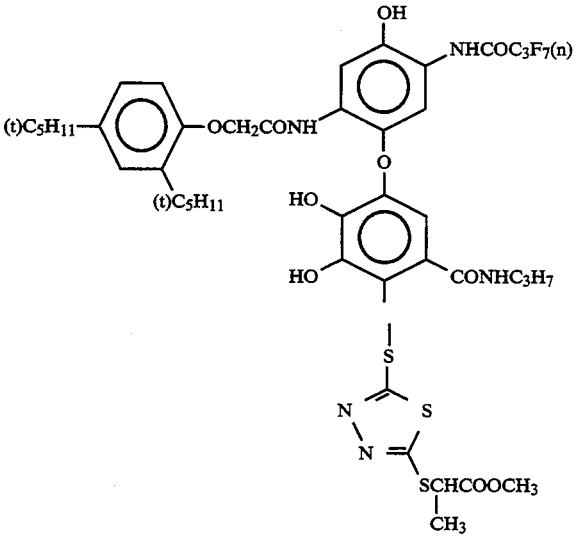

-continued
ExC-10
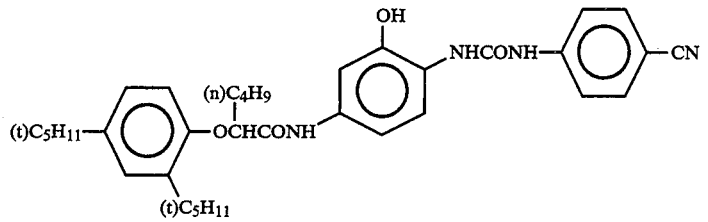
ExC-11
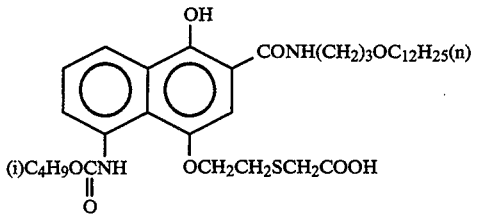
ExC-12
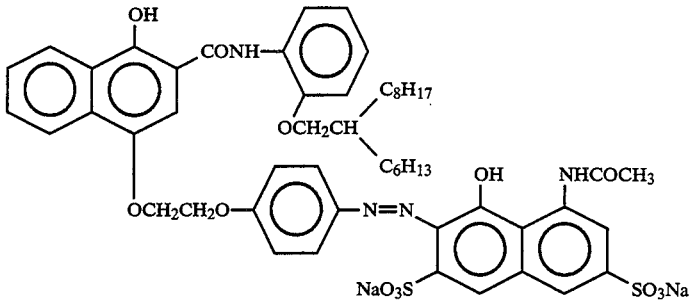
ExM-1
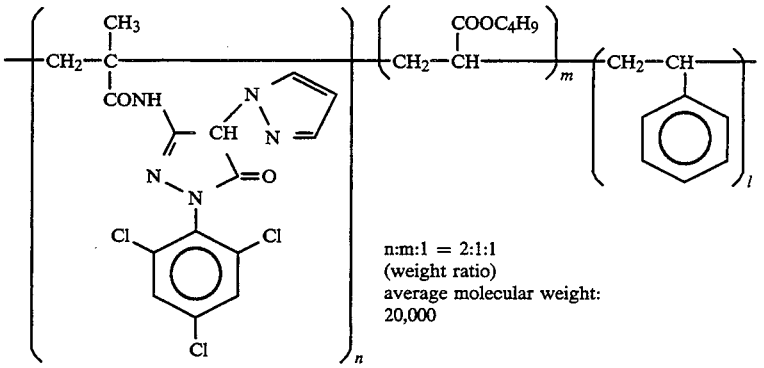
ExM-2
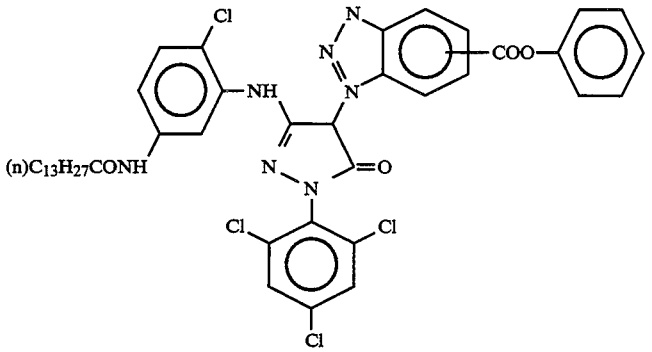
ExM-3

-continued
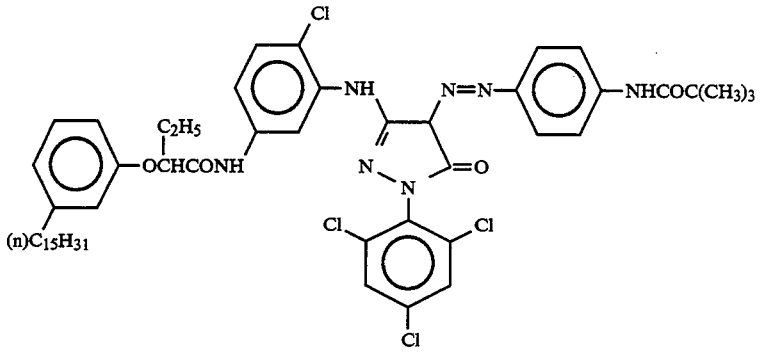
ExM-4
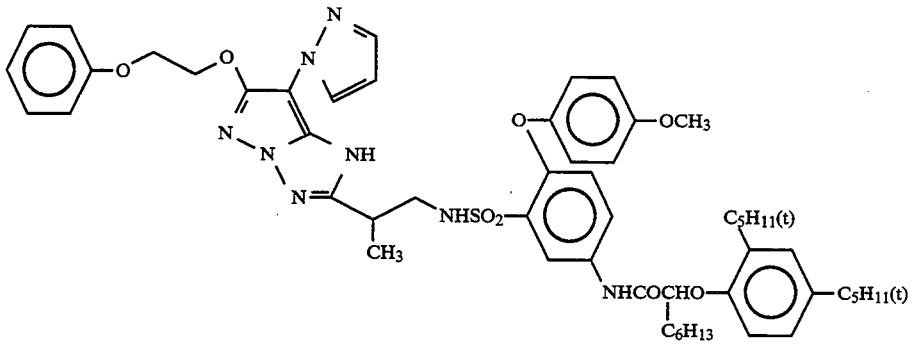
ExM-5
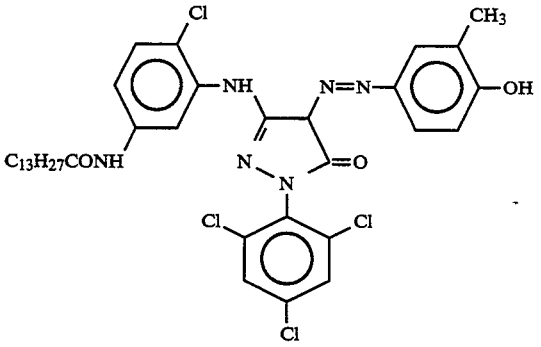
ExM-6
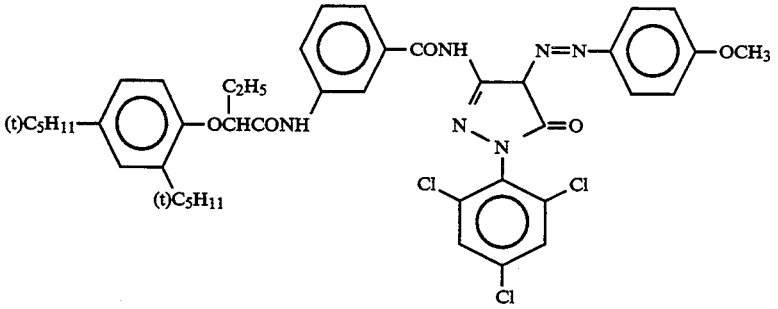
ExM-7

-continued
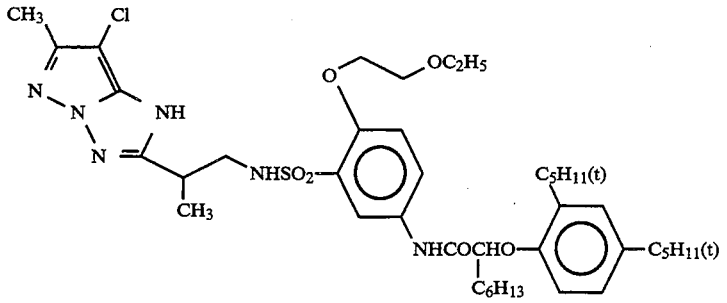
ExM-8
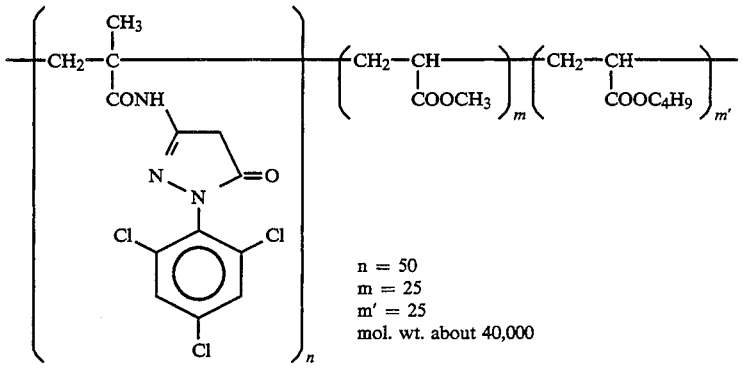
ExM-9
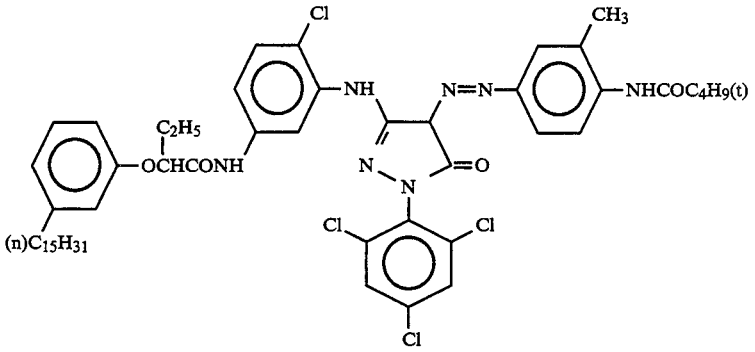
ExM-10
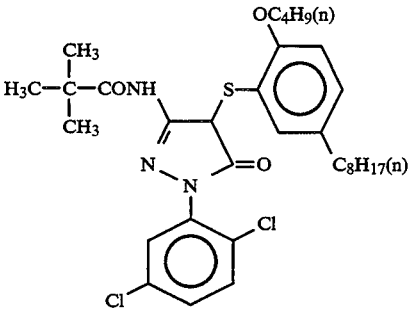
ExM-11

-continued
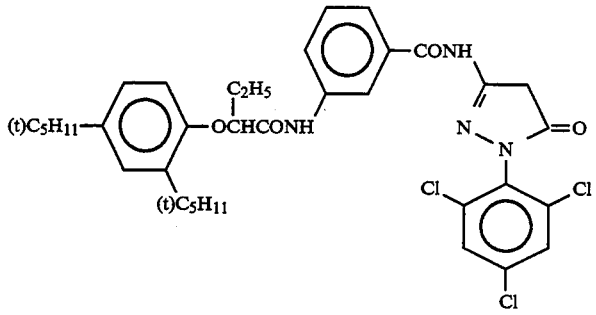
ExM-12
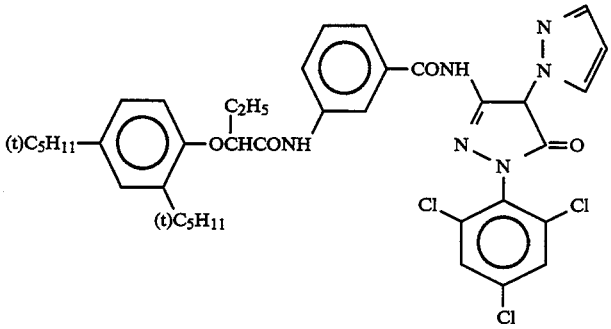
ExY-1
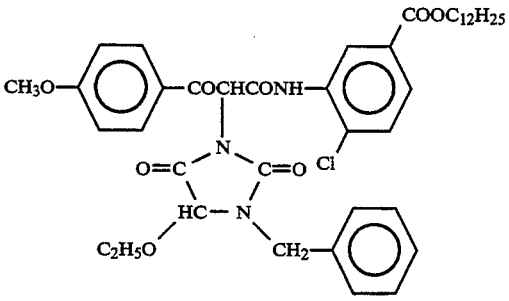
ExY-2
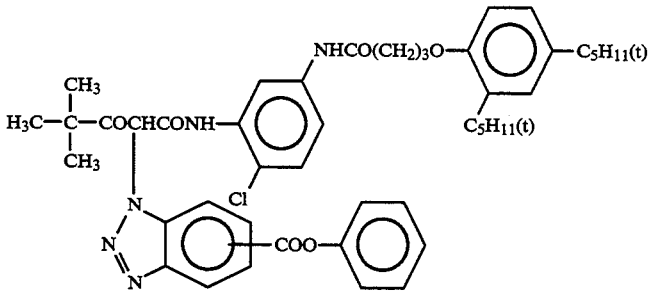
ExY-3
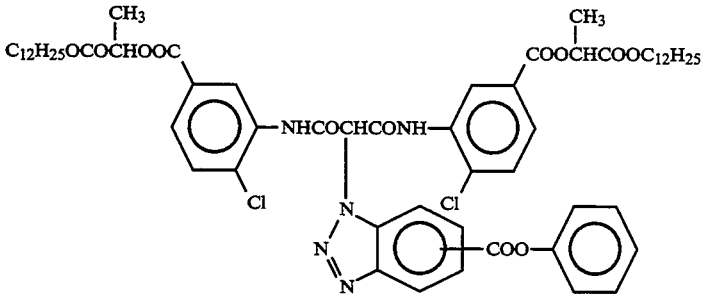
ExY-4

-continued
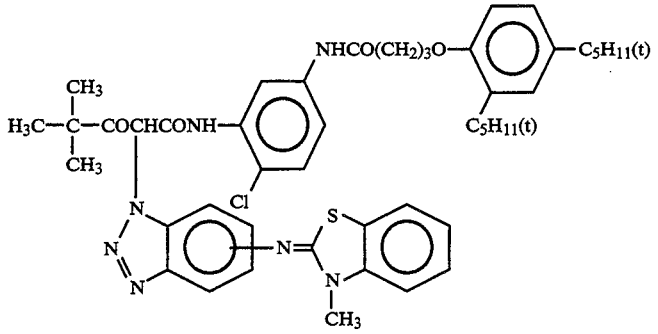
Cpd-1
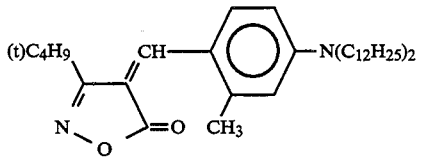
Cpd-2
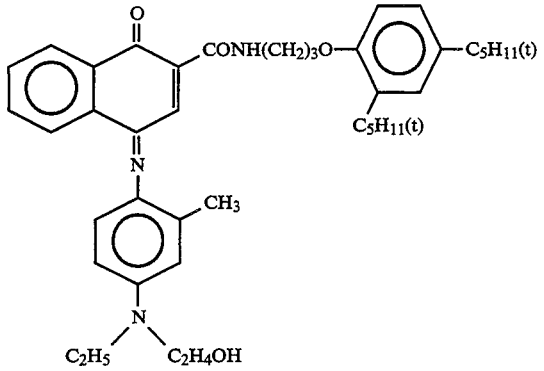
Cpd-3
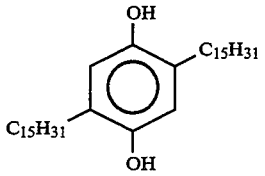
Cpd-4
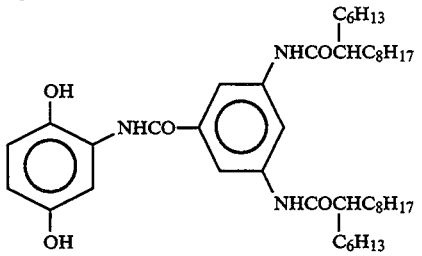
Cpd-5
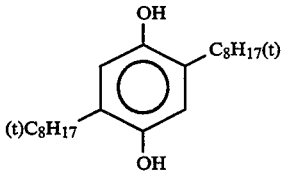
Cpd-6

-continued
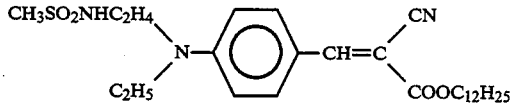
Cpd-7
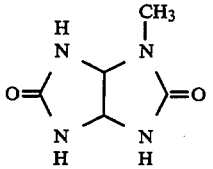
Cpd-8
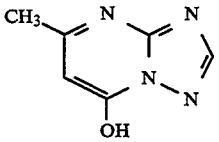
Cpd-9
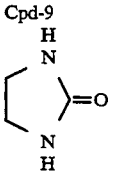
Cpd-10
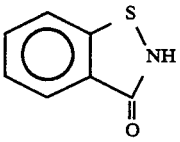
Cpd-11
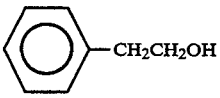
Cpd-12
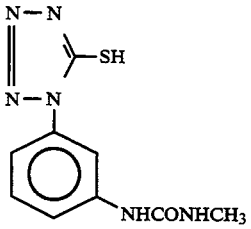
Cpd-13
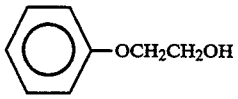
Cpd-14
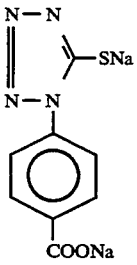

-continued
Cpd-15
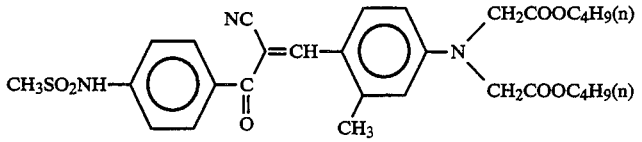
Cpd-16
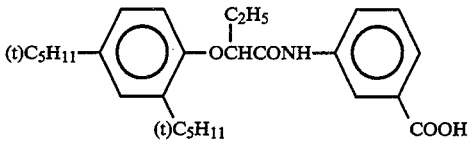
ExS-1
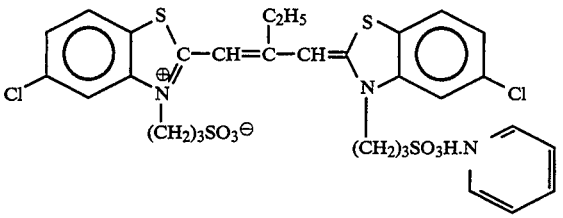
ExS-2
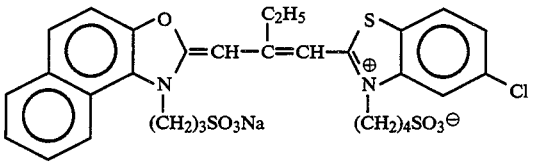
ExS-3
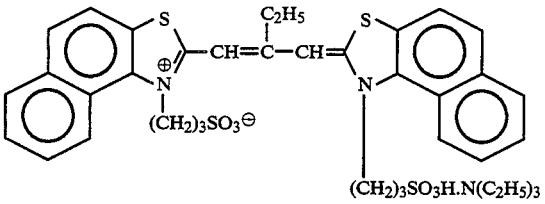
ExS-4
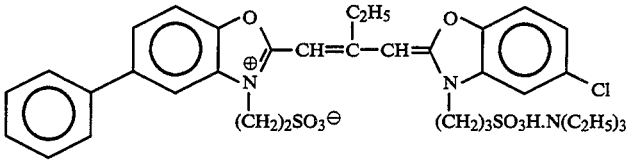
ExS-5
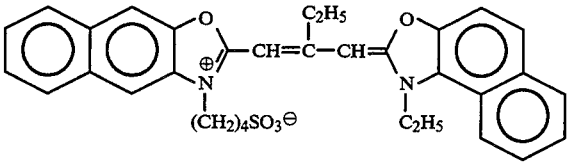
ExS-6
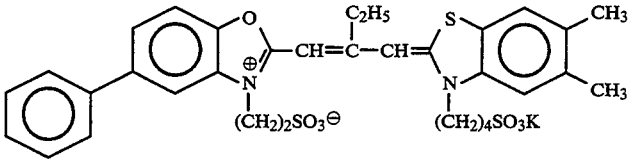

-continued
ExS-7
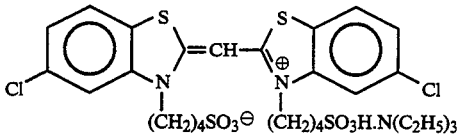
ExS-8
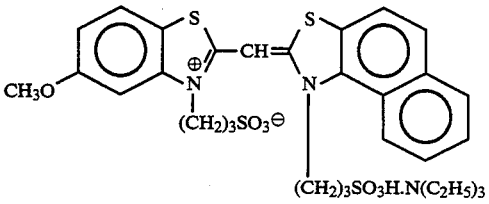
ExS-9
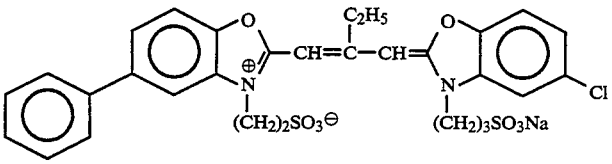
ExS-10
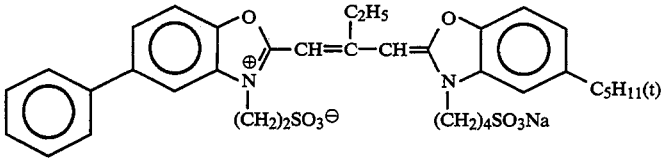
ExS-11
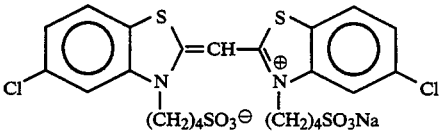
ExS-12
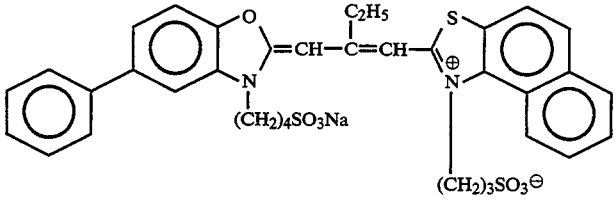
ExS-13
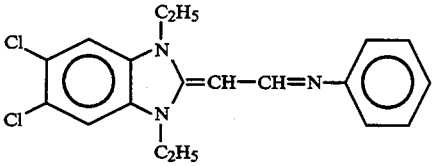
ExS-14

-continued
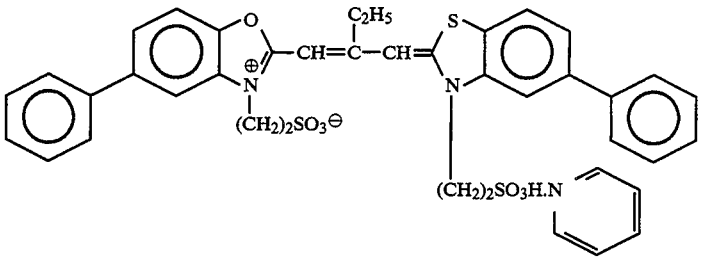
ExS-15
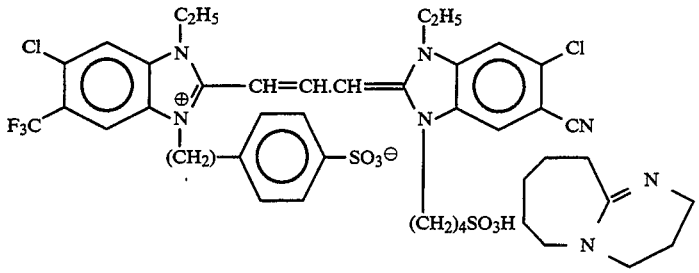
ExS-16
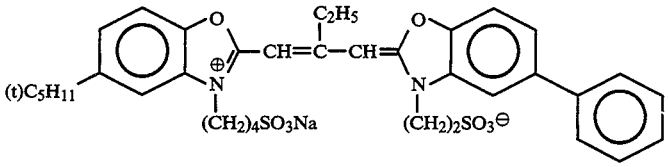
B-1
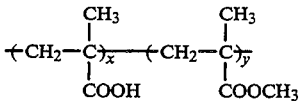
x/y = 10/90
B-2
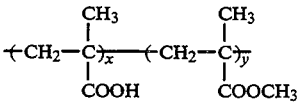
x/y = 40/60
B-3
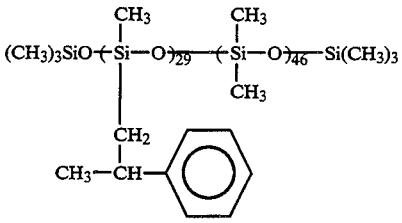
B-4
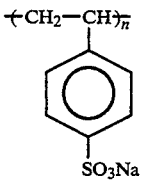
B-5
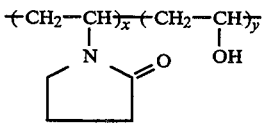
x/y = 70/30
ExF-1

-continued
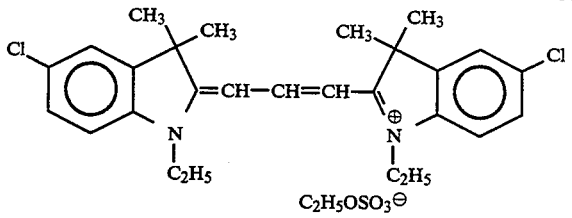
ExF-2
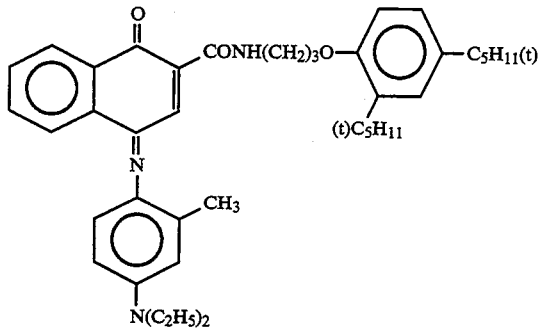
ExF-3
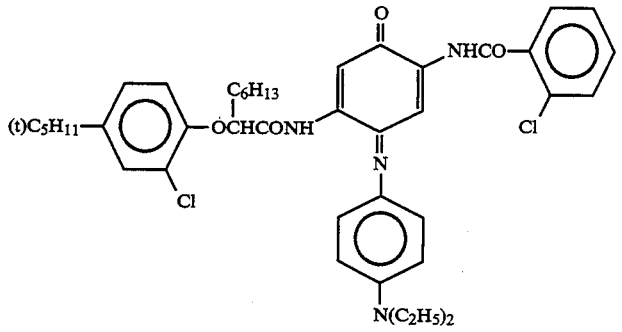
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
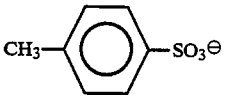
W-2
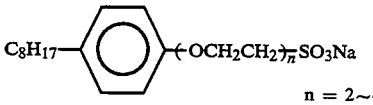
n = 2~4
W-3
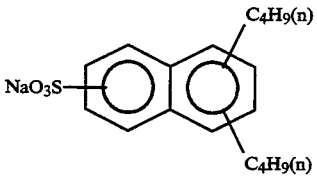
W-4

-continued
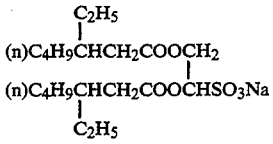
W-5
$C_8F_{17}SO_2N(C_3H_7)CH_2COOK$
W-6
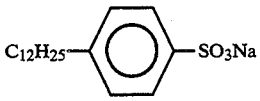
P-1 Vinyl pyrrolidone/vinyl alcohol copolymer (copolymerization ratio = 70/30 by weight)
P-2 Polyethyl acrylate
F-1
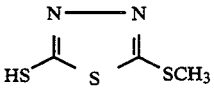
F-2
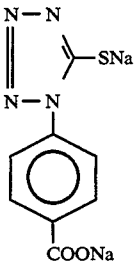
F-3
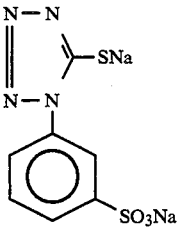
F-4
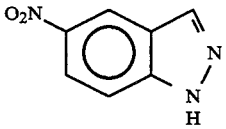
F-5
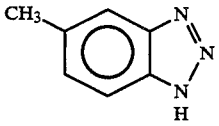
F-6
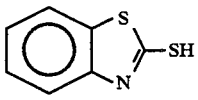
F-7

-continued

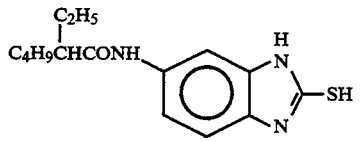

F-8

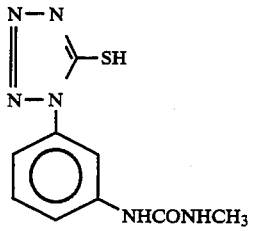

F-9

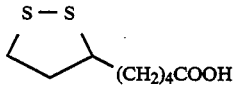

F-10

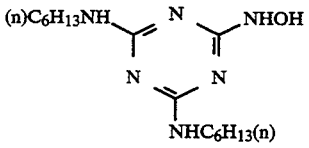

F-11

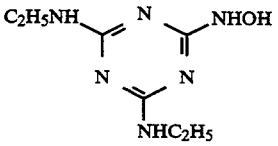

F-12

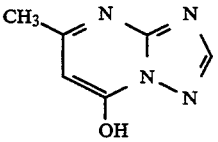

F-13

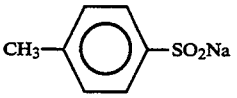

The thus prepared Samples 601 to 605 were subjected to the processing No. 9 described in Example 1. As a result, the present invention can provide a reduced formaldehyde vapor pressure-and a satisfactory anti-fading effect for a dye image without the formation of turbidity and precipitation of the processing solution.

While the invention has been described in detail and with reference to specific embodiments thereof, it will be apparent to one skilled in the art that various changes and modifications can be made therein without departing from the spirit and scope thereof.

What is claimed is:

1. A photographic stabilizing solution having a stabilizing ability for a magenta dye image comprising formaldehyde, wherein said photographic stabilizing solution further contains an amine compound having at least one —NH— group which is represented by formula (I'):

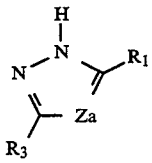

(I')

wherein the Za represents —N= or —C($R_2$)=, $R_1$, $R_2$ and $R_3$ may be the same or different and each represents a hydrogen atom or an unsubstituted alkyl group having from 1 to 3 carbon atoms; the above groups may be further substituted with the group represented by $R_1$ and a hydroxyl group; and $R_1$ and $R_2$ or $R_2$ and $R_3$ may be combined with each other to form a 5- to 7-membered ring and wherein the —NH— equivalent amount per liter of the photographic stabilizing solution is greater than the molar concentration of formaldehyde in the photographic stabilizing solution.

2. A photographic stabilizing solution as in claim 1, wherein each of $R_1$, $R_2$ and $R_3$ are hydrogen atoms.

3. A photographic stabilizing solution as in claim 1, wherein the amine compound is present in the —NH— equivalent amount of 1.5 times or more the molar concentration of formaldehyde in the photographic stabilizing solution.

4. A photographic stabilizing solution as in claim 1, wherein the amine compound is present in the —NH— equivalent amount of 2 times or more the molar concentration of formaldehyde in the photographic stabilizing solution.

5. A photographic stabilizing solution as in claim 1, wherein the amine compound is present in the —NH— equivalent amount of 5 times or more the molar concentration of formaldehyde in the photographic stabilizing solution.

6. A photographic stabilizing solution as in claim 1, wherein the concentration of the amine compound having at least one —NH— group in the photographic stabilizing solution is from 0.003 to 0.3 mol per liter.

7. A photographic stabilizing solution as in claim 1, wherein the total concentration of formaldehyde in the photographic stabilizing solution is 0.005 mole/liter or less.

8. A photographic stabilizing solution as in claim 1, further containing an N-methylol product of the amine compound.

9. A photographic stabilizing solution as in claim 8, wherein the content of the N-methylol product of the amine compound is from 0.001 to 0.2 mole per liter of the photographic stabilizing solution.

10. A photographic stabilizing solution as in claim 1, wherein the amine compound having at least one —NH— group is added to the photographic stabilizing solution in an equivalent amount of from 1.5 to 5 times the molar amount of formaldehyde.

* * * * *